US009950537B2

(12) United States Patent
Kodama et al.

(10) Patent No.: US 9,950,537 B2
(45) Date of Patent: Apr. 24, 2018

(54) CARTRIDGE AND PRINTING MATERIAL SUPPLY SYSTEM

(71) Applicant: SEIKO EPSON CORPORATION, Tokyo (JP)

(72) Inventors: Hidetoshi Kodama, Matsumoto (JP); Izumi Nozawa, Matsumoto (JP); Tadahiro Mizutani, Shiojiri (JP); Kazutoshi Matsuzaki, Shiojiri (JP); Kazumasa Harada, Matsumoto (JP); Satoshi Nakata, Matsumoto (JP); Hidetaka Kawata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/259,549

(22) Filed: Sep. 8, 2016

(65) Prior Publication Data

US 2016/0375688 A1 Dec. 29, 2016

Related U.S. Application Data

(60) Continuation of application No. 14/539,338, filed on Nov. 12, 2012, which is a division of application No.
(Continued)

(30) Foreign Application Priority Data

Jan. 12, 2012 (JP) ..... 2012-003650
Jan. 12, 2012 (JP) ..... 2012-003652
(Continued)

(51) Int. Cl.
*B41J 2/175* (2006.01)

(52) U.S. Cl.
CPC ..... *B41J 2/1752* (2013.01); *B41J 2/17523* (2013.01)

(58) Field of Classification Search
None
See application file for complete search history.

(56) References Cited

U.S. PATENT DOCUMENTS 4,907,018 A 3/1990 Pinkerpell et al.
6,276,780 B1 8/2001 Carrese et al.
(Continued)

FOREIGN PATENT DOCUMENTS

DE 10 2006 036 716 B3 9/2007
DE 102006036716 B3 9/2007
(Continued)

OTHER PUBLICATIONS

Notification of Reasons for Refusal dated Jan. 12, 2017 in Japanese Patent Appln. No. 2013-039204.
(Continued)

*Primary Examiner* — Erica Lin
(74) *Attorney, Agent, or Firm* — Foley & Lardner LLP

(57) ABSTRACT

A printing material supply system 10 includes a printer 50 equipped with a holder 600 and cartridges 20 that are detachably attached to the holder 600. The holder 600 has a first apparatus-side locking element 810 and a lever 800. The first apparatus-side locking element 810 is formed as part of the lever 800. The cartridge 20 has a first cartridge-side locking element 210 that includes a first locking surface 211 to engage with the first apparatus-side locking element 810. The first cartridge-side locking element 210 has an extended surface 219 that prevents a negative Z-axis end 818 of the lever 800 from running on the first locking surface 211.

7 Claims, 40 Drawing Sheets

Related U.S. Application Data

13/739,609, filed on Jan. 11, 2013, now Pat. No. 8,915,582.

(30) Foreign Application Priority Data

Jan. 12, 2012 (JP) ..... 2012-003653
Jan. 12, 2012 (JP) ..... 2012-003694
Jan. 12, 2012 (JP) ..... 2012-003698

(56) References Cited

U.S. PATENT DOCUMENTS

| | | | |
|---|---|---|---|
| 6,488,369 | B1 | 12/2002 | Steinmetz et al. |
| 6,502,917 | B1 | 1/2003 | Shinada et al. |
| 6,953,242 | B2 | 10/2005 | Yoshiyama et al. |
| 6,955,422 | B2 | 10/2005 | Miyazawa et al. |
| 6,979,079 | B2 | 12/2005 | Hashii et al. |
| 7,213,914 | B2 | 5/2007 | Anma et al. |
| 7,237,881 | B2 | 7/2007 | Hayasaki et al. |
| 7,244,018 | B2 | 7/2007 | Hashii et al. |
| 7,278,721 | B2 | 10/2007 | Shimizu et al. |
| 7,452,066 | B2 | 11/2008 | Tsuji |
| 7,562,958 | B2 | 7/2009 | Asaushi |
| 7,712,986 | B2 | 5/2010 | DeVore et al. |
| 8,172,386 | B2 | 5/2012 | Petranek et al. |
| 8,177,340 | B2 | 5/2012 | Harazim |
| 8,297,738 | B1 | 10/2012 | Kodama et al. |
| 8,297,739 | B1 | 10/2012 | Kodama et al. |
| 8,439,482 | B1 | 5/2013 | Kodama et al. |
| 2002/0135634 | A1 | 9/2002 | Lodal et al. |
| 2002/0140778 | A1 | 10/2002 | Yoshiyama et al. |
| 2005/0151811 | A1 | 7/2005 | Shimizu et al. |
| 2005/0168546 | A1 | 8/2005 | Studholme et al. |
| 2005/0185034 | A1* | 8/2005 | Anma ..... B41J 2/17546 347/86 |
| 2006/0139422 | A1 | 6/2006 | Hatasa et al. |
| 2006/0250426 | A1 | 11/2006 | Wanibe et al. |
| 2007/0279464 | A1 | 12/2007 | Harazim |
| 2008/0049080 | A1 | 2/2008 | Hayashi et al. |
| 2008/0049081 | A1 | 2/2008 | Hayashi et al. |
| 2008/0211892 | A1 | 9/2008 | Kotaki et al. |
| 2009/0051745 | A1 | 2/2009 | Watanabe et al. |
| 2009/0096850 | A1 | 4/2009 | Sulser et al. |
| 2009/0147062 | A1 | 6/2009 | Sulser |
| 2010/0253754 | A1 | 10/2010 | Sulser et al. |
| 2010/0321451 | A1 | 12/2010 | Bianco et al. |
| 2011/0012962 | A1 | 1/2011 | Nakano et al. |
| 2011/0063386 | A1 | 3/2011 | Petranek et al. |
| 2012/0056955 | A1 | 3/2012 | Kodama et al. |
| 2012/0056956 | A1 | 3/2012 | Kodama et al. |
| 2012/0256991 | A1 | 10/2012 | Kodama et al. |
| 2013/0182046 | A1 | 7/2013 | Kodama et al. |
| 2013/0182047 | A1 | 7/2013 | Nozawa et al. |
| 2013/0182048 | A1 | 7/2013 | Nozawa et al. |
| 2013/0182049 | A1 | 7/2013 | Kodama et al. |
| 2013/0182052 | A1 | 7/2013 | Matsuzaki et al. |
| 2013/0182053 | A1 | 7/2013 | Kodama et al. |
| 2014/0152746 | A1 | 6/2014 | Kodama et al. |
| 2014/0210917 | A1 | 7/2014 | Kodama et al. |
| 2014/0368585 | A1 | 12/2014 | Nozawa et al. |
| 2016/0129696 | A1 | 5/2016 | Nozawa et al. |
| 2016/0375688 | A1 | 12/2016 | Kodama et al. |

FOREIGN PATENT DOCUMENTS

| | | | |
|---|---|---|---|
| EP | 0698497 | A3 | 3/1999 |
| EP | 1 114 726 | A1 | 7/2001 |
| EP | 1 547 783 | A2 | 6/2005 |
| EP | 1547782 | A2 | 6/2005 |
| EP | 1547783 | A2 | 6/2005 |
| EP | 1547783 | A3 | 11/2006 |
| EP | 1892104 | A1 | 2/2008 |
| EP | 2269827 | A1 | 5/2011 |
| JP | 2000062212 | A | 2/2000 |
| JP | 2002-019142 | A | 1/2002 |
| JP | 2003-011390 | A | 1/2003 |
| JP | 2003025599 | A | 1/2003 |
| JP | 2003053999 | A | 2/2003 |
| JP | 2004-209663 | A | 7/2004 |
| JP | 2004209663 | A | 7/2004 |
| JP | 2005-022345 | A | 1/2005 |
| JP | 2005-144723 | A | 6/2005 |
| JP | 2007-230249 | A | 9/2007 |
| JP | 5218712 | B1 | 3/2013 |
| JP | 5435149 | B | 12/2013 |
| KR | 1020060091275 | A | 8/2006 |
| WO | 2009/143422 | A2 | 11/2009 |

OTHER PUBLICATIONS

International Search Report and the Written Opinion of the International Searching Authority dated Dec. 14, 2012 in International Application No. PCT/JP2012/001395, filed on Mar. 1, 2012.

International Search Report and the Written Opinion of the International Searching Authority dated Dec. 17, 2012 in International Application No. PCT/JP2012/001397, filed on Mar. 1, 2012.

International Search Report and the Written Opinion of the International Searching Authority dated Dec. 17, 2012 in International Application No. PCT/JP2012/001409, filed on Mar. 1, 2012.

International Search Report and the Written Opinion of the International Searching Authority dated Dec. 17, 2012 in International Application No. PCT/JP2012/001410, filed on Mar. 1, 2012.

Office Action dated May 25, 2012 in U.S. Appl. No. 13/410,461 (now U.S. Pat. No. 8,297,738), filed Mar. 2, 2012.

Office Action dated May 25, 2012 in U.S. Appl. No. 13/410,478 (now U.S. Pat. No. 8,297,739), filed Mar. 2, 2012.

Combined Search and Examination Report dated Jun. 3, 2013 in U.K. Patent Appln. No. GB1300618.4.

Extended European Search Report dated Sep. 10, 2014 in European Application No. 13192668.5.

Examiner's Report dated Sep. 9, 2014 in Canadian Patent Application No. 2,807,789.

Chinese Office Action and English translation of Chinese Office Action dated Sep. 23, 2014 in Chinese Patent Application No. 201280003040.0.

Extended European Search Report dated Mar. 10, 2015 in European Patent Application No. 14195157.4.

Examination Report dated May 18, 2015 in Australian Patent Application No. 2014203079.

Non-Final Office Action dated Apr. 16, 2015 in U.S. Appl. No. 14/459,901.

Notice of Reasons for Rejection issued in Japanese Patent Application No. 2013-247318 dated Dec. 1, 2015 with English translation.

Office Action dated Jan. 5, 2016 in Taiwanese Patent Application No. 101106802 and its English translation.

Office Action dated Jan. 6, 2016 in Taiwanese Patent Application No. 101106812 and its English translation.

Taiwanese Office Action and English translation of Taiwanese Office Action dated May 9, 2017 in Taiwanese Patent Application No. 101106803.

Korean Office Action with English translation dated Apr. 3, 2017 in Korean Patent Application No. 10-2016-7015688.

Office Action dated Oct. 13, 2017 in related Chilean Application No. 201400624 with English-language comments regarding same (23 pgs.).

Australian Office Action dated Jun. 26, 2017 in Australian Patent Application No. 2016201351.

Chinese Office Action with English Translation dated Jun. 20, 2017 in Chinese Patent Application No. 201610630627.4.

Extended European Search Report dated Jul. 13, 2017 in European Patent Application No. 12823217.0.

Office Action dated Sep. 14, 2017 in related U.S. Appl. No. 14/969,977 (14 pgs.).

Office Action dated Sep. 29, 2017 in related Malaysian Appl. PI 2014700258 (3 pgs.).

(56) References Cited

OTHER PUBLICATIONS

Office Action dated Sep. 7, 2017 in related Taiwanese Appl. 105134322 with English-language translation (10 pgs.).
Examination Report No. 2 dated Dec. 6, 2017 in related Australian Appl. No. 2016201351 (4 pgs.).
Notice of Allowance dated Feb. 8, 2018 in related U.S. Appl. No. 14/969,977.
Philippine Office Action dated Feb. 22, 2018 in corresponding application No. 1/2014/500307.

* cited by examiner

SECTION F5-F5

CARTRIDGE AND PRINTING MATERIAL SUPPLY SYSTEM

CROSS-REFERENCE TO RELATED APPLICATIONS

The present application is a continuation of co-pending U.S. patent application Ser. No. 14/539,338 filed on Nov. 12, 2014 which is a divisional application of U.S. patent application Ser. No. 13/739,609 filed on Jan. 11, 2013, which claims the priority based on Japanese Patent Applications No. 2012-003650, No. 2012-003652, No. 2012-003653, No. 2012-003694 and No. 2012-003698 filed on Jan. 12, 2012, the disclosures of each of which are hereby incorporated by reference in its entirety.

BACKGROUND

1. Technical Field

The present invention relates to a cartridge and a printing material supply system including the cartridge and a printing apparatus.

2. Related Art

Latest cartridges generally have a circuit board with information regarding printing material (e.g., information on an remaining amount of printing material). For attachment of this cartridge to a printing apparatus, the circuit board on the cartridge is electrically connected with the printing apparatus through contact of cartridge-side terminals with terminals on the printing apparatus. With size reduction of the terminals, it is of great importance to properly attach the cartridge at a designed attachment position.

Various mechanisms have been proposed to removably attach the cartridge to a cartridge mounting structure of the printing apparatus. For example, JP 2007-230249 (PTL1) and JP 2005-022345 (PTL2) describe a mechanism for attachment of the cartridge to the cartridge mounting structure, wherein a lever with a first locking element is formed integrally with one side face of the cartridge, a second locking element is provided on the other side face of the cartridge opposite to one side face with the first locking element, and the first locking element and the second locking element of the cartridge are respectively locked by the cartridge mounting structure.

JP2002-019142 (PTL3) describes another mechanism for attachment of the cartridge to the cartridge mounting structure, wherein a first locking element and a second locking element are provided on two side faces of the cartridge opposite to each other, a lever to be engaged with the first locking element is formed integrally with the cartridge mounting structure, and the first locking element and the second locking element of the cartridge are respectively locked by the cartridge mounting structure.

In the proposed mechanism described in PTL1, in the attached state of the cartridge to the cartridge mounting structure, the repulsive force applied from the printing material supply tube of the cartridge mounting structure to the printing material supply port of the cartridge or the pressing force applied by the spring contact of the cartridge mounting structure acts in the direction of detaching the cartridge from the cartridge mounting structure. Similarly, the repulsive force of the spring or the seal member provided on the printing material supply port in the proposed mechanism described in PTL2 or the repulsive force of the spring provided in the vicinity of the printing material supply tube in the proposed mechanism described in PTL3 acts in the direction of detaching the cartridge from the cartridge mounting structure. The first locking element and the second locking element serve to interfere with such forces in any of the mechanisms described in PTL1 to PTL3.

SUMMARY

The structures of PTL1 and PTL2 need the first locking element provided between the operating member of the lever and the axis of rotation of the lever. In order to readily unlock the first locking element of the lever from the locking element of the cartridge mounting structure, a relatively large distance is required between the lever and the side face of the cartridge with the lever. This is achieved by increasing the length of the lever and locating the first locking element closer to the operating member. This disadvantageously interferes with size reduction of the cartridge and leads to size expansion of the printing apparatus, which the cartridge is detachably attached to. According to the structures of PTL1 and PTL2, the elastically deformable lever is formed integrally with the wall surface of the cartridge. This limits the available material satisfying the contradictory features, i.e., the rigidness required for the wall surface and the flexibility required for elastic deformation of the lever, in addition to the formability of the cartridge wall surface and the lever to a narrow range, for example, polypropylene (PP). According to the structures of PTL1 and PTL2, the flexibility of the material required for elastic deformation of the lever may cause plastic deformation of the lever by the stress generated on the lever in the attached state of the cartridge to the cartridge mounting structure and may lead to difficulty in stably holding the cartridge at the designed attachment position. Such difficulty in stably holding the cartridge at the designed attachment position may lead to the positional misalignment between the cartridge-side terminals and the printing apparatus-side terminals and result in poor conduction.

According to the structure of PTL3, on the other hand, the lever is provided not on the cartridge but on the cartridge mounting structure, which allows size reduction of the cartridge. Based on the moment balance about the second locking element as the pivot point of rotation, however, the pressing force applied from the cartridge mounting structure to the cartridge tends to act in the direction of disengaging the first locking element from the cartridge mounting structure and may cause detachment of the cartridge from the cartridge mounting structure. There is accordingly difficulty in applying the structure of PTL3 to the mechanisms of PTL1 and PTL2 that require secure contact between the cartridge-side terminals and the printing apparatus-side terminals.

Consequently, by taking into account the above problems, there is a requirement to provide technology that ensures stable electrical connection between cartridge-side terminals and apparatus-side terminals. There is also a requirement to provide technology that enables downsizing of a cartridge, a printing apparatus and furthermore a printing material supply system that is completed by attaching the cartridge to the printing apparatus.

In order to achieve at least part of the foregoing, the invention provides various aspects and embodiments described below.

According to a first aspect, there is provided a cartridge configured to be removably attached to a cartridge mounting structure of a printing apparatus. The cartridge mounting structure comprises a printing material supply tube, an apparatus-side terminal constructed to apply a pressing force to the cartridge when the cartridge is mounted to the cartridge mounting structure, a lever having an apparatus-side locking element. The cartridge includes a first face, a second face, a third face, a fourth face, a fifth face, a sixth face, a sloped surface, a printing material supply port, a cartridge-side terminal, and a cartridge-side locking element. The first face is located on a negative Z-axis side and the second face is located on a positive Z-axis side, as two faces is opposed to each other in a Z-axis direction. The third face are located on a positive X-axis side and the fourth face is located on a negative X-axis side, as two faces are opposed to each other in an X-axis direction and intersecting the first face and the second face. The fifth face is located on a positive Y-axis side and the sixth face is located on a negative Y-axis side, as two faces are opposed to each other in a Y-axis direction and intersecting the first, second, third and fourth faces. The sloped surface is provided in a corner section arranged to connect the first face with the third face and inclined in the negative Z-axis direction and in the positive X-axis direction. The printing material supply port is provided on the first face and configured to be connectable with the printing material supply tube. The cartridge-side terminal is provided on the sloped surface and configured to be in contact with the apparatus-side terminal while receiving the pressing force including the positive Z-axis component from the apparatus-side terminal, so as to be electrically connected with the apparatus-side terminal, in the attached state of the cartridge to the cartridge mounting structure. The cartridge-side locking element is provided on the third face. The cartridge-side locking element has a locking surface that faces in the positive Z-axis direction. The locking surface is configured to engage with the apparatus-side locking element in the attached state of the cartridge to the cartridge mounting structure. An engagement-preventing structure is provided on the positive Z-axis side of the locking surface of the cartridge-side locking element to prevent engagement between a negative Z-axis end of the lever and the locking surface.

According to the first aspect, the lever is provided not on the cartridge but on the cartridge mounting structure. The structure of this aspect enables downsizing of the cartridge. This structure also decreases the distance between the side wall of the cartridge and the lever and enables downsizing of the lever, thus reducing the size of the printing apparatus and the entire size of the printing material supply system. Since the lever is not provided on the cartridge, there is the enhanced flexibility in selection of the material used for the housing of the cartridge. In other words, the material having relatively high rigidity is usable as the material for this component. This reduces the possibility of plastic deformation described above. The cartridge can thus be held in the stable state at a designed attachment position. Additionally, the structure of this aspect enables the cartridge to be attached at the designed attachment position with effectively preventing the lever from running on the locking surface.

In the cartridge according to a second aspect, the engagement-preventing element may be formed in a specific shape that prevents an end of the lever from moving into a projected area of the locking surface in the positive Z-axis direction. The structure of this aspect prevents the lever from running on the locking surface.

In the cartridge according to a third aspect, the engagement-preventing element may be formed in a specific shape that enables an end of the lever that has moved to the positive Z-axis side of the locking surface to be guided to the negative Z-axis side of the locking surface. The structure of this aspect enables the lever deviated from the normal position to be returned to the normal position.

In the cartridge according to a fourth aspect, the engagement-preventing element may be formed integrally with the cartridge-side locking element. This advantageously simplifies the structure of the cartridge.

In the cartridge according to a fifth aspect, the cartridge-side locking element may be formed on a positive X-axis side of the locking surface to have an end surface parallel to the Y axis and the Z axis, and the engagement-preventing element may be arranged to have an extended surface formed by extending part of the end surface in the positive Z-axis direction. The structure of this aspect facilitates formation of the engagement-preventing element.

According to a sixth aspect, there is provided a printing material supply system includes a printing apparatus and a cartridge according to any one of the first to fifth aspects. The printing apparatus has a cartridge mounting structure. The cartridge is removably attached to the cartridge mounting structure. The cartridge mounting structure is configured to receive a plurality of the cartridges attached thereto and to have a printing material supply tube, an apparatus-side terminal, and a lever having an apparatus-side locking element provided for each of the cartridges. The printing material supply tube has a peripheral end to be connected with the cartridge. A Z axis represents an axis parallel to a central axis C of the printing material supply tube. An X axis represents an axis, along which the printing material supply tube and the apparatus-side terminal are arrayed and which is orthogonal to the Z axis. A Y axis represents an axis orthogonal to both the Z axis and the X axis. A positive Z-axis direction represents a direction along the Z axis going from a base end to the peripheral end of the printing material supply tube. A negative Z-axis direction represents a reverse direction to the positive Z-axis direction. A positive X-axis direction represents a direction along the X axis going from the printing material supply tube to the apparatus-side terminal. A negative X-axis direction represents a reverse direction to the positive X-axis direction.

The apparatus-side terminal is configured to be in contact with the cartridge while applying a pressing force including a positive Z-axis component to the cartridge, so as to electrically connectable with the cartridge. The apparatus-side locking element is configured as part of the lever to lock the cartridge at a position on a positive Z-axis side and on a positive X-axis side of the apparatus-side terminal. The lever is configured to turn about a pivotal center on a positive Z-axis side and on a positive X-axis side of a locking position where the apparatus-side locking element locks the cartridge, so as to move the apparatus-side locking element from the locking position in the positive X-axis direction and thereby allow the apparatus-side locking element to lock and unlock the cartridge.

The structure of this aspect has the similar advantageous effects to those of the first to fifth aspects.

In the printing material supply system according to a seventh aspect, the lever may be arranged to have an undercut element formed by cutting out a specific part corresponding to the engagement-preventing element in a state that the apparatus-side locking element engages with the cartridge-side locking element. The structure of this aspect avoids interference between the engagement-preventing element and the lever in the state that the apparatus-side locking element engages with the locking surface.

According to a eighth aspect, there is provided a cartridge configured to be removably attached to a cartridge mounting structure of a printing apparatus. The cartridge mounting structure comprises a printing material supply tube, an apparatus-side terminal constructed to apply a pressing force to the cartridge when the cartridge is mounted to the cartridge mounting structure, a lever having an apparatus-side locking element. The cartridge includes a first face, a second face, a third face, a fourth face, a fifth face, a sixth face, a printing material supply port, a first cartridge-side locking element and a second cartridge-side locking element. The first face is located on a negative Z-axis side and the second face is located on a positive Z-axis side, as two faces is opposed to each other in a Z-axis direction. The third face are located on a positive X-axis side and the fourth face is located on a negative X-axis side, as two faces are opposed to each other in an X-axis direction and intersecting the first face and the second face. The fifth face is located on a positive Y-axis side and the sixth face is located on a negative Y-axis side, as two faces are opposed to each other in a Y-axis direction and intersecting the first, second, third and fourth faces. The printing material supply port is provided on the first face, provided to have an open surface with an opening formed on a plane parallel to the X-axis and the Y-axis, and configured to be connectable with the printing material supply tube via the open surface while being subjected to a pressing force including a positive Z-axis component to the open surface. The cartridge-side locking element is provided on the third face. The cartridge-side locking element has a locking surface that faces in the positive Z-axis direction. The locking surface is configured to engage with the apparatus-side locking element in the attached state of the cartridge to the cartridge mounting structure. An engagement-preventing structure is provided on the positive Z-axis side of the locking surface of the cartridge-side locking element to prevent engagement between a negative Z-axis end of the lever and the locking surface.

The structure of this aspect has the similar advantageous effects to those of the first aspect.

According to a ninth aspect, there is provided a cartridge removably attached to a cartridge mounting structure of a printing apparatus. The printing apparatus includes: a printing material supply port, a cartridge-side locking element, and an engagement-preventing element. The printing material supply port is arranged to have an open surface with an opening formed on a protruded end. Printing material is supplied to the printing apparatus via the open surface. The cartridge-side locking element is located on a positive Z-axis side of the open surface of the printing material supply port and arranged to have a locking surface that faces in a positive Z-axis direction and engages with an apparatus-side locking element of a lever in an attached state of the cartridge to the cartridge mounting structure. A negative Z-axis direction represents a protruding direction of the printing material supply port, and the positive Z-axis direction represents a reverse direction to the negative Z-axis direction. The engagement-preventing element is located on the positive Z-axis side of the locking surface and arranged to prevent engagement between a negative Z-axis end of the lever and the locking surface. The structure of this aspect has the similar advantageous effects to those of the first aspect.

The invention is not limited to the cartridge or the printing material supply system described above but may be implemented by diversity of other aspects, for example, a liquid cartridge, a liquid container, a printing material container, a cartridge adapter, a circuit board, a printing apparatus, a liquid ejection device, and a liquid supply system including a liquid ejection device and a liquid cartridge. The invention is not limited to the above aspects, but a multiplicity of variations and modifications may be made to these aspects without departing from the scope of the invention.

BRIEF DESCRIPTION OF THE DRAWINGS

The invention will be described with reference to the accompanying drawings in which.

DESCRIPTION OF THE PREFERRED EMBODIMENTS

In order to further clarify the configurations and the operations of the invention, embodiments of a printing material supply system according to the invention are described below with reference to the accompanied drawings.

A. First Embodiment

A-1. General Configuration of Printing Material Supply System

Figure 1:
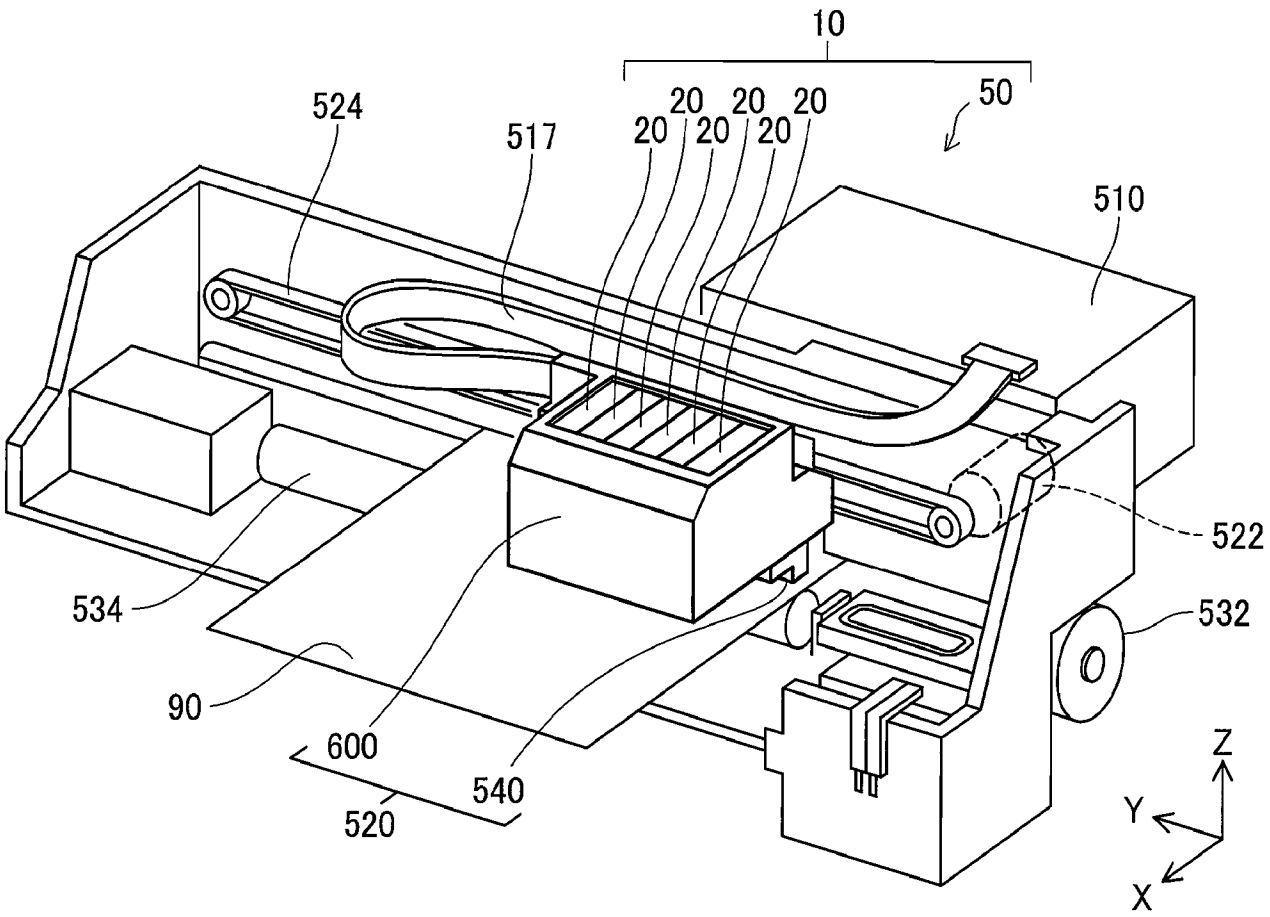
FIG. 1 is a perspective view illustrating the configuration of a printing material supply system.

FIG. 1 is a perspective view illustrating the configuration of a printing material supply system 10. XYZ axes orthogonal to one another are shown in FIG. 1. The XYZ axes in FIG. 1 correspond to the XYZ axes in the other drawings. According to this embodiment, the Z axis represents vertical direction. The printing material supply system 10 includes cartridges 20 and a printer (printing apparatus) 50. In the printing material supply system 10, the cartridges 20 are removably attached to a holder (cartridge mounting structure) 600 of the printer 50 by the user.

Each of the cartridges 20 in the printing material supply system 10 is a cartridge (ink cartridge) serving to contains ink (printing material) and is structured to be removably attached to the printer 50. The ink as the printing material contained in the cartridge 20 is supplied through a printing material supply port and a printing material supply tube (described later) to a head 540 of the printer 50. According to this embodiment, a plurality of the cartridges 20 are removably attached to the holder 600 of the printer 50. More specifically, six cartridges 20 respectively containing six different color inks (black, yellow, magenta, light magenta, cyan and light cyan) are attached to the holder 600.

The number of cartridges attached to the holder 600 is not limited to six but may be changed to any arbitrary number, i.e., less than six or greater than six, according to the structure of the printer 50. The number of different color inks contained in the cartridges 20 is not limited to six colors but may be less than six colors (for example, four colors, black, yellow, magenta and cyan) or greater than six colors (for example, special glossy colors, such as metallic luster and pearl white, in addition to the ink colors of the embodiment). According to other embodiments, two or more cartridges 20 attached to the holder 600 may contain one identical color ink. The detailed structures of the cartridge 20 and the holder 600 will be described later.

The printer 50 of the printing material supply system 10 is constructed as an inkjet printer including the printing apparatus serving to supply ink (printing material). The printer 50 has a controller 510, a carriage 520, and a head 540, in addition to the holder 600. The printer 50 serves to supply ink from each of the cartridges 20 attached to the holder 600 to the head 540 (i.e., function of printing apparatus) and ejects ink from the head 540 onto a printing medium 90, such as printing sheet or label, so as to print various data, such as character strings, figures and images, on the printing medium 90.

The controller 510 of the printer 50 serves to control the various parts of the printer 50. The carriage 520 of the printer 50 is configured to move the head 540 relative to the printing medium 90. The head 540 of the printer 50 has an ink ejection mechanism configured to receive ink supply from each of the cartridges 20 attached to the holder 600 and eject the ink onto the printing medium 90. The controller 510 and the carriage 520 are electrically connected via a flexible cable 517. The ink ejection mechanism of the head 540 is operated by control signals from the controller 510.

According to this embodiment, the carriage 520 has the head 540 and the holder 600. This type of the printer 50 having the cartridges 20 attached to the holder 600 on the carriage 520 serving to move the head 540 is called "on-carriage type" printer.

According to another embodiment, the holder 600 may be provided at a different position from the carriage 520, and ink may be supplied from each of the cartridges 20 attached to the holder 600 to the head 540 of the carriage 520 through a flexible tube. This type of the printer is called "off-carriage type" printer.

According to this embodiment, the printer 50 has a main scan feed mechanism and a sub-scan feed mechanism to move the carriage 520 and the printing medium 90 relative to each other and implement printing on the printing medium 90. The main scan feed mechanism of the printer 50 includes a carriage motor 522 and a drive belt 524 and serves to transfer the power of the carriage motor 522 to the carriage 520 by means of the drive belt 524, so as to move back and forth the carriage 520 in a main scanning direction. The sub-scan feed mechanism of the printer 50 includes a feed motor 532 and a platen 534 and serves to transfer the power of the feed motor 532 to the platen 534, so as to feed the printing medium 90 in a sub-scanning direction orthogonal to the main scanning direction. The carriage motor 522 of the main scan feed mechanism and the feed motor 532 of the sub-scan feed mechanism are operated by control signals from the controller 510.

According to this embodiment, in the use state of the printing material supply system 10, the X axis represents the axis along the sub-scanning direction, in which the printing medium 90 is fed. The Y axis represents the axis along the main scanning direction, in which the carriage 520 is moved back and forth. The Z axis represents the axis along the direction of gravity. The X, Y and Z axes are orthogonal to one another. The use state of the printing material supply system 10 means the state of the printing material supply system 10 placed on a horizontal plane. In this embodiment, the horizontal plane is a plane parallel to the X axis and the Y axis.

According to this embodiment, the positive X-axis direction represents the sub-scanning direction, and the negative X-axis direction represents its reverse direction. In this embodiment, the positive X-axis side forms the front face of the printing material supply system 10. According to this embodiment, the positive Y-axis direction represents the direction going from the right side face to the left side face of the printing material supply system 10, and the negative Y-axis direction represents its reverse direction. In this embodiment, the plurality of cartridges 20 attached to the holder 600 are arrayed in the direction along the Y axis.

A-2. Structure for Attachment of Cartridge to Holder

Figure 2:
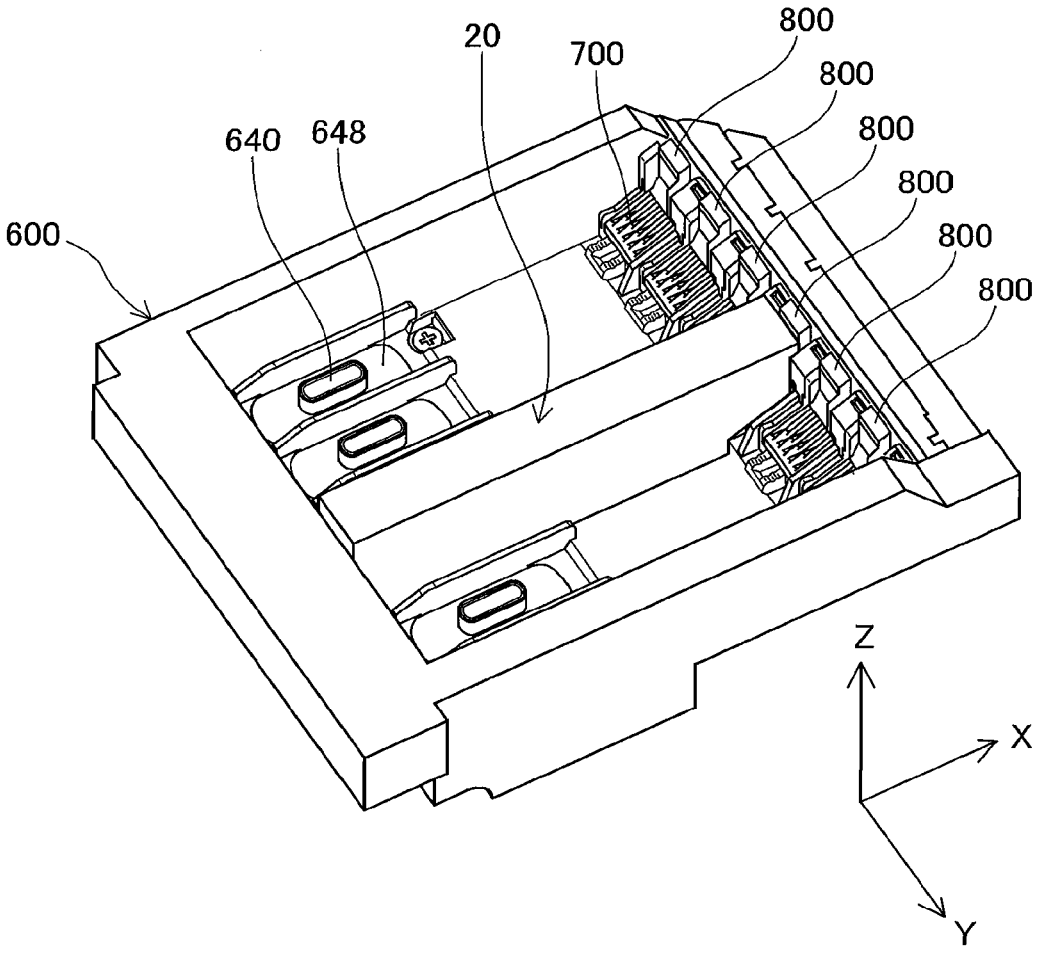
FIG. 2 is a perspective view illustrating a holder with a cartridge attached thereto.
Figure 3:
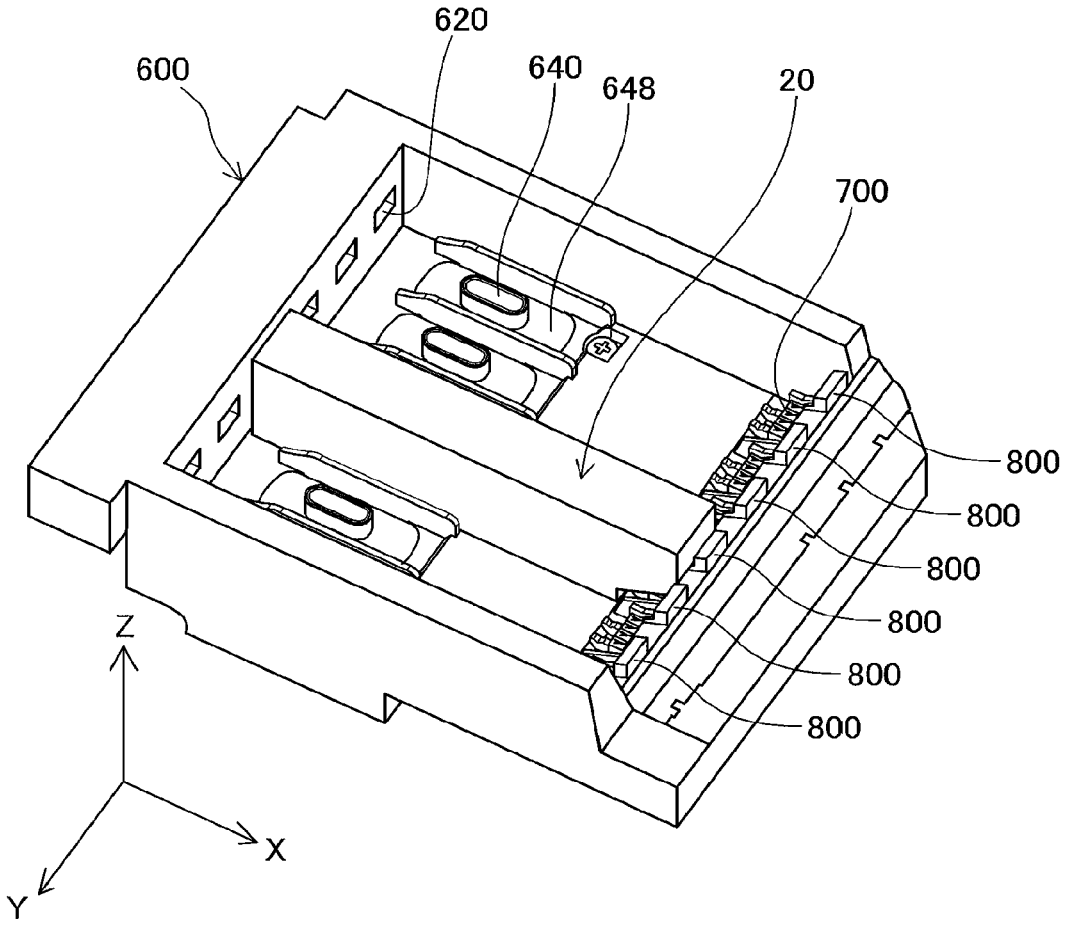
FIG. 3 is a perspective view illustrating the holder with the cartridge attached thereto.
Figure 4:
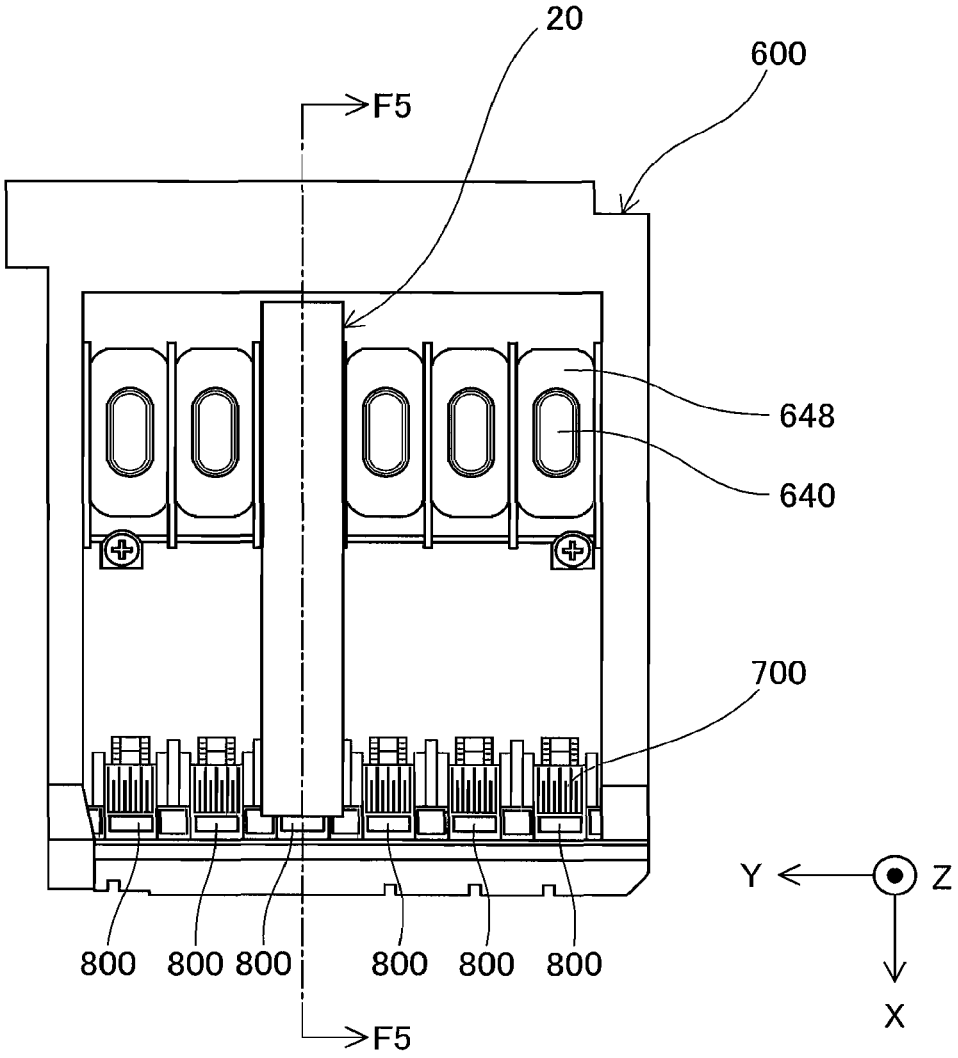
FIG. 4 is a top view illustrating the holder with the cartridge attached thereto.
Figure 5:
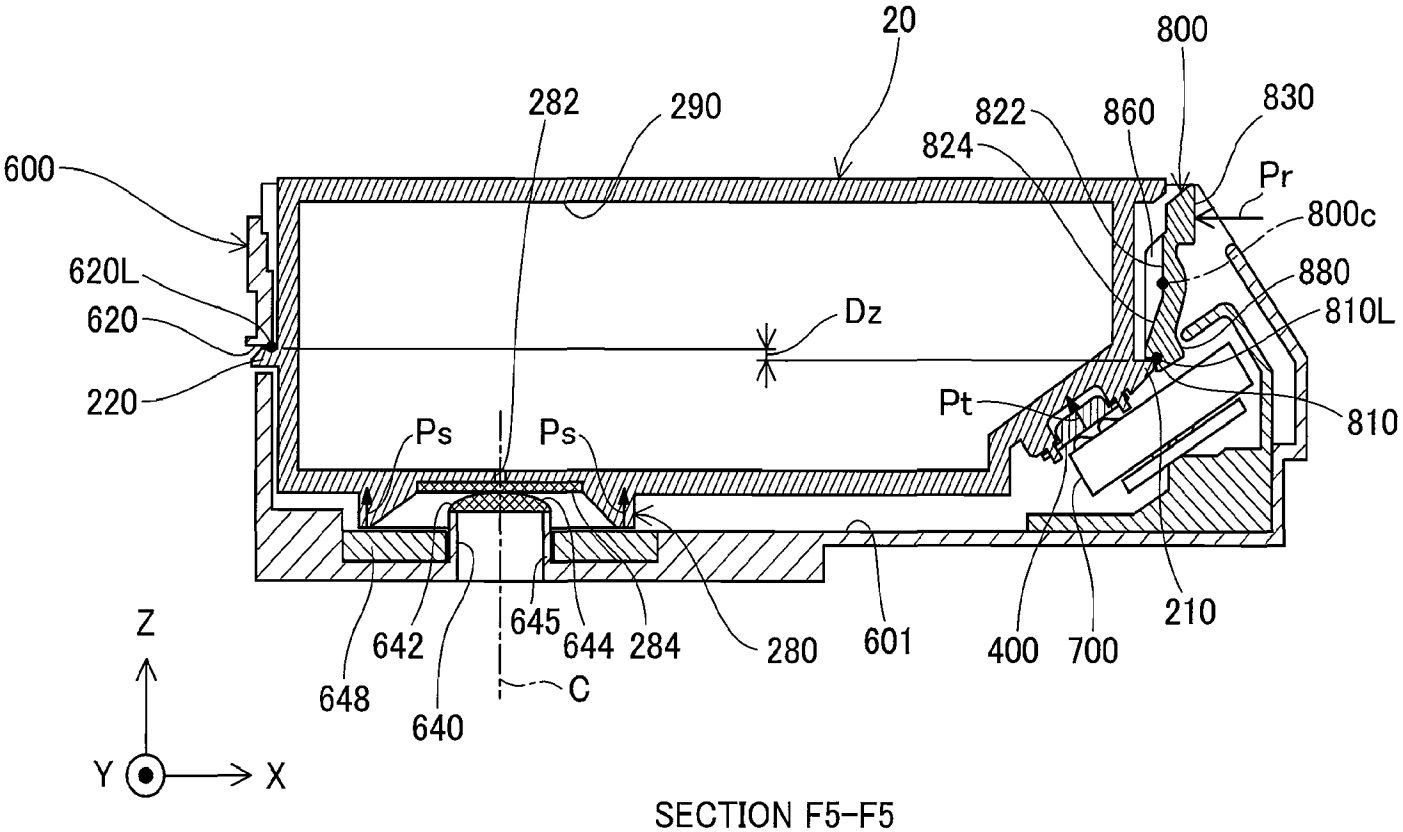
FIG. 5 is a sectional view illustrating the holder with the cartridge attached thereto, taken on an arrowed line F5-F5 in FIG. 4.

FIGS. 2 and 3 are perspective views illustrating the holder 600 with the cartridge 20 attached thereto. FIG. 4 is a top view illustrating the holder 600 with the cartridge 20 attached thereto. FIG. 5 is a sectional view of the holder 600 with the cartridge 20 attached thereto, taken on an arrowed line F5-F5 of FIG. 4. In the state illustrated in FIGS. 2 to 5, one cartridge 20 is properly attached at a designed attachment position of the holder 600.

The holder 600 of the printer 50 has a plurality of slots (mounting spaces) formed corresponding to the plurality of cartridges 20 to receive the respective cartridge 20 attached thereto. In the printer 50, each of the slots provided in the holder 600 has an ink supply tube (printing material supply tube) 640, a terminal base 700, a lever 800, a first apparatus-side locking element 810 and a second apparatus-side locking element 620.

As shown in FIG. 5, the cartridge 20 has a first cartridge-side locking element 210, a second cartridge-side locking element 220, an ink chamber (printing material chamber) 290, an ink supply port (printing material supply port) 280 and a circuit board 400 corresponding to each of the slots provided in the holder 600 of the printer 50. According to this embodiment, an ink flow path 282 communicating with the ink chamber 290 is formed at the ink supply port 280 of the cartridge 20, so that ink is supplied from the ink chamber 290 through the ink flow path 282 to outside of the cartridge 20. According to this embodiment, a resin foam 284 is provided at the exit of the ink flow path 282 to prevent unintentional leakage of ink from the ink flow path 282.

Connecting the ink supply tube 640 of the printer 50 with the ink supply port 280 of the cartridge 20 enables ink to be supplied from the ink chamber 290 of the cartridge 20 to the head 540. The ink supply tube 640 has a peripheral end 642 to be connected with the cartridge. A base end 645 of the ink supply tube 640 is provided on the bottom face of the holder 600. According to this embodiment, the ink supply tube 640 has a central axis C parallel to the Z axis as shown in FIG. 5. The direction going from the base end 645 to the peripheral end 642 of the ink supply tube 640 along the central axis C is the positive Z-axis direction.

According to this embodiment, a porous filter 644 serving to filter the ink supplied from the cartridge 20 is provided at the peripheral end 642 of the ink supply tube 640. The porous filter 644 may be made of, for example, stainless steel mesh or stainless steel woven fabric. According to another embodiment, the peripheral end 642 of the ink supply tube 640 may be configured without a porous filter.

According to this embodiment, as shown in FIGS. 2 to 5, an elastic member 648 is provided around the ink supply tube 640 to seal the ink supply port 280 of the cartridge 20 and thereby prevent leakage of ink from the ink supply port 280 to the periphery. In the attached state of the cartridge 20 to the holder 600, a pressing force Ps including a positive Z-axis component is applied from the elastic member 648 to the ink supply port 280.

The terminal base 700 of the printer 50 is provided on the positive X-axis side of the ink supply tube 640. The terminal base 700 has apparatus-side terminals that are electrically connectable with cartridge-side terminals provided on the circuit board 400. In the attached state of the cartridge 20 to the holder 600, a pressing force Pt including a positive Z-axis component is applied from the apparatus-side terminals provided on the terminal base 700 to the circuit board 400.

The first apparatus-side locking element 810 of the printer 50 is formed as part of the lever 800 to engage with the first cartridge-side locking element 210 at a first locking position 810L. The first locking position 810L is located on the positive Z-axis side and on the positive X-axis side of the contact position where the circuit board 400 is in contact with the apparatus-side terminals provided on the terminal base 700. The first apparatus-side locking element 810 engages with the first cartridge-side locking element 210 to restrict the motion of the cartridge 20 in the positive Z-axis direction.

The second apparatus-side locking element 620 of the printer 50 is formed as part of the holder 600 to engage with the second cartridge-side locking element 220 at a second locking position 620L. The second locking position 620L is located on the positive Z-axis side and the negative X-axis side of the ink supply tube 640. The second apparatus-side locking element 620 engages with the second cartridge-side locking element 220 to restrict the motion of the cartridge 20 in the positive Z-axis direction.

For attachment and detachment of the cartridge 20 to and from the holder 600, the cartridge 20 is turned along a plane parallel to the Z axis and the X axis about the engagement of the second cartridge-side locking element 220 and the second apparatus-side locking element 620 as the pivot point of rotation. The second cartridge-side locking element 220 and the second apparatus-side locking element 620 accordingly serve as the pivot point of rotation of the cartridge 20 during attachment and detachment of the cartridge 20. The details of attachment and detachment of the cartridge 20 to and from the holder 600 will be described later.

The lever 800 of the printer 50 has a pivotal center 800*c* on the positive Z-axis side and on the positive X-axis side of the first locking position 810L where the first apparatus-side locking element 810 engages with the first cartridge-side locking element 210. The lever 800 is provided to be rotatable such that the first apparatus-side locking element 810 moves in the positive X-axis direction from the first locking position 810L to engage with and disengage from the first cartridge-side locking element 210.

The lever 800 has an operating member 830 provided to receive the user's operating force Pr toward the negative X-axis direction and located on the positive Z-axis side and the positive X-axis side of the pivotal center 800*c*. The user's operating force Pr applied to the operating member 830 turns the lever 800 to move the first apparatus-side locking element 810 in the positive X-axis direction from the first locking position 810L and thereby disengage the first apparatus-side locking element 810 from the first cartridge-side locking element 210. The cartridge 20 can thus be detached from the holder 600.

As shown in FIG. 5, in the attached state of the cartridge 20 to the holder 600, the first locking position 810L is located on the negative Z-axis side by a distance Dz from the second locking position 620L. The pressing forces Ps and Pt applied from the holder 600 to the cartridge 20 act in the direction to enhance the engagement between the first cartridge-side locking element 210 and the first apparatus-side locking element 810 (i.e., the direction including a positive X-axis component and a positive Z-axis component), based on the moment balance with the second locking position 620L serving as the pivot point of rotation of the cartridge 20. This enables the cartridge 20 to be stably held at the designed attachment position.

Figure 6A:
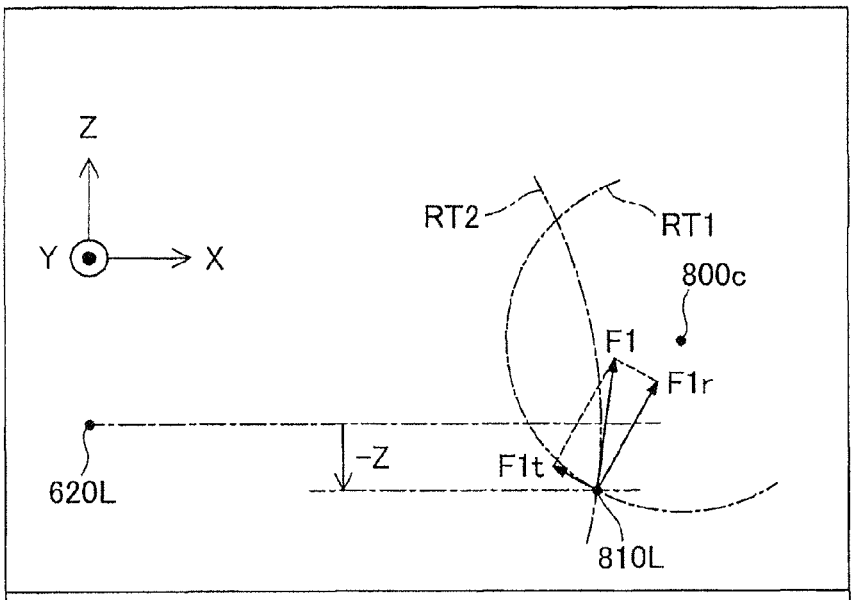
FIGS. 6A and 6B show how the force is applied from the cartridge to a lever at a first locking position.
Figure 6B:
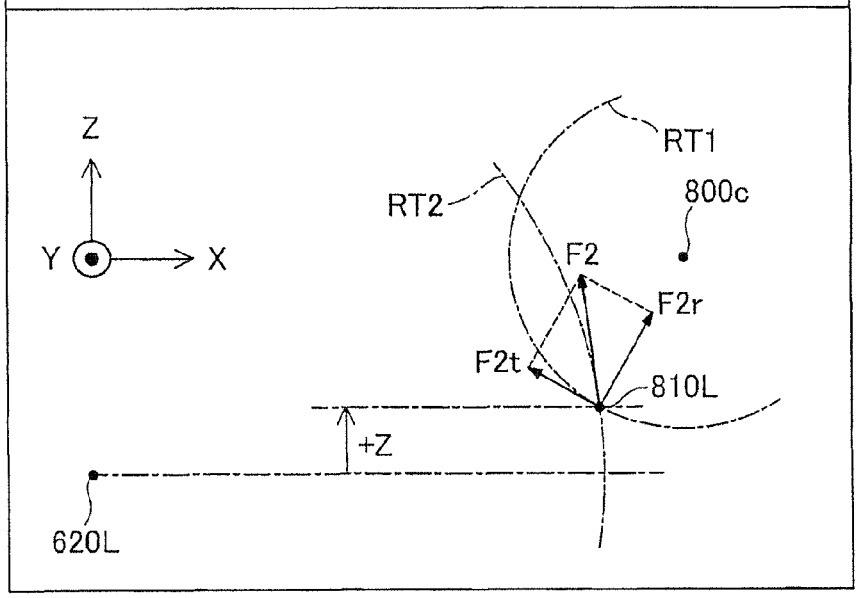

FIGS. 6A and 6B show how the force is applied from the cartridge 20 to the lever 800 at the first locking position 810L. In the state of FIG. 6A where the first locking position 810L is located on the negative Z-axis side of the second locking position 620L, a force F1 is applied from the cartridge 20 to the lever 800 at the first locking position 810L. In the state of FIG. 6B where the first locking position 810L is located on the positive Z-axis side of the second locking position 620L, a force F2 is applied from the cartridge 20 to the lever 800 at the first locking position 810L. The force F1 shown in FIG. 6A has the same magnitude as that of the force F2 shown in FIG. 6B.

FIGS. 6A and 6B schematically show the positional relationships of the first locking position 810L, the second locking position 620L and the pivotal center 800*c* to one another on the X axis and on the Z axis. The difference between the two positional relationships shown in FIGS. 6A and 6B is only the difference of the second locking position 620L on the Z axis. An arc RT1 shown in FIGS. 6A and 6B represents the rotation locus of the first locking position 810L about the pivotal center 800*c*. An arc RT2 shown in FIGS. 6A and 6B represents the rotation locus of the first locking position 810L about the second locking position 620L.

In the state of FIG. 6A where the first locking position 810L is located on the negative Z-axis side of the second locking position 620L, the force F1 applied in the tangential direction of the arc RT2 at the first locking position 810L has a positive X-axis component and a positive Z-axis component. The force F1 is accordingly resolved into a component F1*t* in the tangential direction of the arc RT1 and a component F1*r* in the radial direction of the arc RT1.

In the state of FIG. 6B where the first locking position 810L is located on the positive Z-axis side of the second locking position 620L, the force F2 applied in the tangential direction of the arc RT2 at the first locking position 810L has a negative X-axis component and a positive Z-axis component. The force F2 is accordingly resolved into a component F2*t* in the tangential direction of the arc RT1 and a component F2*r* in the radial direction of the arc RT1.

As clearly understood from the comparison between FIGS. 6A and 6B, when the magnitude of force F1 is equal to the magnitude of force F2 (F1=F2), the positional relationships of the first locking position 810L, the second locking position 620L and the pivotal center 800*c* to one another cause the relation "F1*t*<F2*t*" of the force components in the tangential direction of the arc RT1 and the relation "F1*r*>F2*r*" of the force components in the radial direction of the arc RT1. The state where the first locking position 810L is located on the negative Z-axis side of the second locking position 620L has the larger force component from the cartridge 20 toward the pivotal center 800*c* of the lever 800 and the smaller force component of rotating the lever 800 clockwise, viewed from the positive Y-axis direction, around the pivotal center 800*c* than the state where the first locking position 810L is located on the positive Z-axis side of the second locking position 620L. In other words, the state where the first locking position 810L is located on the negative Z-axis side of the second locking position 620L has the stronger engagement between the first cartridge-side locking element 210 and the first apparatus-side locking element 810 than the state where the first locking position 810L is located on the positive Z-axis side of the second locking position 620L.

A-3. Detailed Structure of Cartridge

Figure 7:
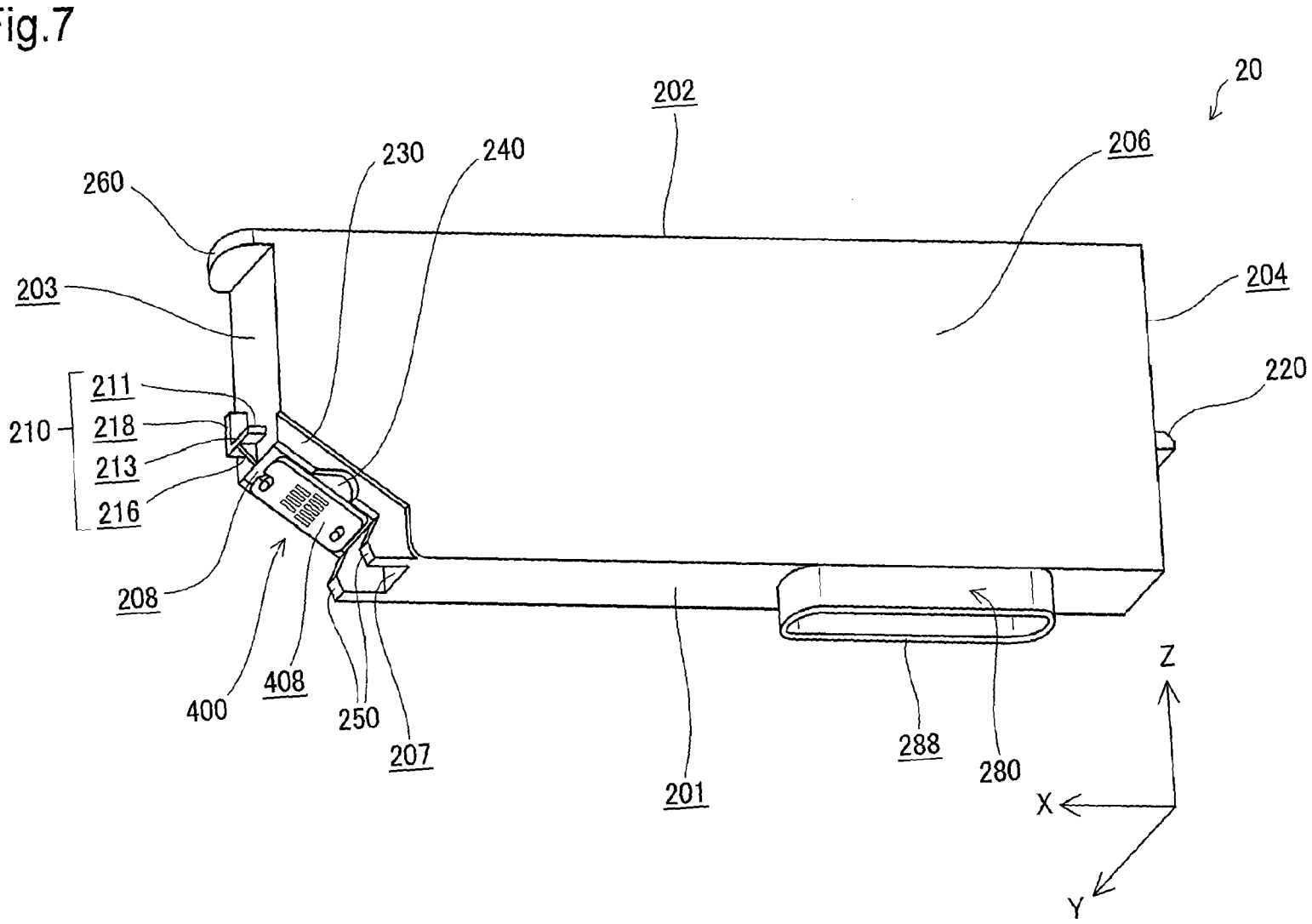
FIG. 7 is a perspective view illustrating the structure of the cartridge.
Figure 8:
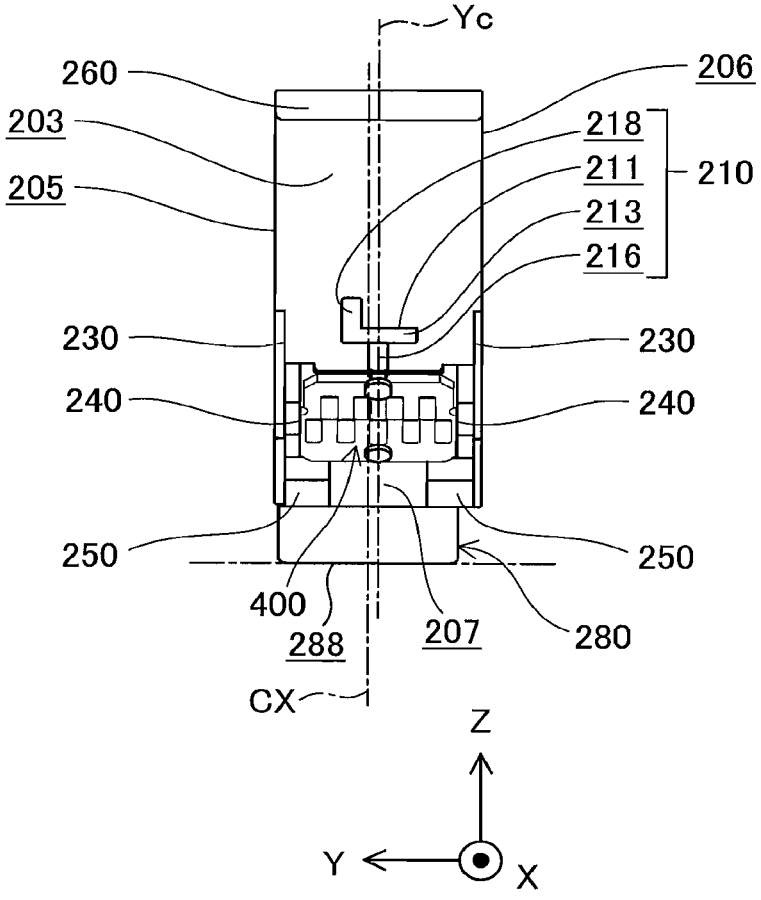
FIG. 8 is a front view illustrating the structure of the cartridge.
Figure 9:
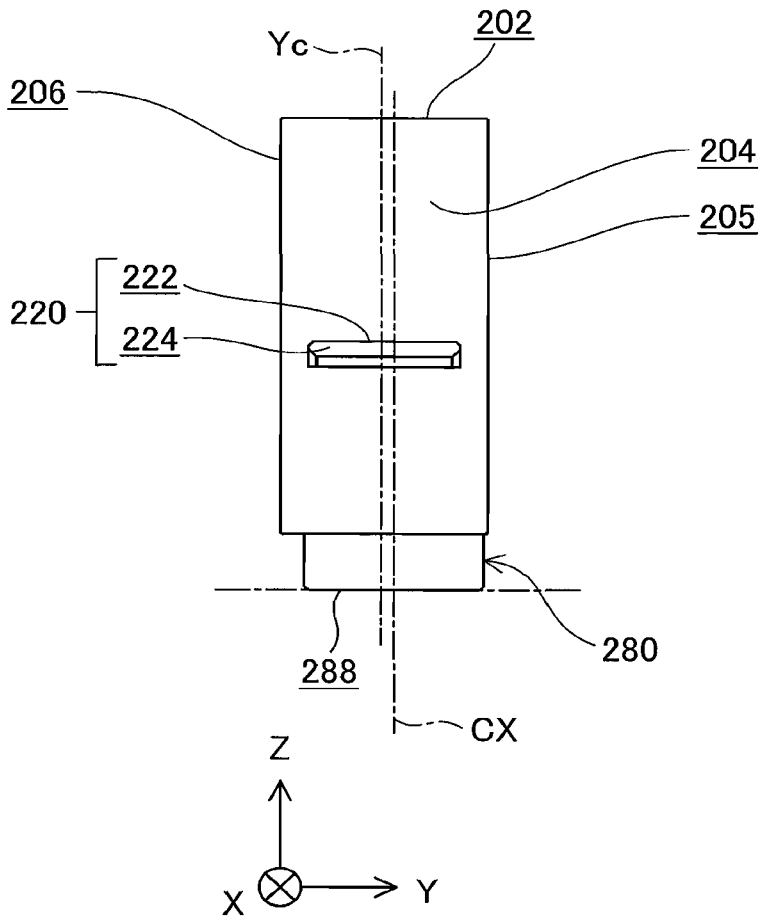
FIG. 9 is a rear view illustrating the structure of the cartridge.
Figure 10:
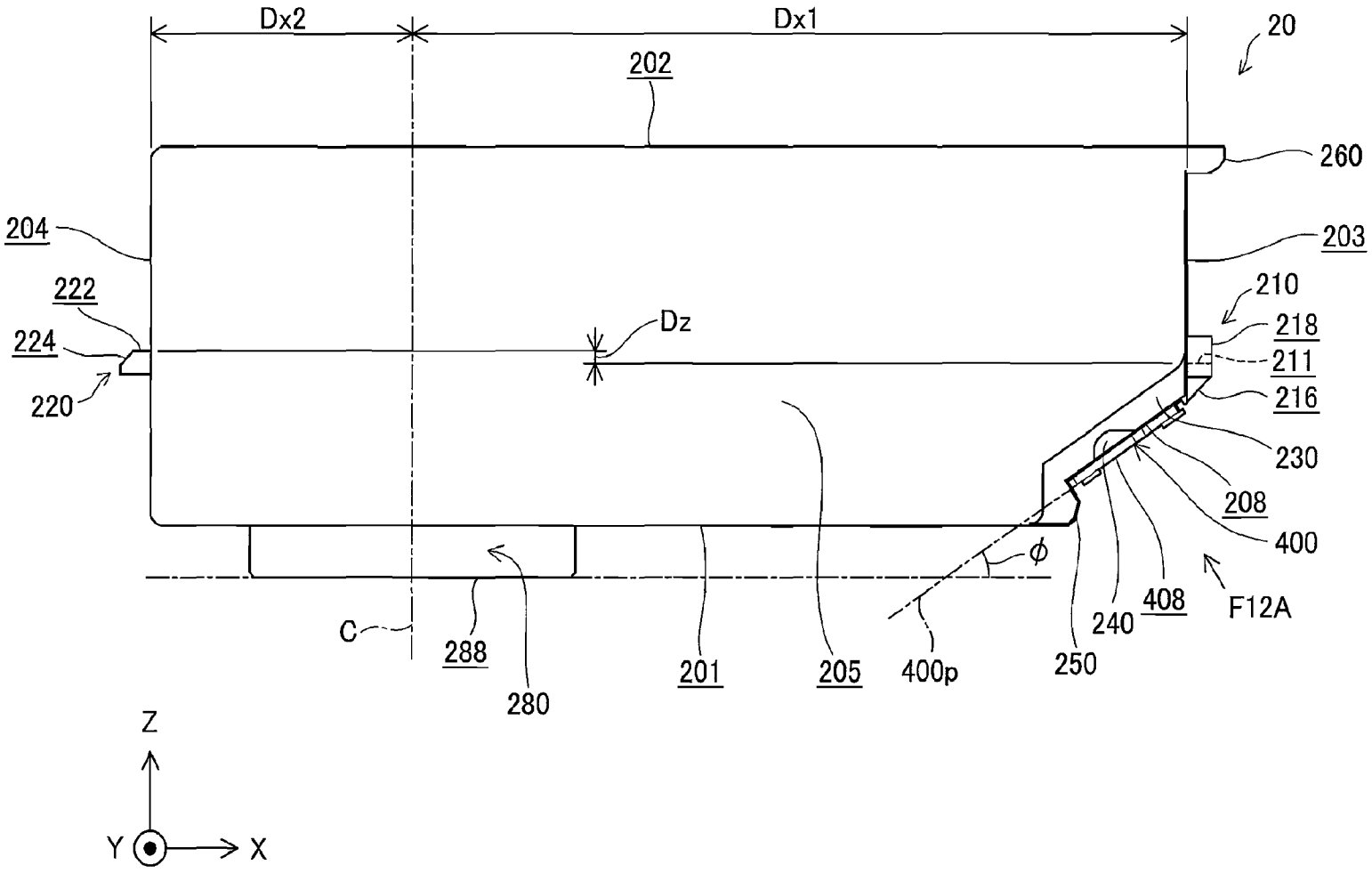
FIG. 10 is a left side view illustrating the structure of the cartridge.
Figure 11:
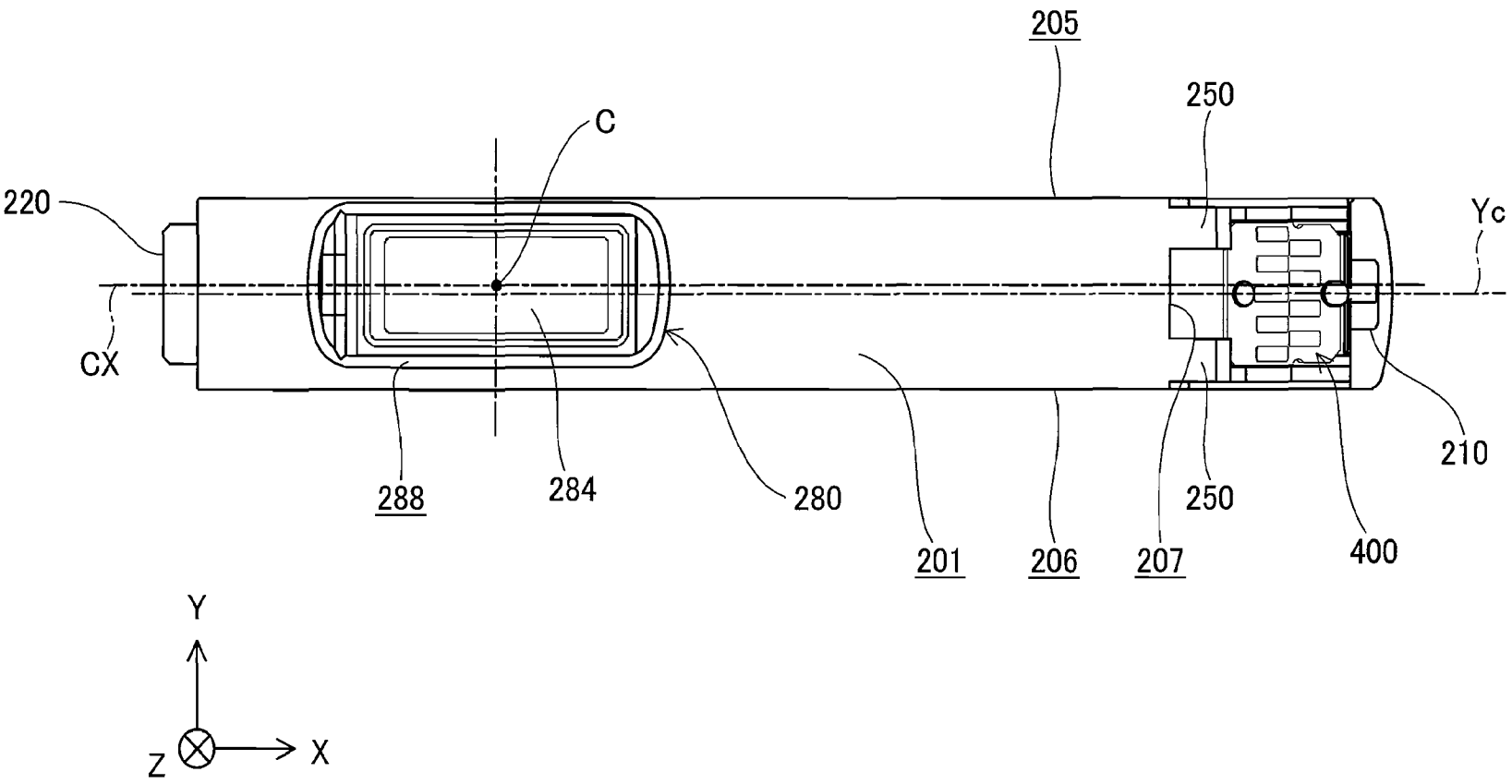
FIG. 11 is a bottom view illustrating the structure of the cartridge.

FIG. 7 is a perspective view illustrating the structure of the cartridge 20. FIG. 8 is a front view illustrating the structure of the cartridge 20. FIG. 9 is a rear view illustrating the structure of the cartridge 20. FIG. 10 is a left side view illustrating the structure of the cartridge 20. FIG. 11 is a bottom view illustrating the structure of the cartridge 20.

In the description of the cartridge 20, the X axis, the Y axis and the Z axis with respect to the cartridge 20 attached to the holder 600 are regarded as the axes on the cartridge 20. According to this embodiment, in the attached state of the cartridge 20 to the holder 600, the positive X-axis side forms the front face of the cartridge 20. A plane CX shown in FIGS. 8, 9 and 11 is a plane that passes through the central axis C and is parallel to the Z axis and the X axis. A plane Yc shown in FIGS. 8, 9 and 11 is a plane that passes through the center of the width or the Y-axis direction length of the cartridge 20 and is parallel to the Z axis and the X axis.

As shown in FIGS. 7 to 11, the cartridge 20 has six planes defining the profile of approximate rectangular prism, first face 201, second face 202, third face 203, fourth face 204, fifth face 205 and sixth face 206. According to this embodiment, the cartridge 20 also has a seventh face 207 and an eighth face 208 provided between the first face 201 and the third face 203, in addition to the first to the sixth faces 201 to 206 corresponding to the six planes of the approximate rectangular prism profile. The space defined by the first to the eighth faces 201 to 208 serves as the ink chamber 290.

The first to the eighth faces 201 to 208 are provided as substantial planes, which may not be perfectly flat over the whole surface but may have partial irregularity. According to this embodiment, the first to the eighth faces 201 to 208 form the outer surfaces of the assembly of the plurality of members. According to this embodiment, the first to the eighth faces 201 to 208 are made of plate-like members. According to other embodiments, part of the first to the eighth faces 201 to 208 may be made of a film (thin film) member. The first to the eighth faces 201 to 208 are made of a resin material and more specifically made of a resin material having the higher rigidity than polypropylene (PP) (e.g., polyacetal (POM)) in this embodiment.

According to this embodiment, the cartridge 20 has the length (X-axis direction length), the width (Y-axis direction length) and the height (Z-axis direction length), wherein the length, the height and the width descend in this order. The magnitude relation of the length, the width and the height of the cartridge 20 is, however, not limited to this order but may be determined arbitrarily; for example, the height, the length and the width may descend in this order or the height, the length and the width may be equal to one another.

The first face 201 and the second face 202 of the cartridge 20 are the faces parallel to the X axis and the Y axis and are located to be opposed to each other in the Z-axis direction. The first face 201 is located on the negative Z-axis side, and the second face 202 is located on the positive Z-axis side. The first face 201 and the second face 202 are located to intersect the third face 203, the fourth face 204, the fifth face 205 and the sixth face 206. In the description herein, the expression that "two faces intersect or cross each other"

means one of the state that two faces actually cross each other, the state that an extension of one face intersects the other face, and the state that extensions of two faces cross each other. According to this embodiment, in the attached state of the cartridge 20 to the holder 600, the first face 201 forms the bottom face of the cartridge 20, and the second face 202 forms the top face of the cartridge 20.

The ink supply port 280 is formed in the first face 201. The ink supply port 280 is protruded in the negative Z-axis direction from the first face 201 and has an open surface 288 at its negative Z-axis end with an opening in a plane parallel to the X axis and the Y axis. According to this embodiment, as shown in FIG. 11, the resin foam 284 is provided inside the ink supply port 280 at the position on the positive Z-axis side of the open surface 288. According to this embodiment, before shipment of the cartridge 20, the open surface 288 of the ink supply port 280 is sealed with a sealing member (not shown), such as a cap or a film. For attachment of the cartridge 20 to the holder 600, the sealing member (not shown) to seal the open surface 288 is removed from the cartridge 20.

According to this embodiment, the ink supply port 280 is protruded in the negative Z-axis direction with the center on the central axis C of the ink supply tube 640. According to another embodiment, the center of the ink supply port 280 may be deviated from the central axis C of the ink supply tube 640. According to this embodiment, the open surface 288 of the ink supply port 280 viewed from the negative Z-axis direction toward the positive Z-axis direction is line-symmetric with respect to axes parallel to the X axis and the Y axis. According to another embodiment, the open surface 288 of the ink supply port 280 may be asymmetric. The open surface 288 viewed from the Z-axis direction is in the rounded rectangular shape according to this embodiment but may be in any other suitable shape, e.g., precise circle, ellipse, oval, square or rectangle according to other embodiments.

The third face 203 and the fourth face 204 of the cartridge 20 are the faces parallel to the Y axis and the Z axis and are located to be opposed to each other in the X-axis direction. The third face 203 is located on the positive X-axis side, and the fourth face 204 is located on the negative X-axis side. The third face 203 and the fourth face 204 are located to intersect the first face 201, the second face 202, the fifth face 205 and the sixth face 206. According to this embodiment, in the attached state of the cartridge 20 to the holder 600, the third face 203 forms the front face of the cartridge 20, and the fourth face 204 forms the rear face of the cartridge 20.

The first cartridge-side locking element 210 is provided on the third face 203 and is located on the positive Z-axis side and on the positive X-axis side of the ink supply port 280 and the circuit board 400. The first cartridge-side locking element 210 has a first locking surface 211 facing in the positive Z-axis direction. Turning the lever 800 causes the first apparatus-side locking element 810 to engage with the first locking surface 211 at the first locking position 810L and thereby restrict the motion of the cartridge 20 in the positive Z-axis direction.

According to this embodiment, the first cartridge-side locking element 210 is provided as a projection protruded in the positive X-axis direction from the third face 203. The first cartridge-side locking element 210 is thus readily formed on the third face 203 and is readily checked by the user in the course of attachment of the cartridge 20.

According to this embodiment, as shown in FIGS. 7, 8 and 10, the first cartridge-side locking element 210 is protruded from the third face 203 to be formed as the L-shaped projection with two sides respectively parallel to the Y axis and the Z axis. A wall in a triangular shape (viewed from the Y-axis direction) is formed on the negative Z-axis side from the approximate center of the Y-axis parallel portion of the L-shaped projection to be extended from the positive X-axis end of the L-shaped projection to the third face 203.

According to this embodiment, the first cartridge-side locking element 210 has a third locking surface 213 facing in the positive X-axis direction, in addition to the first locking surface 211 facing in the positive Z-axis direction. Turning the lever 800 causes the first apparatus-side locking element 810 to engage with the first locking surface 211 and the third locking surface 213 at the first locking position 810L and thereby restrict the motion of the cartridge 20 in the positive Z-axis direction and in the positive X-axis direction. This enables the cartridge 20 to be more stably held at the designed attachment position.

According to this embodiment, the first locking surface 211 of the first cartridge-side locking element 210 is provided as a plane facing in the positive Z-axis direction, which forms the Y-axis parallel portion of the L-shaped projection. In other words, the first locking surface 211 is the plane parallel to the X axis and the Y axis. According to this embodiment, the third locking surface 213 of the first cartridge-side locking element 210 is provided as a plane facing in the positive X-axis direction, which forms the Y-axis parallel portion of the L-shaped projection. In other words, the third locking surface 213 is the plane parallel to the Y axis and the Z axis.

According to this embodiment, the first cartridge-side locking element 210 has a sloped surface 216 inclined in the negative Z-axis direction and in the positive X-axis direction. The positive Z-axis side of the sloped surface 216 is adjacent to the negative Z-axis side of the third locking surface 213 adjoining to the positive X-axis side of the first locking surface 211. The negative Z-axis side of the sloped surface 216 is adjacent to the position where the third face 203 adjoins to the eighth face 208. This structure enables the first apparatus-side locking element 810 to be smoothly guided to the first locking surface 211 for attachment of the cartridge 20 to the holder 600. According to this embodiment, the sloped surface 216 of the first cartridge-side locking element 210 is formed as a plane on the positive X-axis side of the triangular-shaped wall formed on the negative Z-axis side of the L-shaped projection.

According to this embodiment, the first cartridge-side locking element 210 also has an extended surface 218 formed by extending in the positive Z-axis direction part of the third locking surface 213 adjoining to the positive X-axis side of the first locking surface 211. In the course of attachment of the cartridge 20 to the holder 600, this structure prevents the lever 800 from running on the positive Z-axis side of the first locking surface 211. According to this embodiment, the extended surface 218 of the first cartridge-side locking element 210 is formed as a plane facing in the positive X-axis direction, which forms the Z-axis parallel portion of the L-shaped projection. In other words, the extended surface 218 is the plane parallel to the Y axis and the Z axis.

According to this embodiment, the third face 203 has a projection 260. The projection 260 has a shape extended from the second face 202 in the positive X-axis direction and is protruded in the positive X-axis direction from the third face 203. The projection 260 formed on the cartridge 20 enables the user to readily lift up the cartridge 20 in the positive Z-axis direction about the second cartridge-side locking element 220 as the pivot point of rotation for detachment of the cartridge 20 from the holder 500 by simply placing the user's finger on the projection 260 after pressing the operating member 830 of the lever 800 in the negative X-axis direction. According to other embodiments, the third face 203 may be designed without the projection 260.

The second cartridge-side locking element 220 is provided on the fourth face 204 and is located on the positive Z-axis side and on the negative X-axis side of the ink supply port 280 and the circuit board 400. The second cartridge-side locking element 220 has a second locking surface 222 facing in the positive Z-axis direction. Engaging the second locking surface 222 with the second apparatus-side locking element 620 restricts the motion of the cartridge 20 in the positive Z-axis direction.

According to this embodiment, for attachment and detachment of the cartridge 20 to and from the holder 600, the second cartridge-side locking element 220 engages with the second apparatus-side locking element 620 and serves as the pivot point of rotation of the cartridge 20 relative to the holder 600. This structure ensures easy attachment and detachment of the cartridge 20 to and from the holder 600.

According to this embodiment, the second cartridge-side locking element 220 is provided as a projection protruded in the negative X-axis direction from the fourth face 204. The second cartridge-side locking element 220 is thus readily formed on the fourth face 204 and is readily checked by the user in the course of attachment of the cartridge 20.

According to this embodiment, the second locking surface 222 of the second cartridge-side locking element 220 is provided as a plane facing in the positive Z-axis direction, which forms the projection protruded in the negative X-axis direction from the fourth face 204. In other words, the second locking surface 222 is the plane parallel to the X axis and the Y axis.

According to this embodiment, the second cartridge-side locking element 220 has a sloped surface 224 provided adjacent to the negative X-axis side of the second locking surface 222 and inclined in the positive Z-axis direction and in the negative X-axis direction. This structure enables the second locking surface 222 to be smoothly guided to the second apparatus-side locking element 620 for attachment of the cartridge 20 to the holder 600. According to other embodiments, the second cartridge-side locking element 220 may be designed without the sloped surface 224.

As shown in FIG. 10, the first locking surface 211 of the first cartridge-side locking element 210 is provided on the negative Z-axis side, i.e., on the side closer to the first face 201, by the distance Dz from the second locking surface 222 of the second cartridge-side locking element 220. In other words, the second locking surface 222 is located on the positive Z-axis side, i.e., on the side closer to the second face 202, by the distance Dz from the first locking surface 211. This structure enhances the engagement between the first cartridge-side locking element 210 and the first apparatus-side locking element 810 in the attached state of the cartridge 20 to the holder 600 as described above with reference to FIG. 6.

According to this embodiment, as shown in FIGS. 8, 9 and 11, the first locking surface 211 of the first cartridge-side locking element 210 and the second locking surface 222 of the second cartridge-side locking element 220 are provided at the positions intersecting the plane Yc passing through the center of the width or the Y-axis direction length of the cartridge 20. This structure advantageously prevents the pressing forces Ps and Pt applied from the holder 600 to the cartridge 20 from acting to tilt the cartridge 20 in the Y-axis direction.

According to this embodiment, as shown in FIGS. 8, 9 and 11, the first locking surface 211 of the first cartridge-side locking element 210 and the second locking surface 222 of the second cartridge-side locking element 220 are provided at the positions intersecting the plane CX passing through the central axis C. This structure effectively prevents the pressing force Ps applied from the holder 600 to the cartridge 20 from acting to tilt the cartridge 20 in the Y-axis direction.

According to this embodiment, as shown in FIG. 10, a distance Dx1 on the X axis between the central axis C and the third face 203 is greater than a distance Dx2 on the X axis between the central axis C and the fourth face 204. In other words, the distance on the X axis from the second locking surface 222 of the second cartridge-side locking element 220 to the ink supply port 280 is less than the distance on the X-axis from the first locking surface 211 of the first cartridge-side locking element 210 to the ink supply port 280. The ink supply port 280 is provided at the position closer to the second locking surface 222, which is positioned relative to the holder 600 prior to the first locking surface 211, so that the cartridge 20 can readily be positioned relative to the holder 600.

According to this embodiment, as shown in FIG. 11, the Y-axis direction length of the first cartridge-side locking element 210 is less than the Y-axis direction length of the second cartridge-side locking element 220. According to this embodiment, the Y-axis direction length of the first cartridge-side locking element 210 is less than the Y-axis direction length of the circuit board 400. According to this embodiment, the Y-axis direction length of the second cartridge-side locking element 220 is substantially equal to the Y-axis direction length of the circuit board 400.

The fifth face 205 and the sixth face 206 of the cartridge 20 are the faces parallel to the Z axis and the X axis and are located to be opposed to each other in the Y-axis direction. The fifth face 205 is located on the positive Y-axis side, and the sixth face 206 is located on the negative Y-axis side. The fifth face 205 and the sixth face 206 are located to intersect the first face 201, the second face 202, the third face 203 and the fourth face 204. According to this embodiment, in the attached state of the cartridge 20 to the holder 600, the fifth face 205 forms the left side face of the cartridge 20, and the sixth face 206 forms the right side face of the cartridge 20.

The seventh face 207 of the cartridge 20 is provided at the corner connecting the first face 201 with the third face 203 and is extended in the positive Z-axis direction from the first face 201. The seventh face 207 is linked with the eighth face 208 on its positive Z-axis side and with the first face 201 on its negative Z-axis side. According to this embodiment, the seventh face 207 is the face parallel to the Y axis and the Z axis and is located to be opposed to the fourth face 204.

The eighth face 208 of the cartridge 20 is provided at the corner connecting the first face 201 with the third face 203 and is provided on the positive Z-axis side of the seventh face 207. The eighth face 208 is linked with the third face 203 on its positive Z-axis side and with the seventh face 207 on its negative Z-axis side. According to this embodiment, the eighth face 208 is inclined in the negative Z-axis direction and in the positive X-axis direction as shown in FIGS. 7 and 10.

The circuit board 400 is provided on the eighth face 208 according to this embodiment. As shown in FIG. 10, the circuit board 400 mounted on the eighth face 208 has a sloped surface (also called "cartridge-side sloped surface") 408 inclined in the negative Z-axis direction and in the positive X-axis direction. In the attached state of the cartridge 20 to the holder 600, the cartridge-side terminals provided on the cartridge-side sloped surface 408 of the circuit board 400 of the cartridge 20 are in contact with the apparatus-side terminals provided on the terminal base 700 in the holder 600.

The angle of inclination of the cartridge-side sloped surface 408 to the plane parallel to the X axis and the Y axis (i.e., the open surface 288 of the ink supply port 280) is preferably in a range of 25 to 40 degrees. Setting the angle of inclination of the cartridge-side sloped surface 408 to be not less than 25 degrees ensures a sufficient amount of wiping. The term "wiping" herein means that the cartridge-side terminals provided on the cartridge-side sloped surface 408 are rubbed by the apparatus-side terminals provided on the terminal base 700 in the course of attachment of the cartridge 20 to the holder 600. The "amount of wiping" means the length of the cartridge-side terminals that can be rubbed by the apparatus-side terminals. Such wiping removes dust and foreign particles adhering to the top of the cartridge-side terminals and reduces the potential connection failure between the cartridge-side terminals and the apparatus-side terminals. Setting the angle of inclination of the cartridge-side sloped surface 408 to be not greater than 40 degrees enables the pressing force Pt applied from the apparatus-side terminals provided on the terminal base 700 to the circuit board 400 to include a sufficient magnitude of the positive Z-axis component.

According to this embodiment, a pair of first engagement surfaces 230, a pair of second engagement surfaces 240 and a pair of projections 250 are provided around the circuit board 400 on the cartridge 20, in order to prevent positional misalignment of the cartridge-side terminals provided on the circuit board 400 relative to the apparatus-side terminals provided on the terminal base 700 in the course of attachment of the cartridge 20 to the holder 600.

Figure 13:
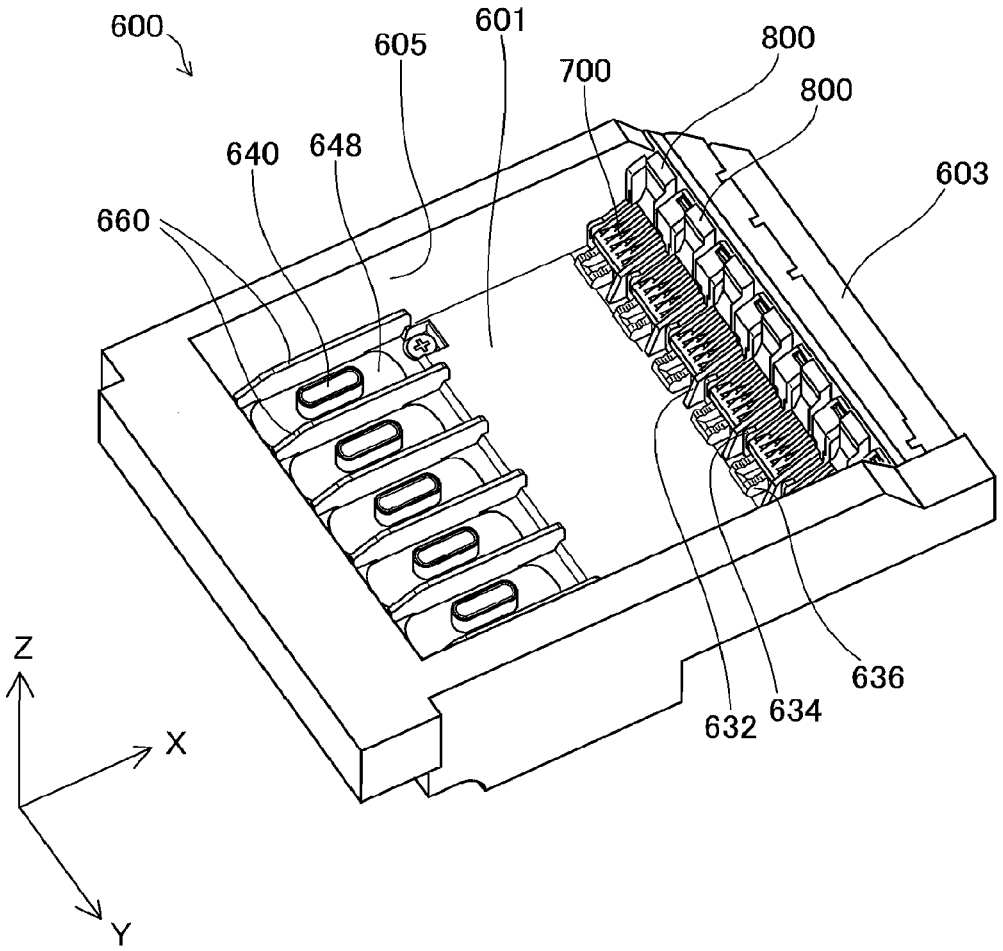
FIG. 13 is a perspective view illustrating the structure of the holder.
Figure 14:
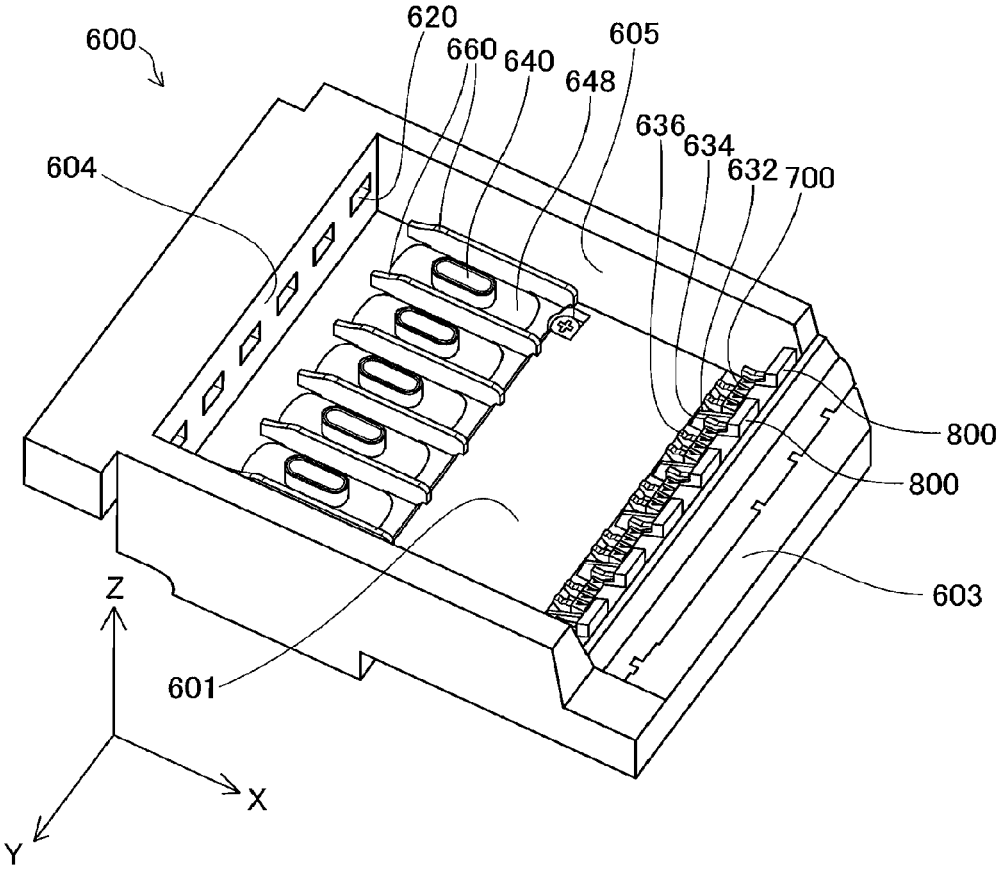
FIG. 14 is a perspective view illustrating the structure of the holder.
Figure 15:
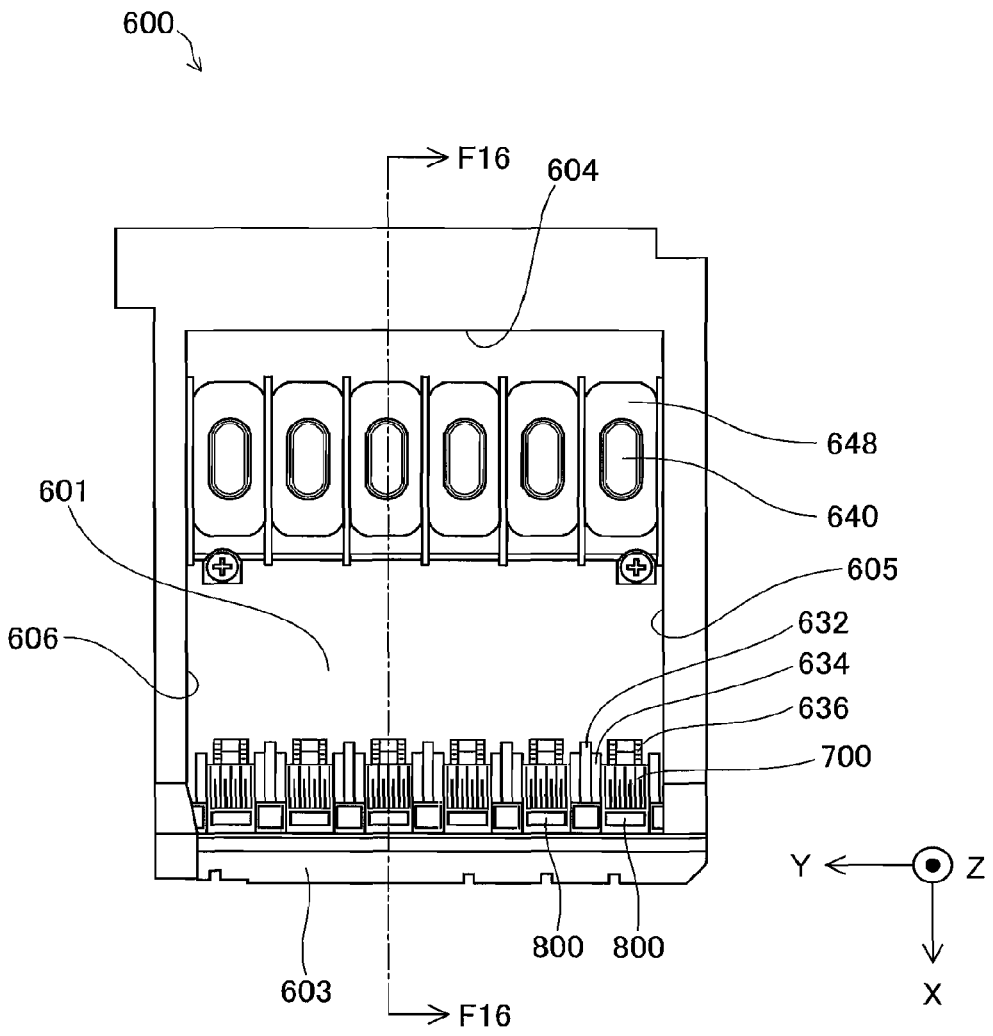
FIG. 15 is a top view illustrating the structure of the holder.

The pair of first engagement surfaces 230 provided at the positions close to the circuit board 400 on the fifth face 205 and the sixth face 206 of the cartridge 20 are the pair of faces parallel to the Z axis and the X axis and are formed on both sides of the circuit board 400 along the Y-axis direction. The pair of first engagement surfaces 230 are configured to engage with first engagement members 632 provided in the holder 600 (FIGS. 13 to 15). This structure effectively prevents the positional misalignment of the circuit board 400 relative to the holder 600 in the Y-axis direction and enables the cartridge-side terminals to be in contact with the apparatus-side terminals at the appropriate position.

According to this embodiment, the pair of first engagement surfaces 230 includes an engagement surface formed on the fifth face 205 and an engagement surface formed on the sixth face 206. The engagement surface on the fifth face 205 is formed by lowering part of the fifth face 205 in the negative Y-axis direction over an area within a preset distance from the boundary of the eighth face 208 to the corresponding projection 250. The engagement surface on the sixth face 206 is formed by lowering part of the sixth face 206 in the positive Y-axis direction over an area within the preset distance from the boundary of the eighth face 208 to the corresponding projection 250. The distance between the pair of first engagement surfaces 230 along the Y-axis direction is less than the width or the Y-axis direction length of the cartridge 20, i.e., the distance between the fifth face 205 and the sixth face 206 and is greater than the width or the Y-axis direction length of the circuit board 400.

The pair of second engagement surfaces 240 provided at the positions close to the circuit board 400 on the fifth face 205 and the sixth face 206 of the cartridge 20 are the pair of faces parallel to the Z axis and the X axis and are formed on both sides of the circuit board 400 along the Y-axis direction. The pair of second engagement surfaces 240 are configured to engage with second engagement members 634 provided in the holder 600 (FIGS. 13 to 15). This structure effectively prevents the positional misalignment of the circuit board 400 relative to the holder 600 in the Y-axis direction and enables the cartridge-side terminals to be in contact with the apparatus-side terminals at the appropriate position.

According to this embodiment, the pair of second engagement surfaces 240 includes an engagement surface formed on the fifth face 205 and an engagement surface formed on the sixth face 206. The engagement surface on the fifth face 205 is formed by further lowering part of the first engagement surface 230 adjacent to the eighth face 208 in the negative Y-axis direction. The engagement surface on the sixth face 206 is formed by further lowering part of the first engagement surface 230 adjacent to the eighth face 208 in the positive Y-axis direction. The distance between the pair of second engagement surfaces 204 along the Y-axis direction is less than the width or the Y-axis direction length of the cartridge 20, i.e., the distance between the fifth face 205 and the sixth face 206 and is substantially equal to the width or the Y-axis direction of the circuit board 400.

The pair of projections 250 of the cartridge 20 are provided on the positive Y-axis side and on the negative Y-axis side of the seventh face 207 to be protruded in the positive X-axis direction. The pair of projections 250 face each other along the Y axis on the negative Z-axis side of the circuit board 400. The pair of projections 250 are configured to engage with a fitting member 636 provided in the holder 600 (FIGS. 13 to 15). This structure effectively prevents the positional misalignment of the circuit board 400 relative to the holder 600 in the Y-axis direction and enables the cartridge-side terminals to be in contact with the apparatus-side terminals at the appropriate position.

Figure 12A:
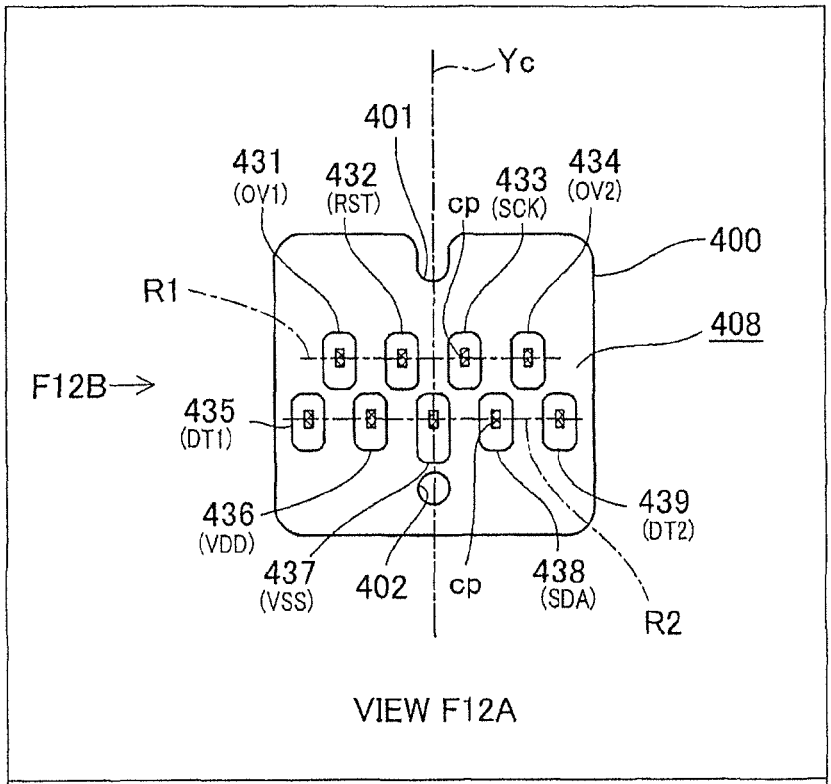
FIGS. 12A and 12B illustrate the detailed structure of a circuit board on the cartridge.
Figure 12B:
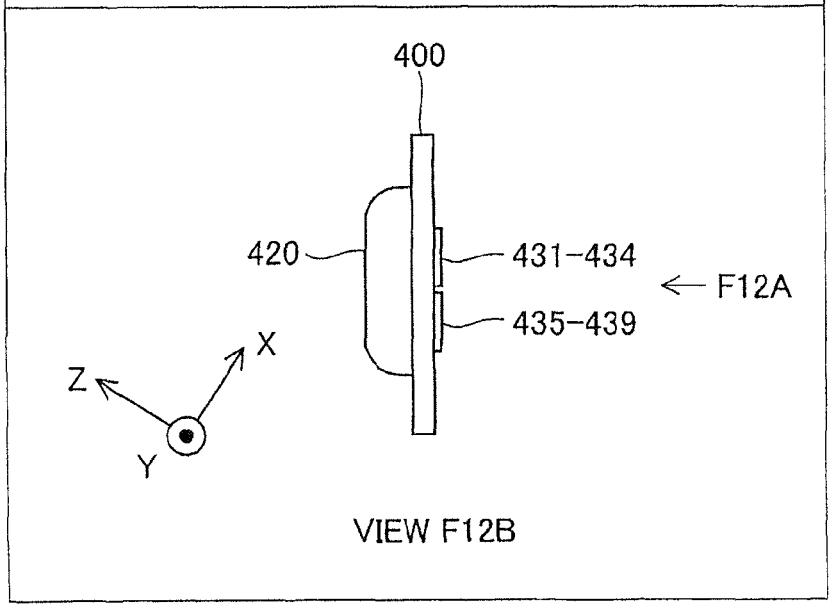

FIGS. 12A and 12B illustrate the detailed structure of the circuit board 400 of the cartridge 20. FIG. 12A shows the structure on the surface (cartridge-side sloped surface) 408 of the circuit board 400 viewed from the direction of arrow F12A in FIG. 10. FIG. 12B shows the structure of the side face of the circuit board 400 viewed from the direction of arrow F12B (positive Y-axis direction) in FIG. 12A.

As shown in FIG. 12A, the circuit board 400 has a boss groove 401 at its positive Z-axis end and a boss hole 402 at its negative Z-axis end. The circuit board 400 is fixed to the eighth face 208 of the cartridge 20 by means of the boss groove 401 and the boss hole 402. According to this embodiment, the boss groove 401 and the boss hole 402 are provided at the positions intersecting the plane Yc passing through the center of the width or Y-axis direction length of the cartridge 20. According to another embodiment, at least one of the boss groove 401 and the boss hole 402 may be omitted from the circuit board 400, and the circuit board 400 may be fixed to the eighth face 208 by an adhesive or by an engagement click (not shown) provided on the eighth face 208.

According to this embodiment, nine cartridge-side terminals 431 to 439 are provided on the cartridge-side sloped surface 408 of the circuit board 400 as shown in FIG. 12A, while a memory unit 420 is provided on the rear face as shown in FIG. 12B. According to this embodiment, information regarding ink contained in the cartridge 20 (e.g., ink level or ink color) is stored in the memory unit 420 of the circuit board 400.

The number of cartridge-side terminals on the circuit board 400 is not limited to nine but may be changed to any arbitrary number, i.e., less than nine or greater than nine. The cartridge-side terminals 431 to 439 preferably have substantially the same height from the cartridge-side sloped surface 408 of the circuit board 400.

Each of the cartridge-side terminals 431 to 439 of the circuit board 400 has a contact portion "cp" that is in contact with the corresponding apparatus-side terminal provided on the terminal base 700 of the holder 600. Among the cartridge-side terminals 431 to 439, four cartridge-side terminals 431 to 434 are arrayed along a terminal line R1 that is parallel to the Y axis and is located on the positive Z-axis side, while five cartridge-side terminals 435 to 439 are arrayed along a terminal line R2 that is parallel to the Y axis and is located on the negative Z-axis side of the terminal line R1. The contact portions "cp" of the cartridge-side terminals 431 to 434 arrayed along the terminal line R1 are aligned on the terminal line R1, whilst the contact portions "cp" of the cartridge-side terminals 435 to 439 arrayed along the terminal line R2 are aligned on the terminal line R2.

In order to prevent the cartridge-side terminals 431 to 434 on the terminal line R1 from overlapping the cartridge-side terminals 435 to 439 on the terminal line R2 viewed from the direction along the Y axis, the cartridge-side terminals 431 to 434 on the terminal line R1 are located on the positive Z-axis side of the cartridge-side terminals 435 to 439 on the terminal line R2. In order to prevent the cartridge-side terminals 431 to 434 on the terminal line R1 from overlapping the cartridge-side terminals 435 to 439 on the terminal line R2 viewed from the direction along the Z axis, the cartridge-side terminals 431 to 434 on the terminal line R1 and the cartridge-side terminals 435 to 439 on the terminal line R2 are arranged alternately or in zigzag.

The five cartridge-side terminals 432, 433, 436, 437 and 438 are electrically connected with the memory unit 420. The cartridge-side terminal 432 serves as "reset terminal" to receive supply of a reset signal RST to the memory unit 420. The cartridge-side terminals 433 serves as "clock terminal" to receive supply of a clock signal SCK to the memory unit 420. The cartridge-side terminal 436 serves as "power terminal" to receive supply of power voltage VDD (e.g., rated voltage of 3.3 V) to the memory unit 420. The cartridge-side terminal 437 serves as "ground terminal" or "cartridge-side ground terminal" to receive supply of ground voltage VSS (0 V) to the memory unit 420. The cartridge-side terminal 438 serves as "data terminal" to receive supply of a data signal SDA to the memory unit 420.

The four cartridge-side terminals 431, 434, 437 and 439 serve as "attachment detection terminals" used by the holder 600 to check whether the cartridge 20 is properly attached to the holder 600. The contact portions "cp" of the five cartridge-side terminals 432, 433, 436, 437 and 438 are placed in a quadrilateral area defined by the contact portions "cp" of the other four cartridge-side terminals 431, 434, 437 and 439 as four apexes. According to this embodiment, the four cartridge-side terminals 431, 434, 437 and 439 are interconnected electrically inside the circuit board 400 and are electrically connected to a ground line (not shown) of the printer 50 through the cartridge-side terminal 437 serving as the ground terminal, in the attached state of the cartridge 20 to the holder 600.

According to this embodiment, in the attached state of the cartridge 20 to the holder 600, the nine cartridge-side terminals 431 to 439 of the circuit board 400 are electrically connected to the controller 510 of the printer 50 via the apparatus-side terminals provided on the terminal base 700 of the holder 600. Such connection enables the controller 510 to detect attachment of the cartridge 20 and to read and write information from and into the memory unit 420 of the circuit board 400.

According to this embodiment, the cartridge-side terminal 437 serving as the ground terminal is provided at the position intersecting the plane Yc passing through the center of the width or the Y-axis direction length of the cartridge 20. The cartridge-side terminal 437 is configured to be in contact with the corresponding apparatus-side terminal 737 (FIG. 17), before the other cartridge-side terminals 431 to 436, 438 and 439 are in contact with the corresponding apparatus-side terminals 731 to 736, 738 and 739 (FIG. 17), in the course of attachment of the cartridge 20 to the holder 600. The pressing force Pt first applied from the holder 600 to the circuit board 400 is thus generated on the substantial center of the width or the Y-axis direction length of the cartridge 20. This prevents the pressing force Pt applied to the cartridge-side sloped surface 408 from acting to tilt the cartridge 20 in the Y-axis direction and thereby ensures attachment of the cartridge 20 in the stable attitude to the holder 600. Such contact of the cartridge-side terminal 437 serving as the ground terminal with the corresponding apparatus-side terminal prior to the other cartridge-side terminals 431 to 436, 438 and 439 advantageously prevents or reduces the high voltage-induced trouble or failure by the grounding function of the cartridge-side terminal 437, even when an unexpected high voltage is applied to the cartridge 20.

According to this embodiment, the cartridge-side terminal 437 serving as the ground terminal is formed longer along the Z-axis direction than the other cartridge-side terminals 431 to 436, 438 and 439. This ensures the earlier contact of the cartridge-side terminal 437 serving as the ground terminal with the corresponding apparatus-side terminal 737 provided on the terminal base 700 of the holder 600 (FIG. 17) than the contact of the other cartridge-side terminals 431 to 436, 438 and 439 with the corresponding apparatus-side terminals 731 to 736, 738 and 739. According to another embodiment, all the cartridge-side terminals 431 to 439 may be formed in the same size.

A-4. Detailed Structure of Holder

Figure 16:
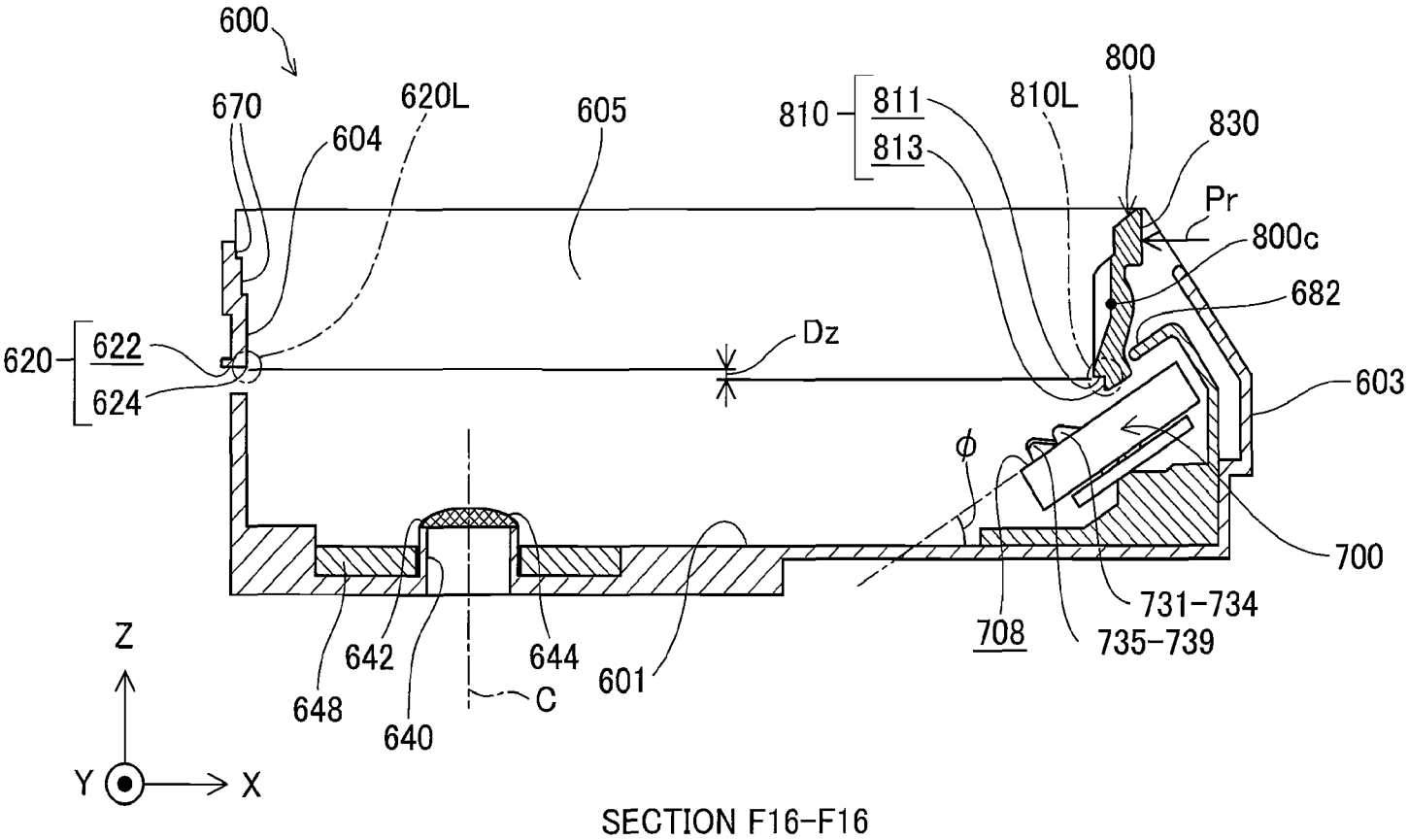
FIG. 16 is a sectional view illustrating the holder, taken on an arrowed line F16-F16 in FIG. 15.

FIGS. 13 and 14 are perspective views illustrating the structure of the holder 600. FIG. 15 is a top view illustrating the structure of the holder 600. FIG. 16 is a sectional view, taken on an arrowed line F16-F16 in FIG. 15.

The holder 600 of the printer 50 has five wall members 601, 603, 604, 605 and 606 assembled to form a container with the space to receive the cartridges 20 attached to the holder 600. According to this embodiment, the five wall members 601, 603, 604, 605 and 606 are plate members and are made of a resin material having the higher rigidity than polypropylene (PP), e.g., modified polyphenylene ether (m-PPE).

The wall member 601 of the holder 600 forms the bottom face of the container in the use attitude of the printer 50. The wall member 603 of the holder 600 is erected on the positive X-axis side of the wall member 601 and forms the front face of the container in the use attitude of the printer 50. The wall member 604 of the holder 600 is erected on the negative X-axis side of the wall member 601 and forms the rear face of the container in the use attitude of the printer 50. The wall member 605 of the holder 600 is erected on the negative Y-axis side of the wall member 601 and forms the right side face of the container in the use attitude of the printer 50. The wall member 606 of the holder 600 is erected on the positive Y-axis side of the wall member 601 and forms the left side face of the container in the use attitude of the printer 50. The wall member 603 and the wall member 604 are located to be opposed to each other, whilst the wall member 605 and the wall member 606 are located to be opposed to each other.

The ink supply tube 640 is provided on the wall member 601 of the holder 600, and a porous filter 644 is provided at a peripheral end 642 of the ink supply tube 640. According to this embodiment, the ink supply tube 640 is located on the side closer to the wall member 604 (i.e., closer to the negative X-axis side). According to other embodiments, the ink supply tube 640 may be located on the side closer to the wall member 603 (i.e., closer to the positive X-axis side) or may be located in the middle between the wall member 604 and the wall member 603.

An elastic member 648 is provided around the ink supply tube 640 on the wall member 601. The elastic member 648 serves to seal the ink supply port 280 of the cartridge 20 and prevent leakage of ink from the ink supply port 280 to the periphery in the attached state of the cartridge 20 to the holder 600. The elastic member 648 generates the pressing force Ps in the direction of pressing back the ink supply port 280 of the cartridge 20 (in the positive Z-axis direction) in the attached state of the cartridge 20 to the holder 600.

According to this embodiment, a pair of elevation surfaces 660 are erected on the positive Y-axis side and on the negative Y-axis side of each ink supply tube 640 on the wall member 601. The pair of elevation surfaces 660 are formed as wall surfaces parallel to the Z axis and the X axis and are configured such that the cartridge 20 is received and fit between the pair of elevation surfaces 660 in the course of attachment of the cartridge 20 to the holder 600. This effectively prevents the positional misalignment of the ink supply port 280 relative to the ink supply tube 640.

The terminal base 700 is provided at the position where the wall member 601 adjoins to the wall member 603 and is located on the side closer to the wall member 603 than the ink supply tube 640 (i.e., on the positive X-axis side of the ink supply tube 640). As shown in FIG. 16, the terminal base 700 mounted on the wall member 601 has an apparatus-side sloped surface 708 inclined in the positive Z-axis direction and in the negative X-axis direction. In the attached state of the cartridge 20 to the holder 600, the apparatus-side terminals provided on the apparatus-side sloped surface 708 of the terminal base 700 in the holder 600 are in contact with the circuit board 400 of the cartridge 20.

The angle of inclination of the apparatus-side sloped surface 708 of the terminal base 700 to the plane parallel to the X axis and the Y axis (wall member 601) is equal to the angle of inclination of the cartridge-side sloped surface 408 of the cartridge 20 to the open surface 288 of the ink supply port 280. In the attached state of the cartridge 20 to the holder 600, the apparatus-side sloped surface 708 of the terminal base 700 is accordingly parallel to the cartridge-side sloped surface 408 of the circuit board 400.

According to this embodiment, nine apparatus-side terminals 731 to 739 are provided on the apparatus-side sloped surface 708 of the terminal base 700 corresponding to the nine cartridge-side terminals 431 to 439 provided on the circuit board 400 of the cartridge 20. The number of apparatus-side terminals is not limited to nine but may be changed to any arbitrary number, i.e., less than nine or greater than nine.

Figure 17:
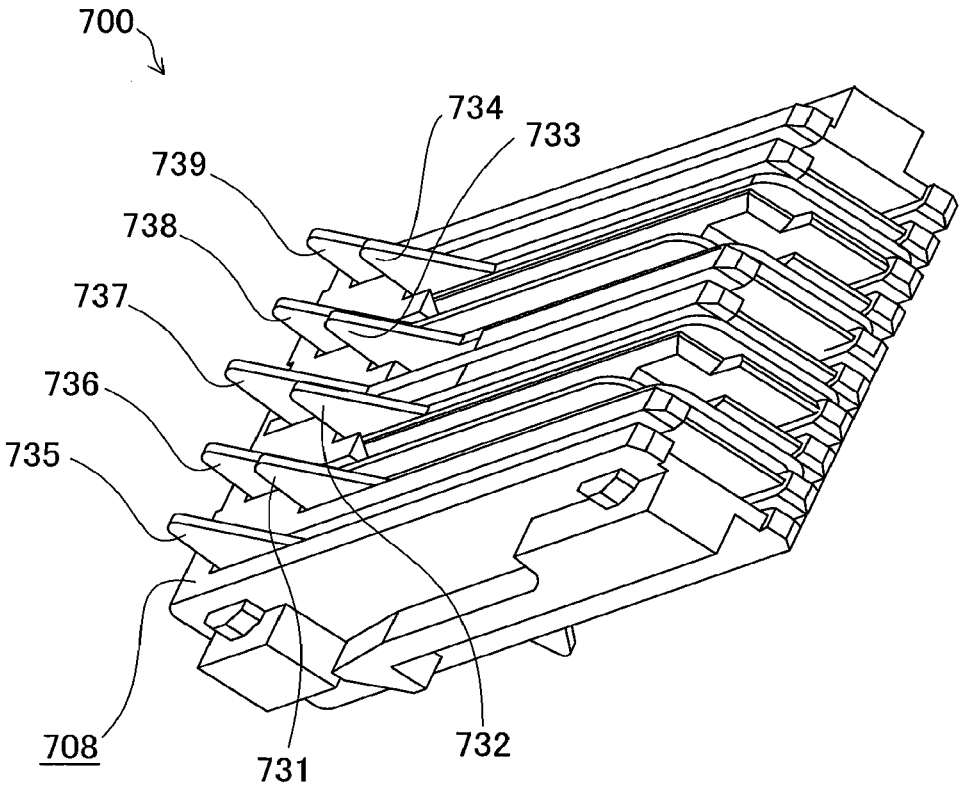
FIG. 17 is a perspective view illustrating the detailed structure of a terminal base.

FIG. 17 is a perspective view illustrating the detailed structure of the terminal base 700 detached from the holder 600. The nine apparatus-side terminals 731 to 739 on the terminal base 700 are provided at the positions corresponding to the nine cartridge-side terminals 431 to 439 on the circuit board 400 of the cartridge 20. The five apparatus-side terminals 735 to 739 are arrayed along the Y axis on the negative Z-axis side of the apparatus-side sloped surface 708 of the terminal base 700. The four apparatus-side terminals 731 to 734 are arrayed along the Y axis on the positive Z-axis side of these five apparatus-side terminals 735 to 739.

The apparatus-side terminals 731 to 739 are made of an elastic material with electrical conductivity. The apparatus-side terminals 731 to 739 are protruded from the apparatus-side sloped surface 708 and generate the pressing force Pt in the direction of pressing back the cartridge-side sloped surface 408 of the cartridge 20 (i.e., in the positive Z-axis direction) in the attached state of the cartridge 20 to the holder 600.

According to this embodiment, the apparatus-side terminal 737 located on the center in the Y-axis direction among the nine apparatus-side terminals 731 to 739 is electrically connected to a ground line (not shown) and serves as "ground terminal" or "apparatus-side ground terminal". The apparatus-side terminal 737 serving as the apparatus-side ground terminal is in contact with the cartridge-side terminal 437 serving as the cartridge-side ground terminal (FIG. 12) in the attached state of the cartridge 20 to the holder 600.

According to this embodiment, the height of the apparatus-side terminal 737 protruded from the apparatus-side sloped surface 708 is greater than the height of the other apparatus-side terminals 731 to 736, 738 and 739. The apparatus-side terminal 737 is accordingly in contact with the cartridge-side terminal 437 serving as the cartridge-side ground terminal (FIG. 12), prior to the other apparatus-side terminals 731 to 736, 738 and 739 with the corresponding cartridge-side terminals.

Referring back to FIGS. 13 to 16, according to this embodiment, the pair of first engagement members 632 are provided on the positive Y-axis side and on the negative Y-axis side of the terminal base 700. The pair of first engagement members 632 respectively have surfaces parallel to the Z axis and the X axis and are configured to engage with the pair of first engagement surfaces 230 of the cartridge 20 in the course of attachment of the cartridge 20 to the holder 600. Such engagement effectively prevents the positional misalignment of the circuit board 400 relative to the terminal base 700 and thereby the positional misalignment of the cartridge-side terminals 431 to 439 relative to the apparatus-side terminals 731 to 739.

According to this embodiment, the pair of second engagement members 634 are provided on the positive Y-axis side and on the negative Y-axis side of the terminal base 700 and inside the pair of first engagement members 632. The pair of second engagement members 634 respectively have surfaces parallel to the Z axis and the X axis and are configured to engage with the pair of second engagement surfaces 240 of the cartridge 20 in the course of attachment of the cartridge 20 to the holder 600. Such engagement effectively prevents the positional misalignment of the circuit board 400 relative to the terminal base 700 and thereby the positional misalignment of the cartridge-side terminals 431 to 439 relative to the apparatus-side terminals 731 to 739.

According to this embodiment, the fitting member 636 is provided adjacent to the negative Z-axis side of the terminal base 700 and is configured to be fit between the pair of projections 250 of the cartridge 20 in the course of attachment of the cartridge 20 to the holder 600. Such engagement effectively prevents the positional misalignment of the circuit board 400 relative to the terminal base 700 and thereby the positional misalignment of the cartridge-side terminals 431 to 439 relative to the apparatus-side terminals 731 to 739.

The lever 800 is provided in a pivotally rotatable manner on the wall member 603 of the holder 600. According to this embodiment, the lever 800 is provided as a separate member from the five wall members 601, 603, 604, 605 and 606 of the holder 600 and is made of a resin material with the higher rigidity than polypropylene (PP), e.g., polyacetal (POM).

As shown in FIG. 16, the lever 800 has the pivotal center 800*c* on the positive Z-axis side and on the positive X-axis side of the apparatus-side terminals 731 to 739. The lever 800 has the operating member 830 and the first apparatus-side locking element 810. The operating member 830 is located on the positive Z-axis side of the pivotal center 800*c*, whilst the first apparatus-side locking element 810 is located on the negative Z-axis side of the pivotal center 800*c*.

The operating member 830 is provided on the positive Z-axis end of the lever 800. The operating member 830 is configured to receive the user's operating force Pr applied in the negative X-axis direction from the side of the wall member 603 (positive X-axis side). The user's operating force Pr applied to the operating member 830 turns the lever 800 counterclockwise, viewed from the positive Y-axis direction, around the pivotal center 800*c*.

The first apparatus-side locking element 810 is provided on the negative Z-axis end of the lever 800. The first apparatus-side locking element 810 is configured to lock the first cartridge-side locking element 210 at the first locking position 810L located on the negative Z-axis side and on the negative X-axis side of the pivotal center 800*c*. According to this embodiment, the first apparatus-side locking element 810 has a first apparatus-side locking surface 811 and a second apparatus-side locking surface 813. The first apparatus-side locking surface 811 is a plane facing in the negative Z-axis direction at the first locking position 810L and is configured to engage with the first locking surface 211 of the first cartridge-side locking element 210. The second apparatus-side locking surface 813 is a plane facing in the negative X-axis direction at the first locking position 810L and is configured to engage with the third locking surface 213 of the first cartridge-side locking element 210.

According to this embodiment, the lever 800 is configured such that the first apparatus-side locking element 810 is located at the first locking position 810L in the state of no attachment of the cartridge 20. According to other embodiments, the standby position of the lever 800 may be the position where the first apparatus-side locking element 810 is located on the negative X-axis side of the first locking position 810L or may be the position where the first apparatus-side locking element 810 is located on the positive X-axis side of the first locking position 810L.

According to this embodiment, an elastic member 682 is provided on the negative Z-axis side and on the positive X-axis side of the pivotal center 800*c* of the lever 800. The elastic member 682 abuts the lever 800 and is elastically deformed to press the lever 800 in the direction of pressing back the lever 800, when the lever 800 turns in the direction of rotation of moving the first apparatus-side locking element 810 in the positive X-axis direction from the first locking position 810L.

Figure 18:
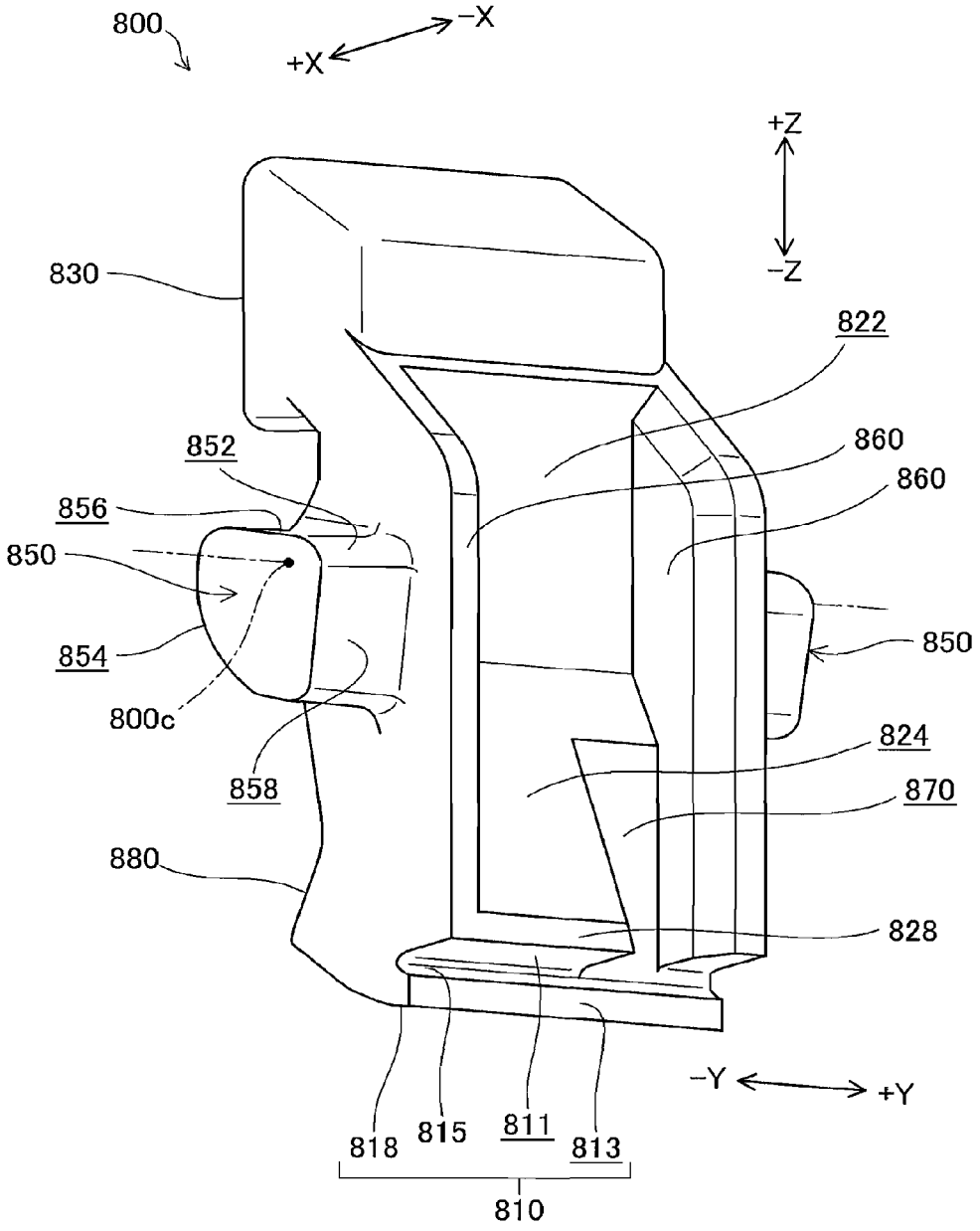
FIG. 18 is a perspective view illustrating the detailed structure of the lever.

FIG. 18 is a perspective view illustrating the detailed structure of the lever 800. As shown in FIG. 18, the operating member 830 is provided on the positive Z-axis end of the lever 800, whilst the first apparatus-side locking element 810 is provided on the opposite end to the end with the operating member 830 across the pivotal center 800*c*, i.e., on the negative Z-axis end of the lever 800.

The first apparatus-side locking element 810 has the first apparatus-side locking surface 811 and the second apparatus-side locking surface 813 as the two intersecting surfaces. The second apparatus-side locking surface 813 is located further away from the pivotal center 800*c* than the first apparatus-side locking surface 811 and is adjacent to a negative Z-axis end 818 of the lever 800.

According to this embodiment, a groove 815 is formed at the position where the first apparatus-side locking surface 811 intersects the second apparatus-side locking surface 813, in order to facilitate engagement of the first apparatus-side locking surface 811 and the second apparatus-side locking surface 813 with the first cartridge-side locking element 210. The groove 815 is provided by extending the first apparatus-side locking surface 811 and cutting part of the first apparatus-side locking surface 811 adjoining to the second apparatus-side locking surface 813.

The lever 800 has a pair of wall members 860 facing each other along the Y axis direction. The pair of wall members 860 are erected on the negative X-axis side of the lever 800 and are extended from the positive Z-axis end to the negative Z-axis end of the lever 800 between the operating member 830 and the first apparatus-side locking element 810. The distance between the pair of wall members 860 along the Y axis is greater than the Y-axis direction length of the first cartridge-side locking element 210 of the cartridge 20. According to this embodiment, the outer surfaces of the pair of wall members 860, i.e., the positive Y-axis side surface of the positive Y-axis side wall member and the negative Y-axis side surface of the negative Y-axis side wall member, form part of the side faces of the lever 800.

A flat surface 822 and a sloped surface 824 are provided between the pair of wall members 860 and are formed sequentially from the operating member 830 toward the first apparatus-side locking element 810. According to this embodiment, the flat surface 822 is provided as a plane parallel to the second apparatus-side locking surface 813, and the sloped surface 824 is provided as a plane linked with the flat surface 822 and inclined in the negative X-axis direction gradually from the flat surface 822 toward the first apparatus-side locking element 810. According to this embodiment, a shallower sloped end portion 828 having the gentler slope than that of the sloped surface 824 is formed between the sloped surface 824 and the first apparatus-side locking surface 811. The pair of wall members 860, the flat surface 822, the sloped surface 824 and the shallower sloped end portion 828 serve as the guide for attachment of the cartridge 20 to the holder 600 and for detachment of the cartridge 20 from the holder 600. In the course of attachment or detachment of the cartridge 20, the pair of wall members 860 restrict the motion of the first cartridge-side locking element 210 in the Y-axis direction, while the flat surface 822, the sloped surface 824 and the shallower sloped end portion 828 restrict the motion of the first cartridge-side locking element 210 in the X-axis direction. This enables the cartridge 20 to be smoothly guided to the proper attachment position in the holder 600 and to be smoothly removed from the holder 600. According to another embodiment, a smooth curved surface may be provided between the pair of wall members 860 to be extended from the operating member 830 to the first apparatus-side locking element 810, instead of the flat surface 822, the sloped surface 824 and the shallower sloped end portion 828.

According to this embodiment, an undercut surface 870 is formed by cutting out part of the sloped surface 824 at the position corresponding to the extended surface 218, in order to receive the extended surface 218 formed on the cartridge 20 and prevent the stuck lever 800. According to this embodiment, the undercut surface 870 is provided as a plane parallel to the second apparatus-side locking surface 813 and is formed from the groove 815 toward the pivotal center 800*c*.

According to this embodiment, an abutting portion 880 is formed on the rear face of the first apparatus-side locking element 810. The abutting portion 880 is configured to temporarily abut the elastic member 682 provided on the holder 600 in the course of attachment of the cartridge 20 to the holder 600 or in the course of detachment of the cartridge 20 from the holder 600.

A pair of pivot shaft bodies 850 are formed on the outer surfaces of the pair of wall members 860 to determine the position of the pivotal center 800*c*. The pair of pivot shaft bodies 850 are provided substantially in the middle of the Z-axis direction length of the lever 800. One of the pivot shaft bodies 850 is protruded in the negative Y-axis direction from the negative Y-axis side surface of the negative Y-axis side wall member, whilst the other pivot shaft body 850 is protruded in the positive Y-axis direction from the positive Y-axis side surface of the positive Y-axis side wall member. According to this embodiment, each of the pair of pivot shaft bodies 840 has a fan-shaped cross section and includes an inner arc surface 852, an outer arc surface 854 and radial side faces 856 and 858. The inner arc surface 852 is a side face at the position corresponding to the central angle of the fan shape, and the outer arc surface 854 is a side face at the position corresponding to the arc of the fan shape. The arcs of the inner arc surface 852 and the outer arc surface 854 both have the centers on the pivotal center 800*c*. The radial side faces 856 and 858 are side faces at the positions corresponding to the radii of the fan shape. The radial side face 856 is a plane substantially along the first apparatus-side locking surface 811, and the radial side face 858 is a plane substantially along the second apparatus-side locking surface 813.

Figure 19:
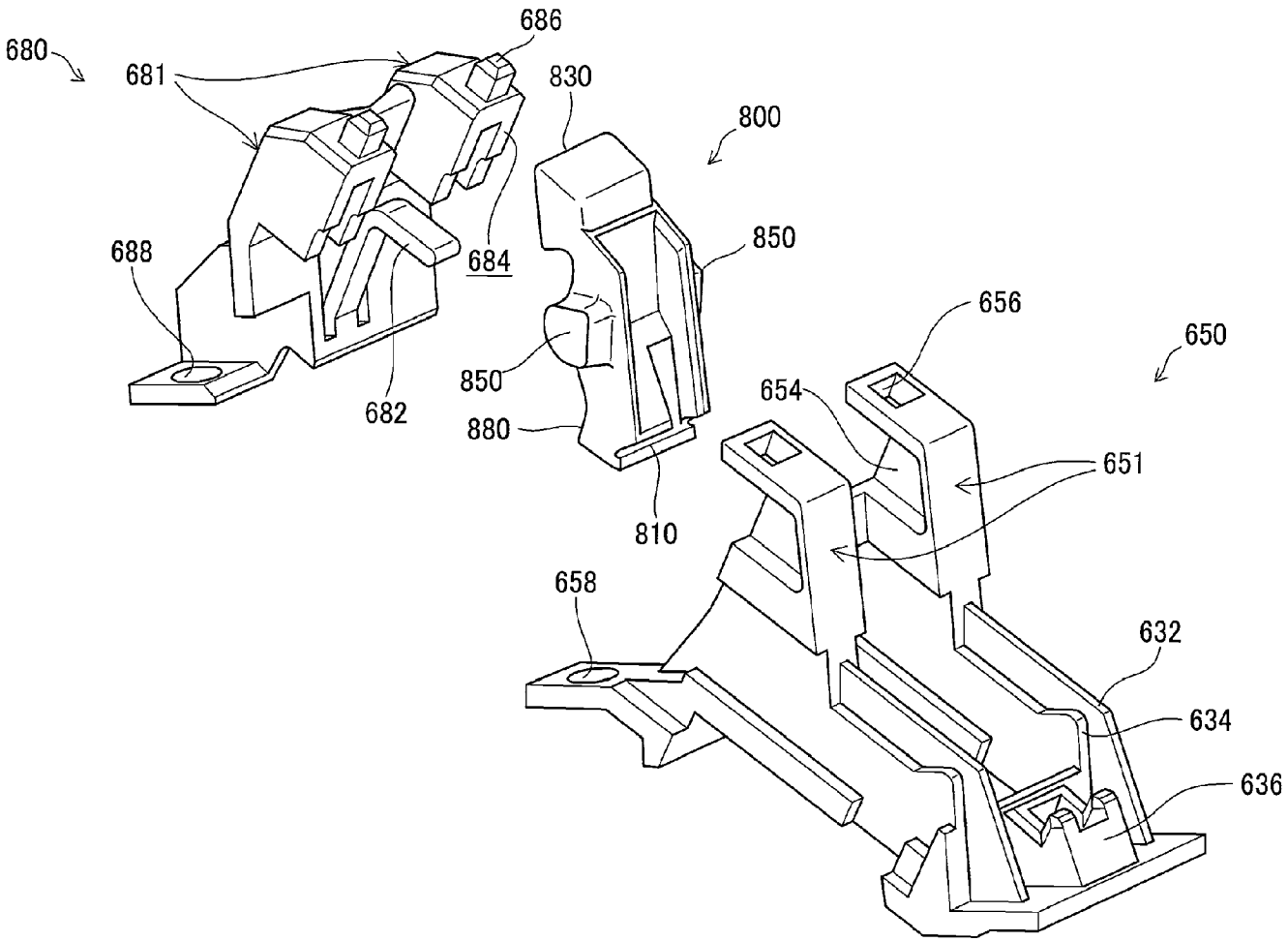
FIG. 19 is an exploded perspective view showing the structure of the lever assembled to the holder.

FIG. 19 is an exploded perspective view showing the structure of the lever 800 assembled to the holder 600. The lever 800 is held on a first retainer member 650 and a second retainer member 680 and is thereby assembled to the holder 600 in a pivotally rotatable manner. The first retainer member 650 and the second retainer member 680 are not fully illustrated in FIG. 19, but only their structural parts relevant to retain the single lever 800 are shown in FIG. 19. According to this embodiment, the first retainer member 650 and the second retainer member 680 are made of a resin material having the higher rigidity than polypropylene (PP), e.g., ABS resin.

The first retainer member 650 has a pair of standing portions 651 and a through hole 658. According to this embodiment, the first retainer member 650 also has the first engagement members 632, the second engagement members 634 and the fitting member 636. The pair of standing portions 651 of the first retainer member 650 are arranged across a space for receiving the lever 800. Each of the standing portions 651 has a bearing element 654 to receive the pivot shaft body 850 of the lever 800. According to this embodiment, each of the standing portions 651 also has an engagement hole 656 serving to engage with the second retainer member 680.

The second retainer member 680 has a pair of standing portions 681 and a through hole 688. According to this embodiment, the second retainer member 680 also has the elastic member 682. The pair of standing portions 681 of the second retainer member 680 are arranged across the same space as that between the pair of standing portions 651 of the first retainer member 650. Each of the standing portions 681 has a block surface 684 to block the bearing element 654, in order to prevent the pivot shaft body 850 of the lever 800 from being unintentionally uncoupled from the bearing element 654. According to this embodiment, each of the standing portions 681 also has an engagement projection 686 to be fit in the engagement hole 656 of the first retainer member 650.

For attachment of the lever 800 to the holder 600, the lever 800 is placed between the pair of standing portions 651 by fitting the respective pivot shaft bodies 850 of the lever 800 into the corresponding bearing elements 654 of the pair of standing portions 651 of the first retainer member 650. Subsequently the first retainer member 650 and the second retainer member 680 are engaged with each other, so that the bearing elements 654 with the pivot shaft bodies 850 of the lever 800 fit therein are blocked by the corresponding block surfaces 684 of the second retainer member 680. The first retainer member 650 and the second retainer member 680 are then fastened together to the holder 600 via screws set in the through holes 658 and 688. This attaches the lever 800 to the holder 600 in a pivotally rotatable manner.

Referring back to FIGS. 13 to 16, the second apparatus-side locking element 620 is formed in the wall member 604 of the holder 600. The second apparatus-side locking element 620 is configured to engage with the second cartridge-side locking element 220 at the second locking position 620L that is located on the positive Z-axis side and on the negative X-axis side of the ink supply tube 640.

According to this embodiment, the second apparatus-side locking element 620 is formed as a through hole having the dimensions to receive the second cartridge-side locking element 220 and has an apparatus-side locking surface 622. The apparatus-side locking surface 622 is a plane facing in the negative Z-axis direction and is configured to engage with the second locking surface 222 of the second cartridge-side locking element 220. In the course of attachment and detachment of the cartridge 20, a positive X-axis end 624 of the apparatus-side locking surface 622 engages with the second cartridge-side locking element 220 and thereby serves as the pivot point of rotation of the cartridge 20 relative to the holder 600.

The wall member 604 of the holder 600 has a space 670 provided on the positive Z-axis side of the second apparatus-side locking element 620. The space 670 provides a room on the wall member 604 to allow rotation of the cartridge 20 about the second apparatus-side locking element 620 as the pivot point of rotation in the course of attachment and detachment of the cartridge 20. According to this embodiment, the space 670 is formed as steps recessed in the negative X-axis direction stepwise in the positive Z-axis direction from the wall member 604. According to another embodiment, the space 670 may be formed as a sloped surface of the wall member 604 lowered in the negative X-axis direction gradually in the positive Z-axis direction.

As shown in FIG. 16, the first apparatus-side locking surface 811 of the first apparatus-side locking element 810 at the first locking position 810L is provided on the negative Z-axis side, i.e., on the side closer to the wall member 601, by the distance Dz from the apparatus-side locking surface 622 of the second apparatus-side locking element 620. In other words, the apparatus-side locking surface 622 is located on the positive Z-axis side, i.e., on the upper side of the holder 600 in the use attitude of the printer 50, by the distance Dz from the first apparatus-side locking surface 811 at the first locking position 810L. This structure enhances the engagement between the first cartridge-side locking element 210 and the first apparatus-side locking element 810 in the attached state of the cartridge 20 to the holder 600 as described above with reference to FIG. 6.

A-5. Attachment and Detachment of Cartridge to and from Holder

Figure 20:
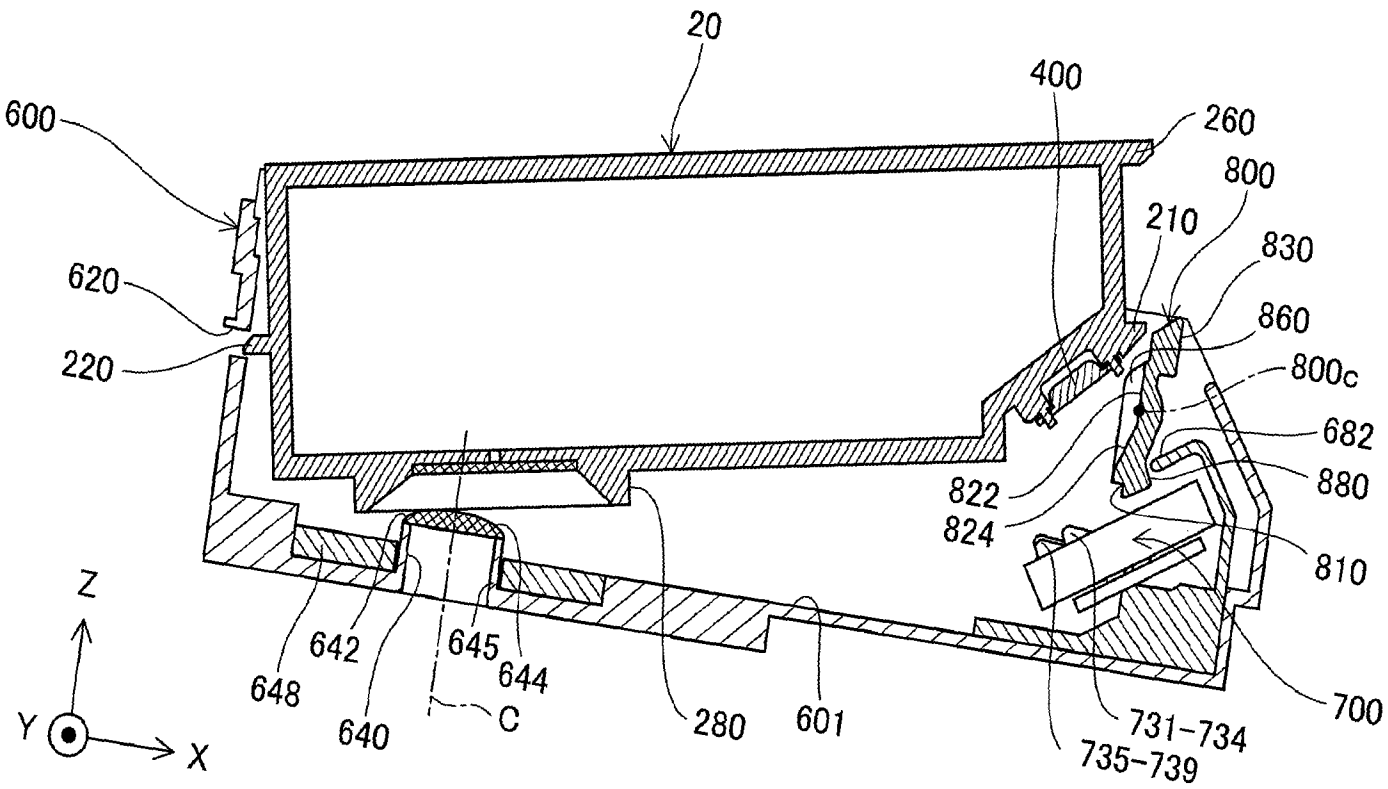
FIG. 20 illustrates attachment and detachment of the cartridge to and from the holder.
Figure 21:
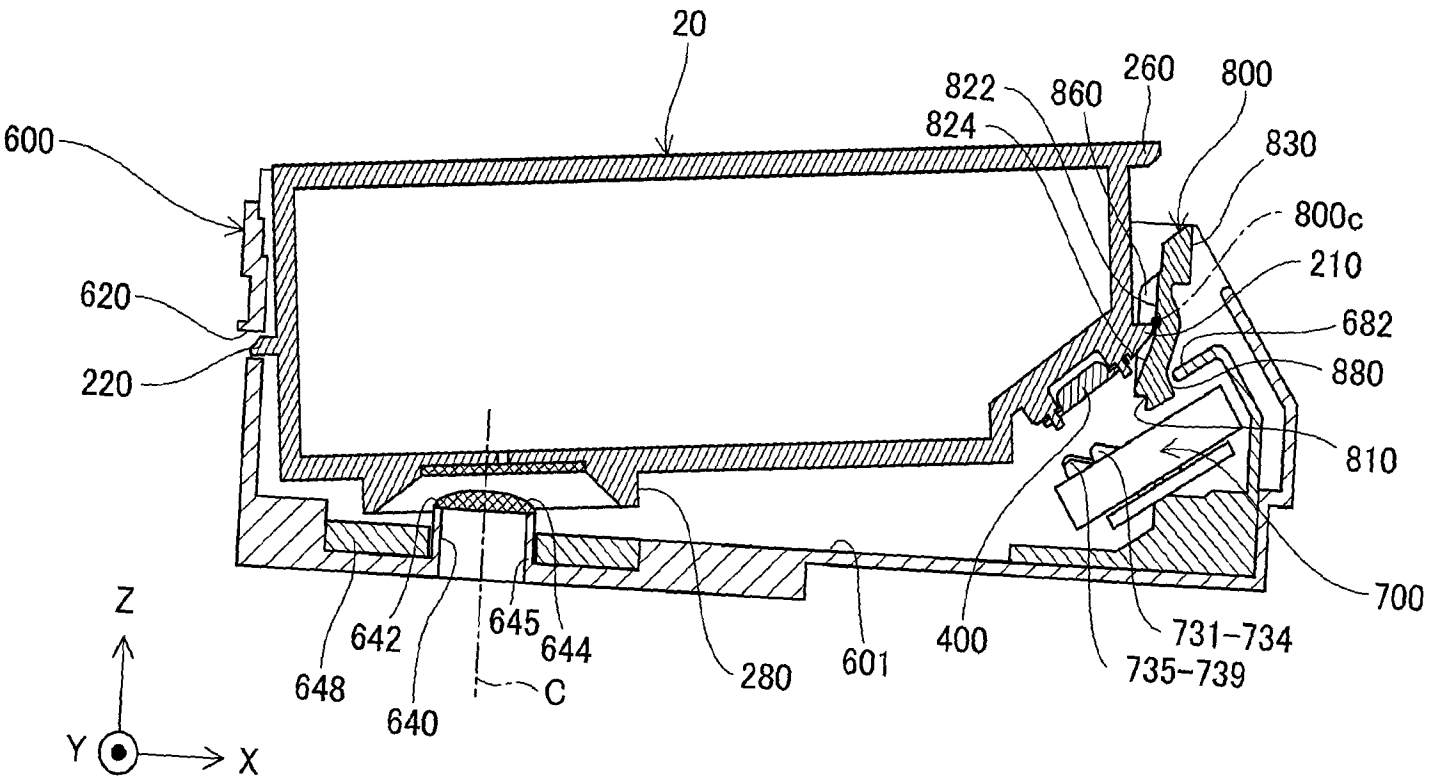
FIG. 21 illustrates attachment and detachment of the cartridge to and from the holder.
Figure 22:
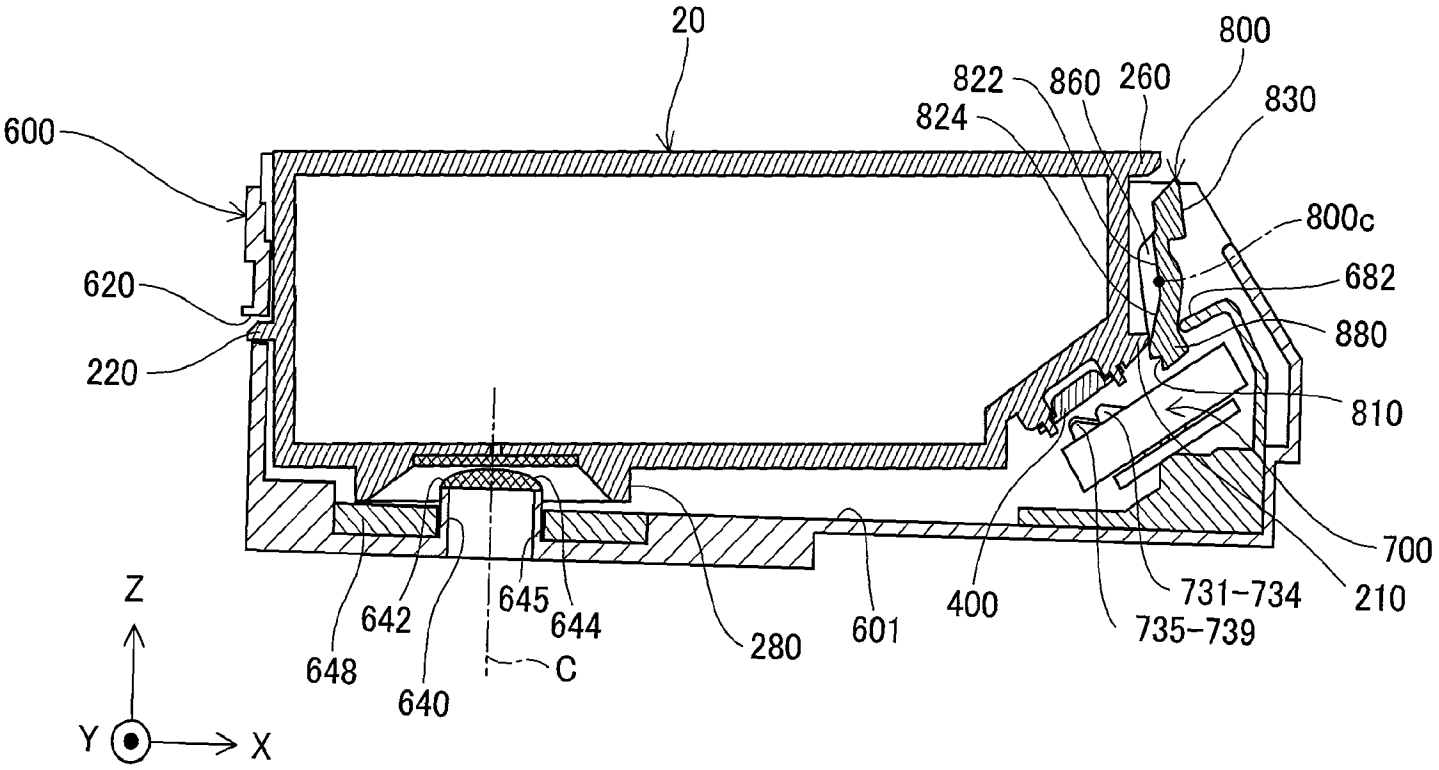
FIG. 22 illustrates attachment and detachment of the cartridge to and from the holder.

FIGS. 20, 21 and 22 illustrate attachment and detachment of the cartridge 20 to and from the holder 600. FIGS. 20 to 22 show the cross sections of the cartridge 20 and the holder 600 taken at the position corresponding to FIG. 5.

For attachment of the cartridge 20 to the holder 600, as shown in FIG. 20, the second cartridge-side locking element 220 is inserted into the second apparatus-side locking element 620, while the cartridge 20 is moved from its end with the second cartridge-side locking element 220 in the negative Z-axis direction into the holder 600. In the state of FIG. 20, the first cartridge-side locking element 210 of the cartridge 20 is located on the positive Z-axis side of the first apparatus-side locking element 810 of the lever 800 in the holder 600.

From the state of FIG. 20, the cartridge 20 is turned clockwise, viewed from the positive Y-axis direction, about the second cartridge-side locking element 220 inserted in the second apparatus-side locking element 620 as the pivot point of rotation, so as to press the third face 203 of the cartridge 20 toward the wall member 601 of the holder 600. As shown in FIG. 21, the first cartridge-side locking element 210 is then guided to between the pair of wall members 860 of the lever 800 to restrict the motion in the Y-axis direction and is in contact with the flat surface 822 between the pair of wall members 860 to restrict the motion in the X-axis direction, while moving on the flat surface 822 in the negative Z-axis direction.

From the state of FIG. 21, the cartridge 20 is further turned to press the third face 203 of the cartridge 20. The first cartridge-side locking element 210 is then further pressed in the negative Z-axis direction and moves on the flat surface 822 to the sloped surface 824 of the lever 800. As shown in FIG. 22, rotating the lever 800 counterclockwise, viewed from the positive Y-axis direction, makes the sloped surface 824 of the lever 800 close to the orientation parallel to the Z axis. In the state of FIG. 22, the first cartridge-side locking element 210 moves in the negative Z-axis direction on the sloped surface 824 close to the orientation parallel to the Z axis. According to this embodiment, the abutting portion 880 on the rear face of the lever 800 abuts the elastic member 682 and receives the pressing force of pressing back the lever 800 clockwise, viewed from the positive Y-axis direction, from the elastic member 682. This pressing force is an external force including a negative Z-axis component. The rotatable range of the lever 800 is accordingly restricted by the elastic member 682. This state of FIG. 22 that the lever 800 abuts the elastic member 682 and is pressed by the elastic member 682 continues until the cartridge 20 is further pressed such that the first cartridge-side locking element 210 goes over the sloped surface 824 of the lever 800.

When the cartridge 20 is further turned from the state of FIG. 22 to cause the first cartridge-side locking element 210 to move on through the sloped surface 824 of the lever 800 and go over the shallower sloped end portion 828, the lever 800 is returned to its original position as shown in FIG. 5, so that the first apparatus-side locking element 810 moves to the first locking position 810L to lock the first cartridge-side locking element 210. The ink supply port 280 of the cartridge 20 is connected with the ink supply tube 640, so that the second cartridge-side locking element 220 engages with the second apparatus-side locking element 620. This completes attachment of the cartridge 20 to the holder 600. Proper attachment of the cartridge 20 at the designed attachment position enables electrical connection between the cartridge-side terminals 431 to 439 and the apparatus-side terminals 731 to 739 and ensures signal transmission between the cartridge 20 and the printer 50.

According to this embodiment, simultaneously with the first cartridge-side locking element 210 moves on through the sloped surface 824 of the lever 800 and goes over the shallower sloped end portion 828, the elastic member 682 separates from the abutting portion 880 on the rear face of the lever 800. The user can accordingly feel the click in the course of attachment of the cartridge 20 to the holder 600.

According to this embodiment, in the attached state of the cartridge 20 to the holder 600, the elastic member 682 does not abut the lever 800 and does not apply an external force. This prevents the lever 800 from being continuously pressed by the elastic member 682 and deformed.

According to another embodiment, the elastic member 682 may abut the lever 800 and press the lever 800 in the direction including a negative X-axis component even in the attached state of the cartridge 20 to the holder 600. This enables the user to more strongly feel the click in the course of attachment of the cartridge 20 to the holder 600. According to another embodiment, the elastic member 682 may be omitted. This reduces the total number of parts. The structure without the elastic member 682 will be described later in a second embodiment.

Figure 23:
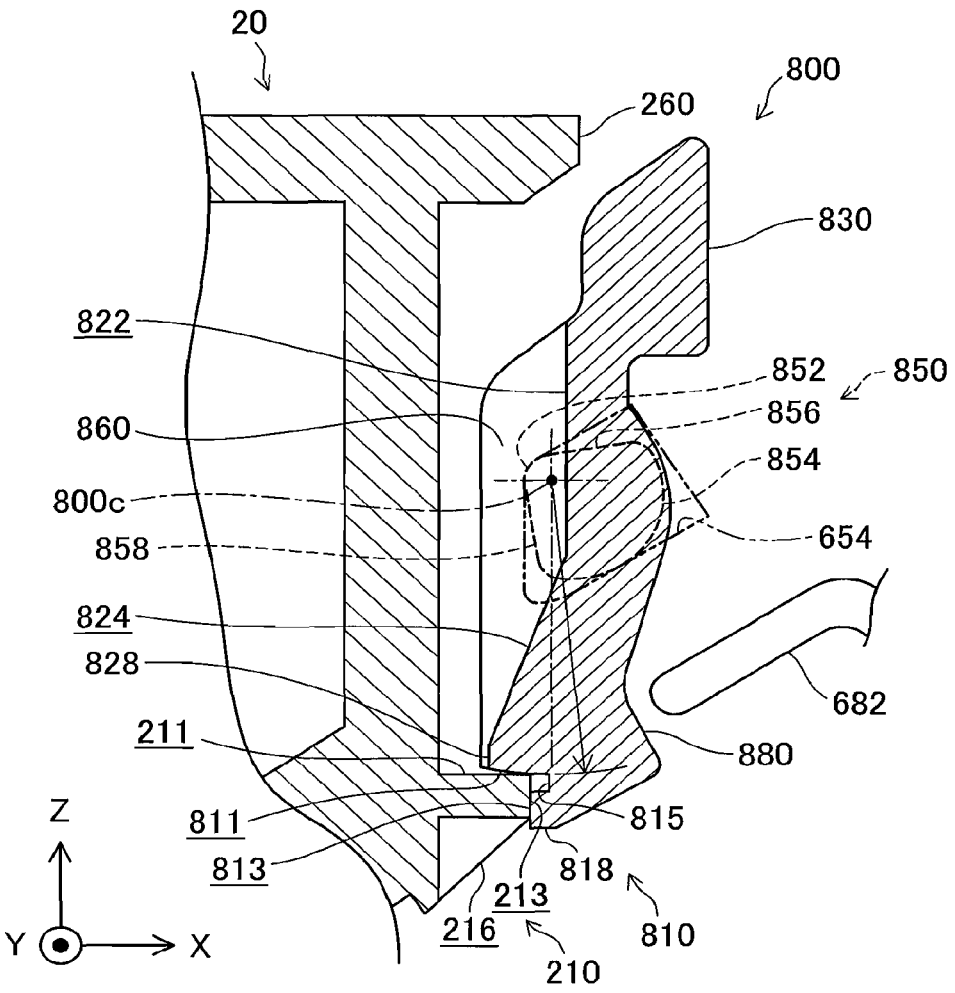
FIG. 23 is a sectional view illustrating the structure around the lever in the attached state of the cartridge to the holder.
Figure 24:
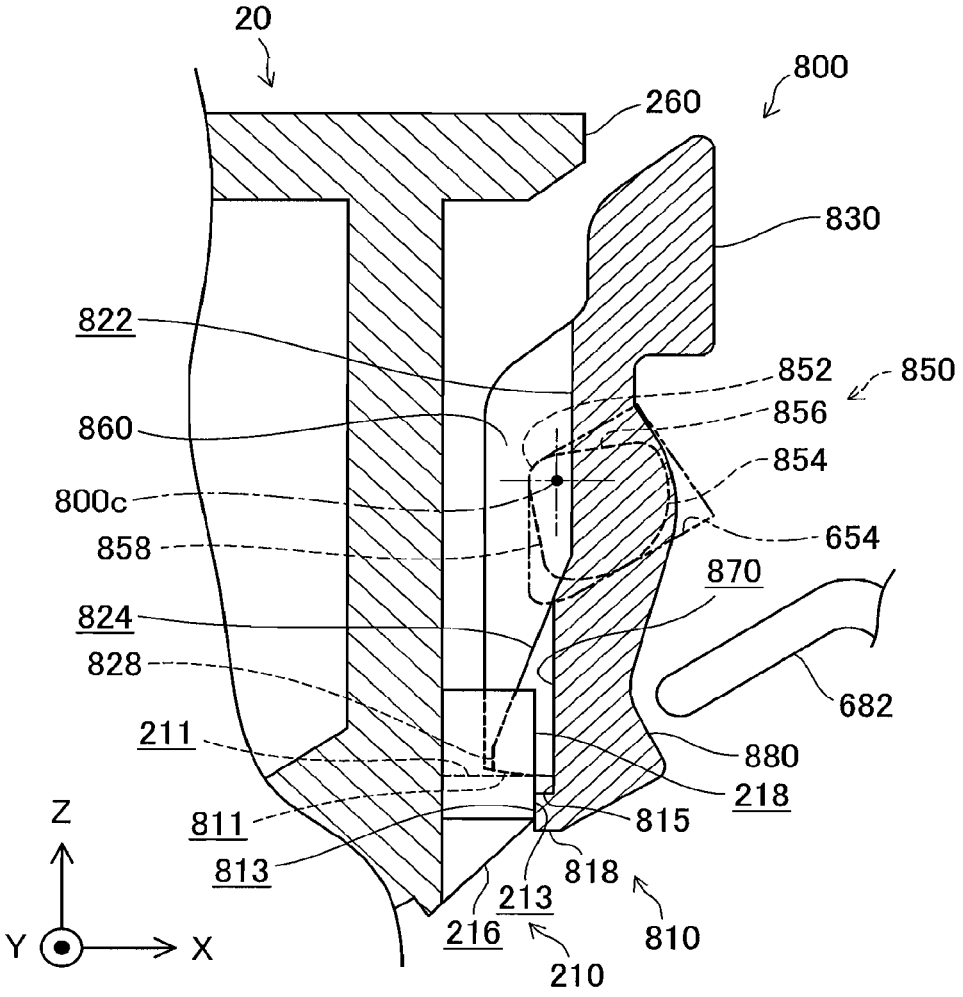
FIG. 24 is a sectional view illustrating the structure around the lever in the attached state of the cartridge to the holder.

FIGS. 23 and 24 are sectional views illustrating the structure around the lever 800 in the attached state of the cartridge 20 to the holder 600. In the state of the lever 800 shown in FIGS. 23 and 24, the first apparatus-side locking element 810 locks the first cartridge-side locking element 210 at the first locking position 810L.

FIG. 23 shows the cross section of the lever 800 locking the cartridge 20 in the holder 600, taken on the plane that goes through the first apparatus-side locking surface 811 and is parallel to the X axis and the Y axis. FIG. 24 shows the cross section of the lever 800 locking the cartridge 20 in the holder 600, taken on the plane that goes through the undercut surface 870 and is parallel to the X axis and the Y axis. In FIGS. 23 and 24, the broken line represents the projected shape of the pivot shaft body 850 of the lever 800, and the two-dot chain line represents the projected shape of the bearing element 654.

As shown in FIGS. 23 and 24, the position of the pivotal center 800*c* of the lever 800 is determined by the contact of the inner arc surface 852 and the outer arc surface 854 with the bearing element 654. Continuously turning the lever 800 counterclockwise, viewed from the positive Y-axis direction, causes the radial side surface 856 of the pivot shaft body 850 to abut the bearing element 654 and thereby restricts the counterclockwise rotation of the lever 800 viewed from the positive Y-axis direction. Continuously turning the lever 800 clockwise, viewed from the positive Y-axis direction, causes the radial side surface 858 of the pivot shaft body 850 to abut the bearing element 654 and thereby restricts the clockwise rotation of the lever 800 viewed from the positive Y-axis direction. This structure ensures stable rotation of the lever 800 and enables the cartridge 20 to be stably held at the designed attachment position.

As shown in FIGS. 23 and 24, the first apparatus-side locking surface 811 of the first apparatus-side locking element 810 engages with the first locking surface 211 of the first cartridge-side locking element 210. Such engagement restricts the motion of the cartridge 20 in the positive Z-axis direction in the attached state of the cartridge 20 to the holder 600. According to this embodiment, the first apparatus-side locking surface 811 is formed to have the cross section parallel to the X axis and the Z axis as the curved surface in arc shape about the pivotal center 800*c*.

As shown in FIGS. 23 and 24, the second apparatus-side locking surface 813 of the first apparatus-side locking element 810 engages with the third locking surface 213 of the first cartridge-side locking element 210. Such engagement restricts the motion of the cartridge 20 in the positive X-axis direction in the attached state of the cartridge 20 to the holder 600. According to this embodiment, the second apparatus-side locking surface 813 is formed as the plane parallel to the Y axis and the Z axis during engagement with the third locking surface 213.

As shown in FIG. 24, in the state that the first apparatus-side locking element 810 locks the first cartridge-side locking element 210, part of the first cartridge-side locking element 210 including the extended surface 218 is accommodated in the space above the undercut surface 870 provided by cutting out the sloped surface 824. This effectively prevents the extended surface 218 from interfering with the engagement of the first apparatus-side locking element 810 with the first cartridge-side locking element 210.

Figure 25:
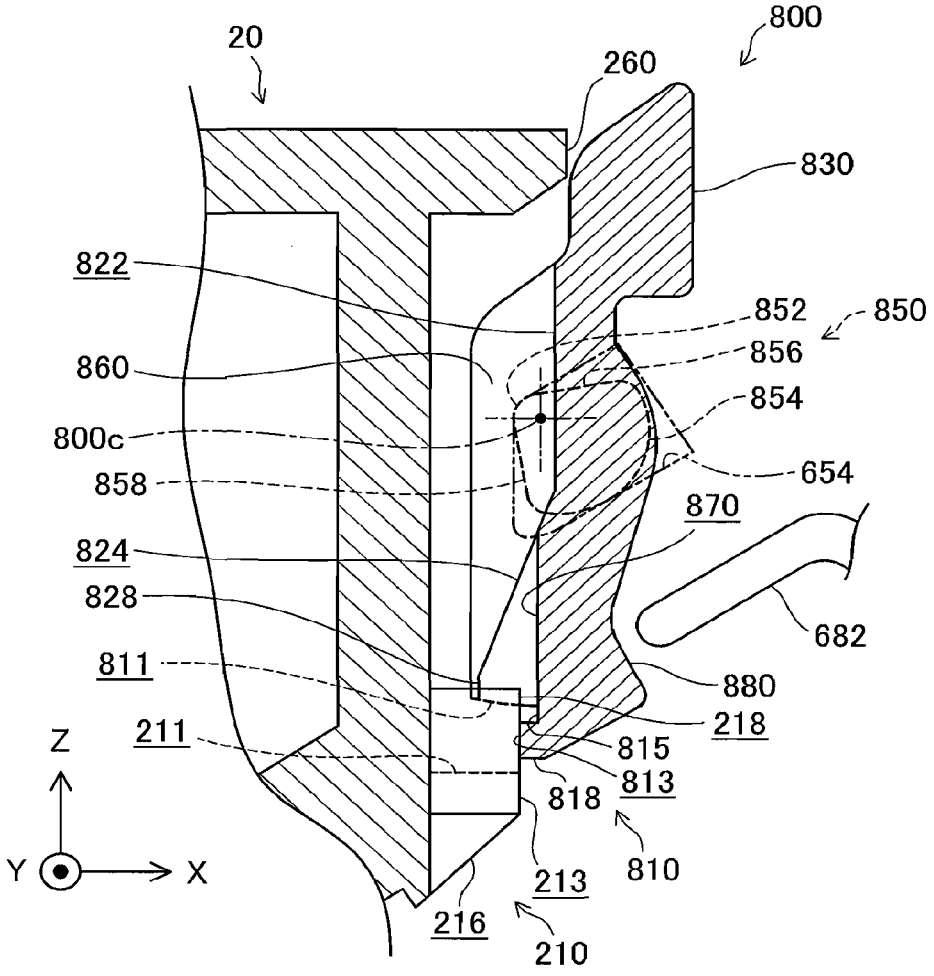
FIG. 25 illustrates moving the cartridge in the negative Z-axis direction from the state of FIG. 24.

FIG. 25 illustrates moving the cartridge 20 in the negative Z-axis direction from the state of FIG. 24. FIG. 25 shows the assumed state that the user excessively presses the cartridge 20 in the negative Z-axis direction compared with the state of FIG. 5 in the course of attachment of the cartridge 20 to the holder 600. According to this embodiment, as shown in FIG. 25, when the cartridge 20 moves further in the negative Z-axis direction from the state where the first apparatus-side locking element 810 locks the first cartridge-side locking element 210, the second apparatus-side locking surface 813 of the lever 800 engages with the extended surface 218 formed by extending the third locking surface 213 in the positive Z-axis direction. This effectively prevents the negative Z-axis end 818 of the lever 800 from running on the first locking surface 211 of the cartridge 20. According to this embodiment, elimination of the force of moving the cartridge 20 in the negative Z-axis direction from the state of FIG. 25 returns the cartridge 20 and the lever 800 to the state of FIG. 24.

Figure 26:
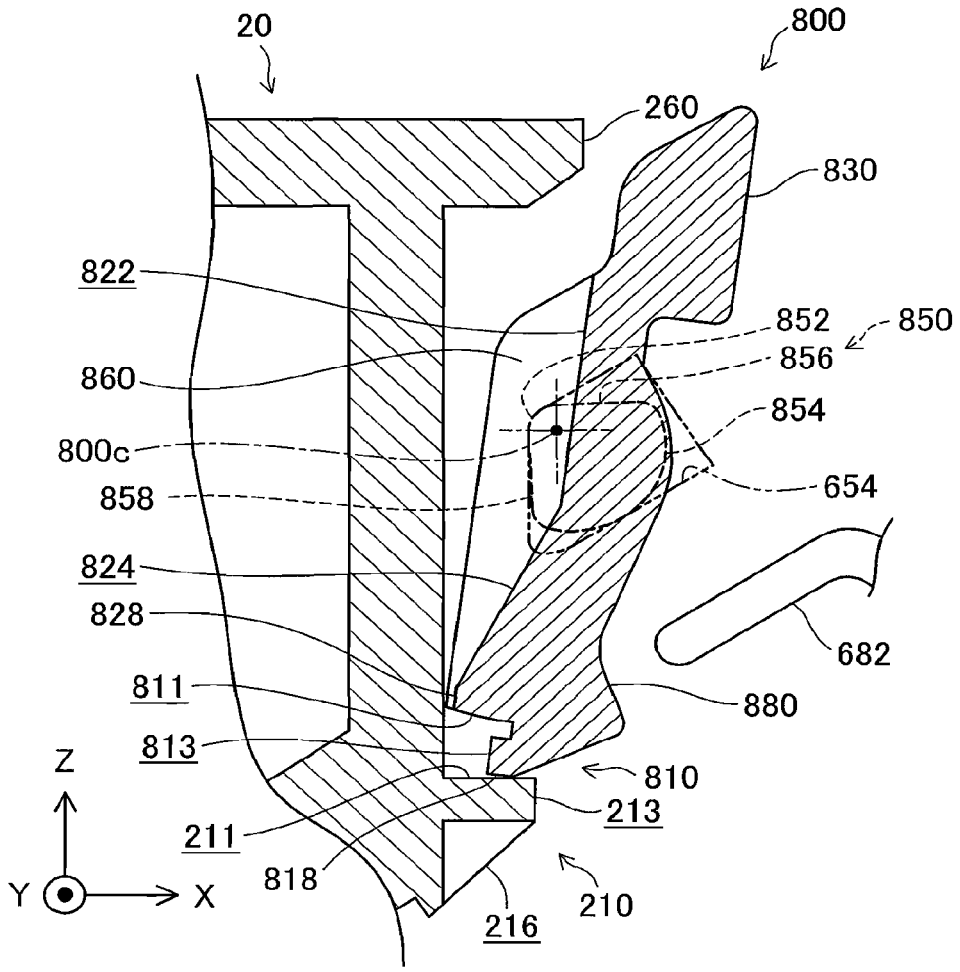
FIG. 26 illustrates moving the cartridge in the negative Z-axis direction from the state corresponding to the state of FIG. 23 according to an embodiment without an extended surface.

FIG. 26 illustrates moving the cartridge 20 in the negative Z-axis direction from the state corresponding to the state of FIG. 23 according to an embodiment without the extended surface 218. Like FIG. 25, FIG. 26 also shows the assumed state that the user excessively presses the cartridge 20 in the negative Z-axis direction in the course of attachment of the cartridge 20 to the holder 600. As shown in FIG. 26, according to this embodiment without the extended surface 218, when the second apparatus-side locking surface 813 of the lever 800 goes over the third locking surface 213 of the cartridge 20, the lever 800 turns clockwise, viewed from the positive Y-axis direction, so that the negative Z-axis end 818 of the lever 800 runs on the first locking surface 211 of the cartridge 20. According to this embodiment without the extended surface 218, the state of FIG. 26 is maintained even when the force of moving the cartridge 20 in the negative Z-axis direction is eliminated. According to this embodiment, the stuck state of the lever 800 is eliminated by pressing the operating member 830 of the lever 800 in the negative X-axis direction and turning the lever 800 counterclockwise, viewed from the positive Y-axis direction, while pressing the cartridge 20 in the negative Z-axis direction.

The cartridge 20 is removed from the holder 600 according to the following procedure. For detachment of the cartridge 20 from the holder 600, the user presses the operating member 830 of the lever 800 in the negative X-axis direction from the state of FIG. 5. In other words, the user applies the operating force Pr in the negative X-axis direction to the operating member 830 of the lever 800. The lever 800 is then turned about the pivotal center 800*c* to move the first apparatus-side locking element 810 in the direction including the positive X-axis component. This disengages the first apparatus-side locking element 810 from the first cartridge-side locking element 210 to the state of FIG. 22. The user subsequently grasps the projection 260 and moves the third face 203 of the cartridge 20 in the positive Z-axis direction, while turning the cartridge 20 counterclockwise, viewed from the positive Y-axis direction, about the second cartridge-side locking element 220 inserted in the second apparatus-side locking element 620 as the pivot point of rotation to the state of FIG. 21 and further to the state of FIG. 20. The user then holds the third face 203 of the cartridge 20 and pulls the second cartridge-side locking element 220 out of the second apparatus-side locking element 620, so as to remove the cartridge 20 from the holder 600.

A-6. Advantageous Effects

In the printing material supply system 10 of the first embodiment described above, as shown in FIG. 25, the extended surface 218 of the first cartridge-side locking element 210 serves as the engagement-preventing element that prevents engagement between the negative Z-axis end 818 of the lever 800 and the first locking surface 211. This structure effectively prevents the negative Z-axis end 818 of the lever 800 from running on the first locking surface 211 and thereby enables the cartridge 20 to be attached at the designed attachment position.

As shown in FIG. 25, the extended surface 218 is formed along the sufficient length in the positive Z-axis direction from the first locking surface 211 to a specific position that is surely not reached by the negative Z-axis end 818 of the lever 800. In other words, the extended surface 218 is formed in a specific shape that prevents the negative Z-axis end 818 of the lever 800 from moving to a projected area of the first locking surface 211 in the positive Z-axis direction. This structure thus effectively prevents the negative Z-axis end 818 from running on the first locking surface 211.

Additionally, as shown in FIG. 25, the extended surface 218 is formed as a surface that is continuous from the third locking surface 213. In other words, the extended surface 218 is formed in a specific shape that enables the negative Z-axis end 818 that has moved to the positive Z-axis side of the first locking surface 211 to be guided to the negative Z-axis side of the first locking surface 211. This structure enables the lever 800 deviated from the normal position to be returned to the normal position.

The extended surface 218 serving as the engagement-preventing element is formed integrally with the first cartridge-side locking element 210. This advantageously simplifies the structure of the cartridge 20.

The extended surface 218 serving as the engagement-preventing element is provided as a surface formed by extending part of the third locking surface 213, which is an end surface formed on the positive X-axis side of the first locking surface 211 of the first cartridge-side locking element 210, in the positive Z-axis direction. This facilitates formation of the engagement-preventing element.

As shown in FIG. 24, the lever 800 has the undercut surface 870 that is formed by cutting out a specific part of the lever 800 corresponding to the extended surface in the state that the first apparatus-side locking element 810 engages with the first cartridge-side locking element 210. This structure advantageously avoids interference between the extended surface 218 and the lever 800 in the state that the first apparatus-side locking element 810 engages with the first cartridge-side locking element 210.

In the attached state of the cartridge 20 to the holder 600, the pressing forces Ps and Pt applied from the holder 600 to the cartridge 20 act in the direction of enhancing the engagement of the first cartridge-side locking element 210 with the first apparatus-side locking element 810 (direction including the positive X-axis component and the positive Z-axis component). This arrangement effectively prevents the cartridge 20 from being released from the designed attachment position and enables the cartridge 20 to be stably held at the designed attachment position.

The lever 800 is provided not on the cartridge 20 but on the holder 600. This structure enables downsizing of the cartridge 20. Since the lever 800 is not provided on the cartridge 20, there is the enhanced flexibility in selection of the material used for the first face 201 to the eighth face 208 of the cartridge 20.

B. Second Embodiment

FIGS. 27, 28, 29 and 30 illustrate attachment and detachment of the cartridge 20 to and from a holder 600A according to a second embodiment. A printing material supply system 10A of the second embodiment adopts the holder 600A without the elastic member 682 for pressing the lever 800, but otherwise has the similar configuration and structure to those of the printing material supply system 10 of the first embodiment. The like elements to those of the first embodiment are expressed by the like symbols and are not specifically explained here. The structure of the cartridge 20 is identical with the structure described in the first embodiment.

Figure 27:
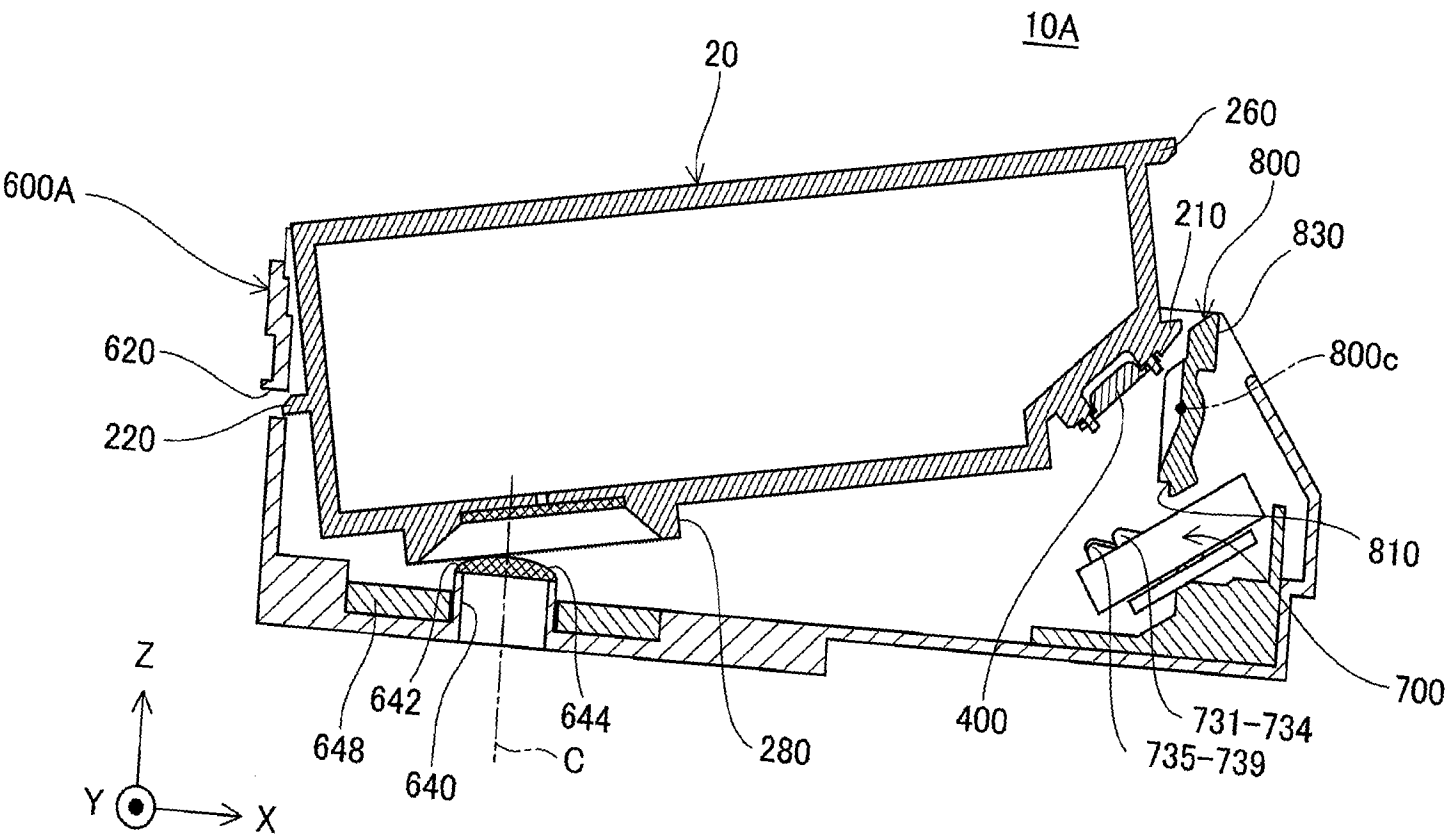
FIG. 27 illustrates attachment and detachment of the cartridge to and from the holder according to a second embodiment.
Figure 28:
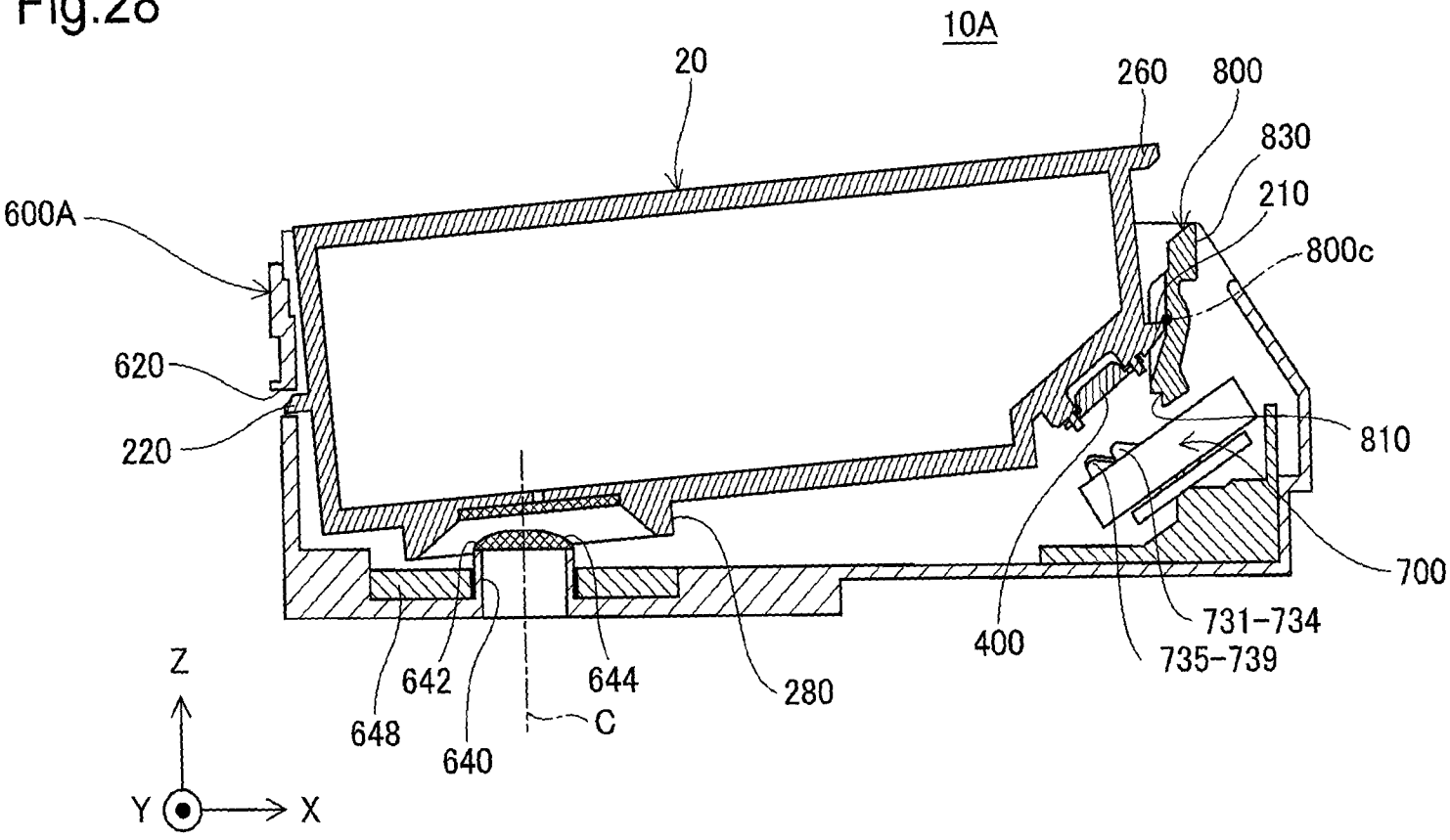
FIG. 28 illustrates attachment and detachment of the cartridge to and from the holder according to the second embodiment.
Figure 29:
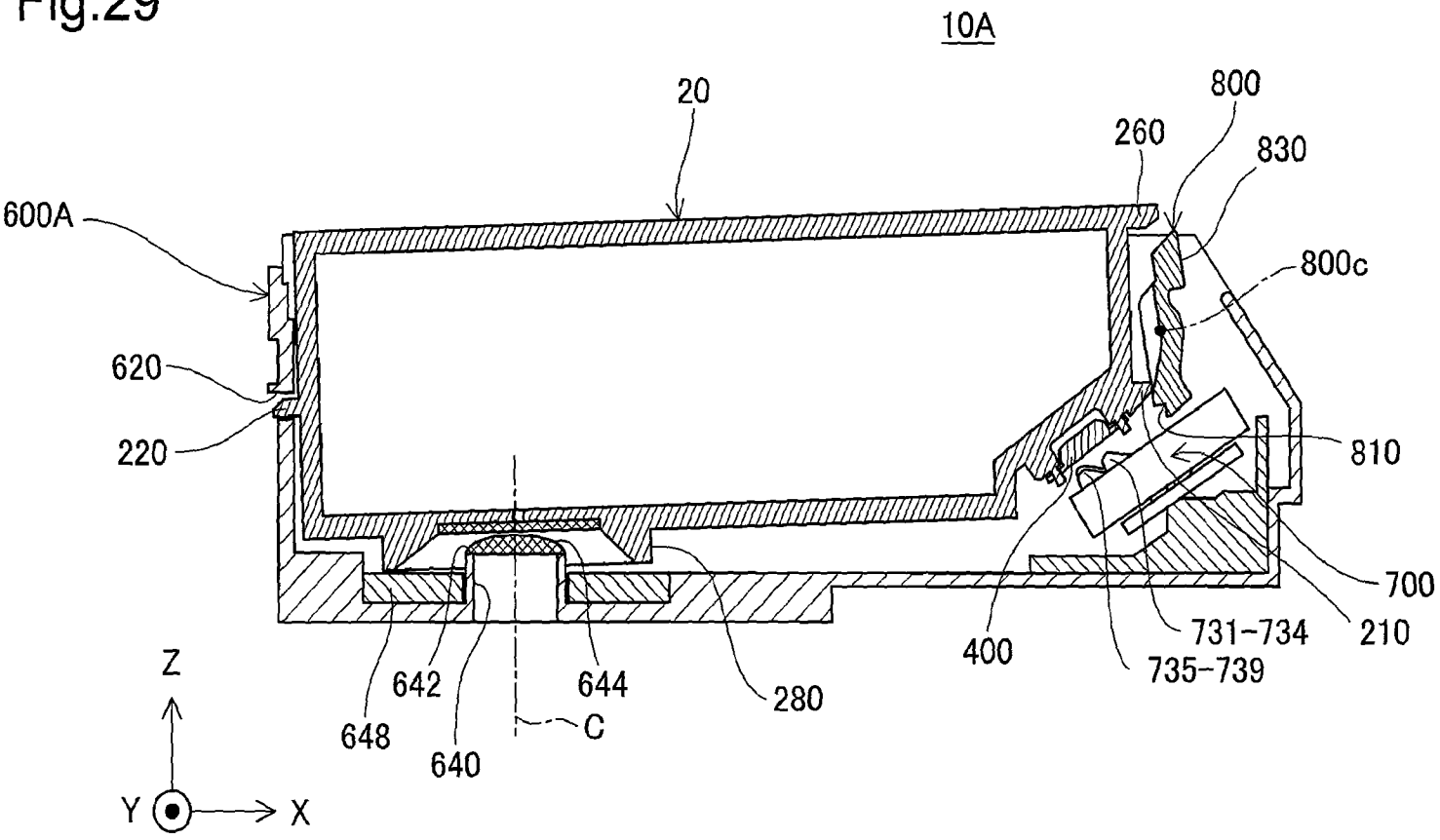
FIG. 29 illustrates attachment and detachment of the cartridge to and from the holder according to the second embodiment.
Figure 30:
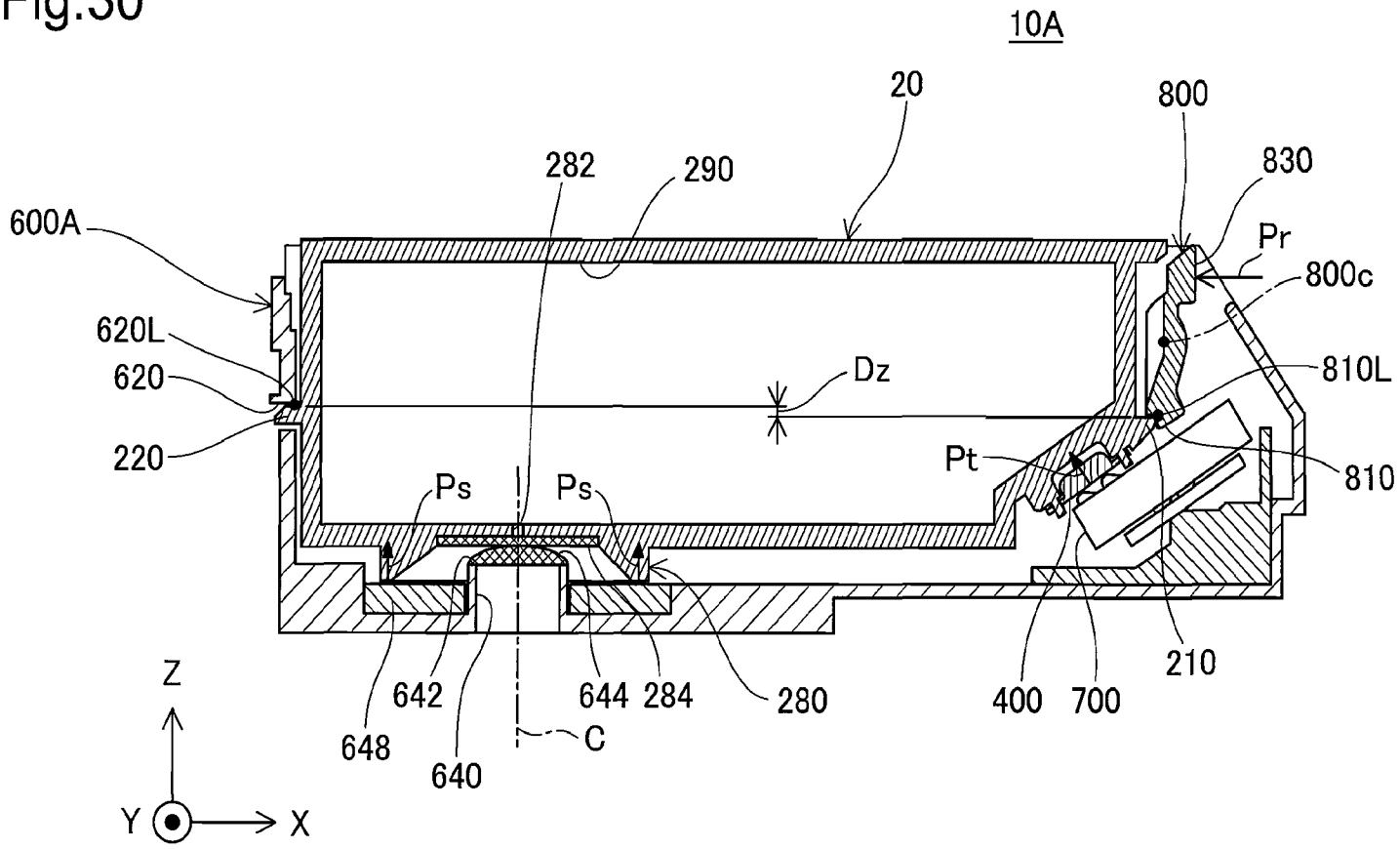
FIG. 30 illustrates attachment and detachment of the cartridge to and from the holder according to the second embodiment.

FIG. 27 corresponds to the state of FIG. 20 of the first embodiment. FIG. 28 corresponds to the state of FIG. 21 of the first embodiment. FIG. 29 corresponds to the state of FIG. 22 of the first embodiment. FIG. 30 corresponds to the state of FIG. 5 of the first embodiment and shows the attached state of the cartridge 20 to the holder 600A.

For attachment of the cartridge 20 to the holder 600A, as shown in FIG. 27, the second cartridge-side locking element 220 is inserted into the second apparatus-side locking element 620, while the cartridge 20 is moved from its end with the second cartridge-side locking element 220 in the negative Z-axis direction into the holder 600A.

From the state of FIG. 27, the cartridge 20 is turned clockwise, viewed from the positive Y-axis direction, about the second cartridge-side locking element 220 inserted in the second apparatus-side locking element 620 as the pivot point of rotation. As shown in FIG. 28, the first cartridge-side locking element 210 is then guided to between the pair of wall members 860 of the lever 800 and moves in the negative Z-axis direction on the flat surface 822 between the pair of wall members 860.

From the state of FIG. 28, the cartridge 20 is further turned to make the first cartridge-side locking element 210 move on the flat surface 822 to the sloped surface 824 of the lever 800. As shown in FIG. 29, rotating the lever 800 counterclockwise, viewed from the positive Y-axis direction, makes the sloped surface 824 of the lever 800 close to the orientation parallel to the Z axis. In the state of FIG. 29, the first cartridge-side locking element 210 moves in the negative Z-axis direction on the sloped surface 824 close to the orientation parallel to the Z axis.

When the cartridge 20 is further turned from the state of FIG. 29 to cause the first cartridge-side locking element 210 to move on through the sloped surface 824 of the lever 800 and go over the shallower sloped end portion 828, the lever 800 is returned to its original position by its dead weight as shown in FIG. 30, so that the first apparatus-side locking element 810 moves to the first locking position 810L to lock the first cartridge-side locking element 210. This completes attachment of the cartridge 20 to the holder 600A.

For detachment of the cartridge 20 from the holder 600A, the user applies the operating force Pr in the negative X-axis direction to the operating member 830 of the lever 800 in the state of FIG. 30, so that the first apparatus-side locking element 810 is disengaged from the first cartridge-side locking element 210 to the state of FIG. 29. The user subsequently moves the cartridge 20 in the positive Z-axis direction, while turning the cartridge 20 counterclockwise, viewed from the positive Y-axis direction, about the second cartridge-side locking element 220 inserted in the second apparatus-side locking element 620 as the pivot point of rotation. This completes detachment of the cartridge 20 from the holder 600A.

The printing material supply system 10 of the second embodiment described above enables the cartridge 20 to be attached at the designed attachment position, like the first embodiment.

C. Third Embodiment

Figure 31:
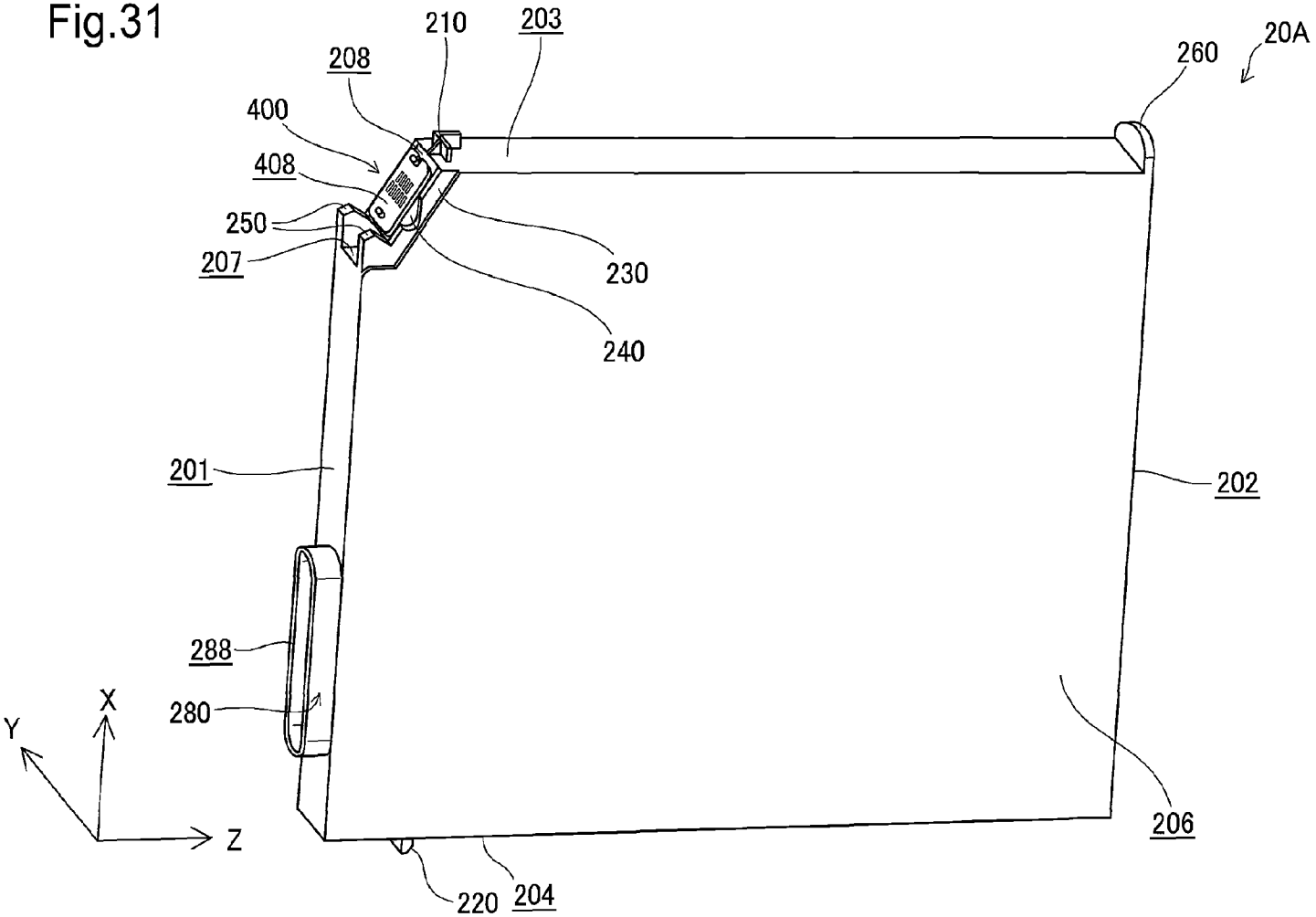
FIG. 31 is a perspective view illustrating the structure of a cartridge according to a third embodiment.

FIG. 31 is a perspective view illustrating the structure of a cartridge 20A according to a third embodiment. The differences from the cartridge 20 of the first embodiment (FIG. 7) include the dimensions of the cartridge 20A and the horizontal orientation of attachment of the cartridge 20A to the holder (not shown) instead of the vertical orientation of attachment described above. Otherwise the cartridge structure is similar to the cartridge structure of the first embodiment. The like elements to those of the first embodiment are expressed by the like symbols and are not specifically explained here. Due to the different dimensions and attachment orientation of the cartridge 20A from those of the first embodiment, the printer of the third embodiment also adapts the different dimensions of the holder and the different position and orientation of the holder in the printer from those in the printer of the first embodiment. The individual parts and components of the holder according to the third embodiment are, however, identical with those of the first embodiment and are thus not specifically described here. While the cartridge 20 of the first embodiment is especially suitable for the on-carriage type printers and the small-size printers, the cartridge 20A of the third embodiment is especially suitable for the off-carriage type printers and the large-size printers. Both the cartridges 20 and 20A are, however, applicable to any types of printers, i.e., on-carriage type and off-carriage type, and small size and large size.

As shown in FIG. 31, the cartridge 20A according to the third embodiment has the similar structure to that of the cartridge 20 according to the first embodiment, except that the third face 203 to the sixth face 206 are extended in the positive Z-axis direction. According to the third embodiment, the Z-axis direction length, the X-axis direction length and the Y-axis direction length of the cartridge 20A descend in this order. According to the third embodiment, the cartridge 20A is attached to and detached from the holder 600 in the Z-axis direction that is the horizontal direction and upward in the direction of gravity (vertical direction) that is the positive X-axis direction.

The structure of the third embodiment has the similar advantageous effects to those of the structure of the first embodiment.

D. Modifications

The foregoing has described the invention in detail with reference to the illustrative embodiments. The invention is, however, not limited to the above embodiments, but a multiplicity of variations and modifications may be made to the embodiments without departing from the scope of the invention.

D-1. Modifications of First Cartridge-Side Locking Element

FIGS. 32A to 32F illustrate modifications of the first cartridge-side locking element 210. More specifically, FIGS. 32A to 32F show six different shapes of first cartridge-side locking elements 210A to 210F.

Figure 32A:
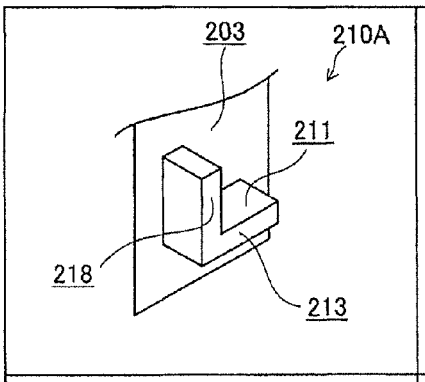
FIGS. 32A to 32F illustrate modifications of first cartridge-side locking element.
Figure 32B:
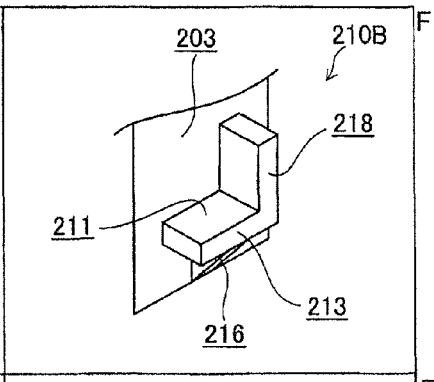
Figure 32C:
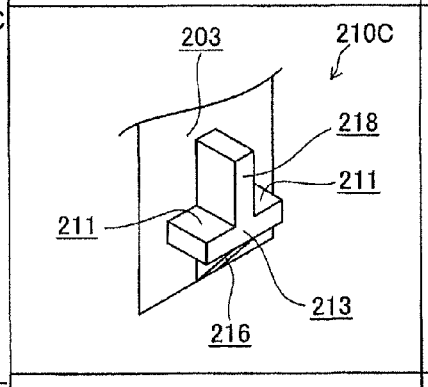

The first cartridge-side locking element 210A shown in FIG. 32A does not have the sloped surface 216, but otherwise has the similar structure to that of the first embodiment. The first cartridge-side locking element 210B shown in FIG. 32B has the extended surface 218 formed on the negative Y-axis side, but otherwise has the similar structure to that of the first embodiment. The first cartridge-side locking element 210C shown in FIG. 32C has the extended surface 218 formed in the middle of the Y-axis direction, but otherwise has the similar structure to that of the first embodiment.

Figure 32D:
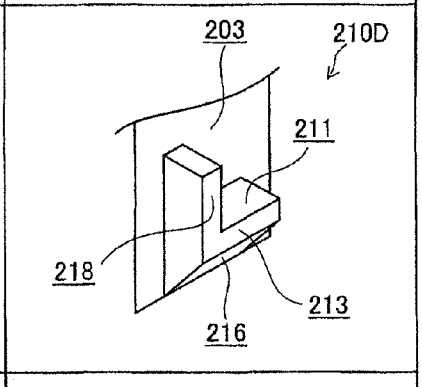
Figure 32E:
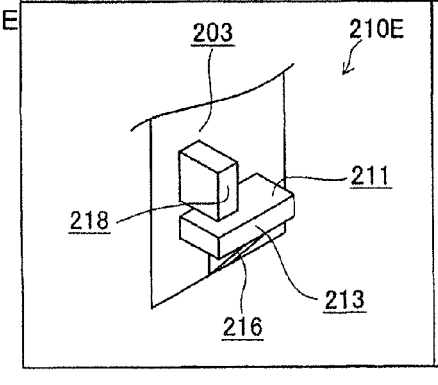
Figure 32F:
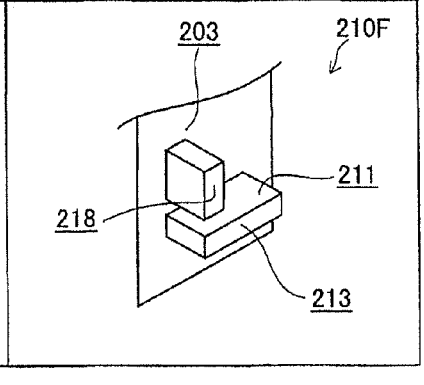

The first cartridge-side locking element 210D shown in FIG. 32D has the sloped surface 216 formed along the whole length of the negative Z-axis end, but otherwise has the similar structure to that of the first embodiment. The first cartridge-side locking element 210E shown in FIG. 32E has the protrusion with the first locking surface 211 and the third locking surface 313 formed separately from the protrusion with the extended surface 218, but otherwise has the similar structure to that of the first embodiment. The first cartridge-side locking element 210F shown in FIG. 32F has the sloped surface 216 omitted, but otherwise has the similar structure to that of the modification of FIG. 32E.

The lever 800 used for any of the modifications shown in FIGS. 32A, 32D, 32E and 32F has the same structure as that of the first embodiment. The lever 800 used for either of the modifications shown in FIGS. 32B and 32C has the similar structure to that of the first embodiment, except the position of the undercut surface 870.

Figure 39:
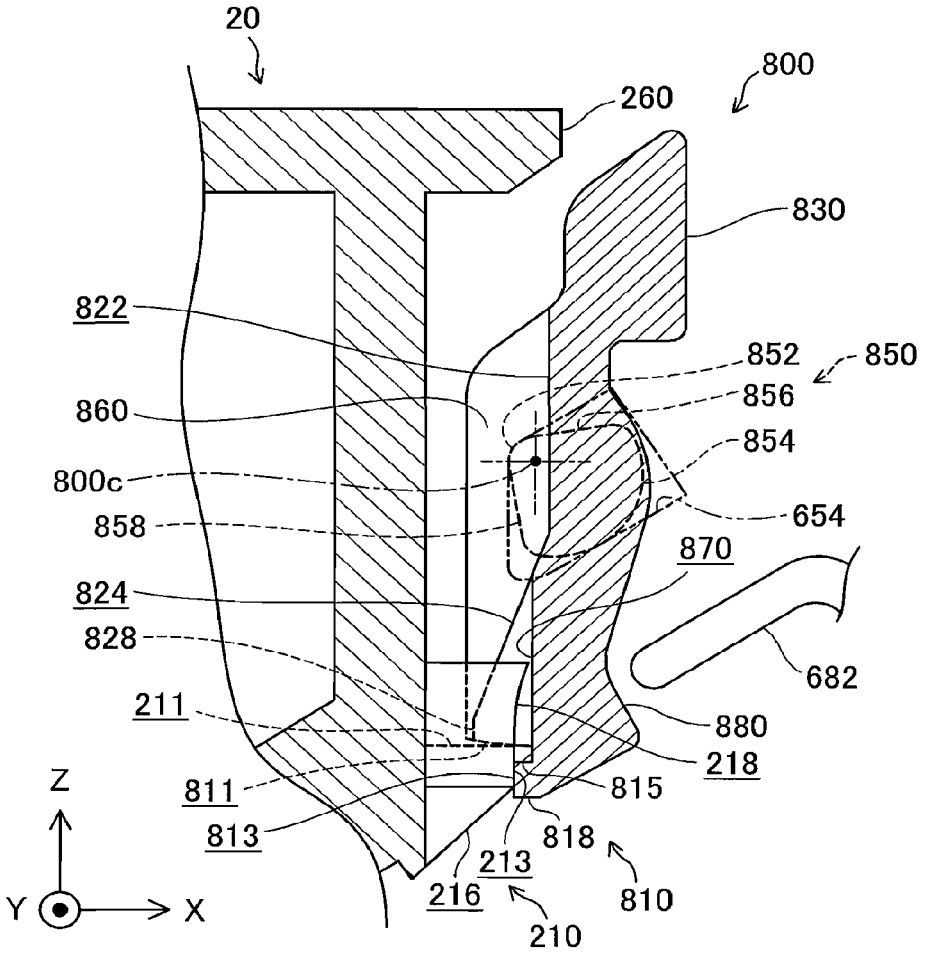
FIG. 39 is a cross sectional diagram illustrating the lever that is mounted on the holder in a pivotally movable manner according to another embodiment.

FIG. 39 is a cross sectional diagram illustrating the lever 800 that is mounted on the holder 600 in a pivotally movable manner according to another embodiment. More specifically, like FIG. 24 of the first embodiment, FIG. 39 shows the cross section of the lever 800 locking the cartridge 20 in the holder 600, taken on the plane that goes through the undercut surface 870 and is parallel to the X axis and the Y axis according to another embodiment. The lever 800 of this embodiment shown in FIG. 39 has the extended surface 218 of the first cartridge-side locking element 210 that is curved along the positive Z-axis direction toward the positive X-axis direction, but otherwise has the similar structure to that of the first embodiment. Like the structure of the first embodiment, the structure of this embodiment shown in FIG. 39 also effectively prevents the negative Z-axis end 818 of the lever 800 from running on the first locking surface 211 and thereby enables the cartridge 20 to be attached at the designed attachment position.

Figure 40:
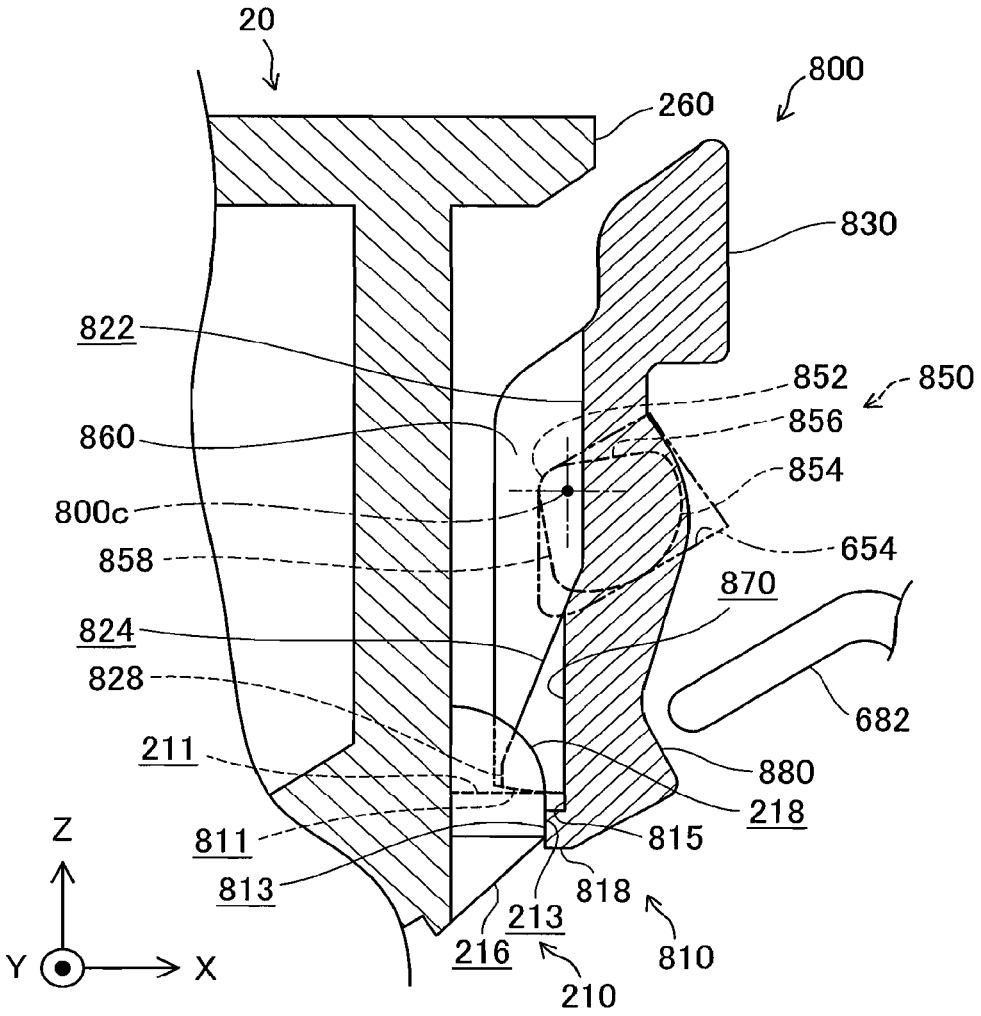
FIG. 40 is a cross sectional diagram illustrating the lever that is mounted on the holder in a pivotally movable manner according to yet another embodiment.

FIG. 40 is a cross sectional diagram illustrating the lever 800 that is mounted on the holder 600 in a pivotally movable manner according to yet another embodiment. More specifically, like FIG. 24 of the first embodiment, FIG. 40 shows the cross section of the lever 800 locking the cartridge 20 in the holder 600, taken on the plane that goes through the undercut surface 870 and is parallel to the X axis and the Y axis according to yet another embodiment. The lever 800 of this embodiment shown in FIG. 40 has the extended surface 218 of the first cartridge-side locking element 210 that is formed as a curved surface convex to both the positive Z-axis direction and the positive X-axis direction, but otherwise has the similar structure to that of the first embodiment. Like the structure of the first embodiment, the structure of this embodiment shown in FIG. 40 also effectively prevents the negative Z-axis end 818 of the lever 800 from running on the first locking surface 211 and thereby enables the cartridge 20 to be attached at the designed attachment position.

Figure 33A:
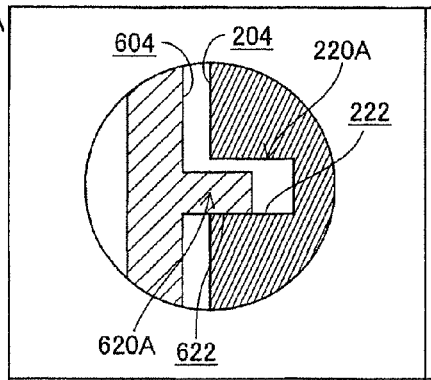
FIGS. 33A to 33C illustrate modifications of second cartridge-side locking element and second apparatus-side locking element.
Figure 33B:
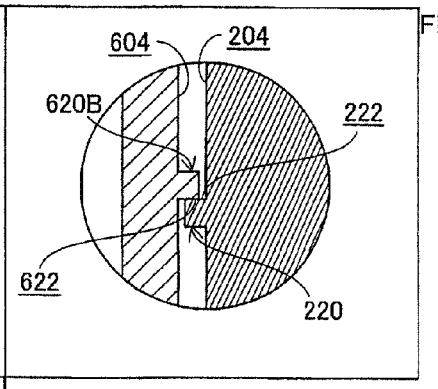
Figure 33C:
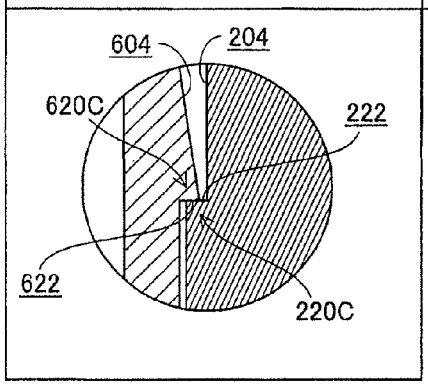

D-2. Modifications of Second Cartridge-Side Locking Element and Second Apparatus-Side Locking Element FIGS. 33A to 33C illustrate modifications of the second cartridge-side locking element 220 and the second apparatus-side locking element 620. More specifically, FIGS. 33A to 33C show three different structures of the second cartridge-side locking element 220 and the second apparatus-side locking element 620.

The modification of FIG. 33A has a second cartridge-side locking element 220A formed as a recess and a second apparatus-side locking element 620A formed as a projection, but otherwise has the similar structure to that of the first embodiment.

The modification of FIG. 33B has a second apparatus-side locking element 620B formed as a projection, which engages with the second cartridge-side locking element 220 of the same shape as that of the first embodiment, but otherwise has the similar structure to that of the first embodiment.

The modification of FIG. 33C has a second cartridge-side locking element 220C formed as a step on the negative Z-axis side rising in the negative X-axis direction and a second apparatus-side locking element 620C formed as a step on the positive Z-axis side rising in the positive X-axis direction, but otherwise has the similar structure to that of the first embodiment.

D-3. Modifications of Cartridge Outer Shape

FIGS. 34A to 34F illustrate modifications of the cartridge outer shape. More specifically, FIGS. 34A to 34F show six different cartridge outer shapes. The like elements to those of the first embodiment are expressed by the like symbols and are not specifically explained here.

Figure 34A:
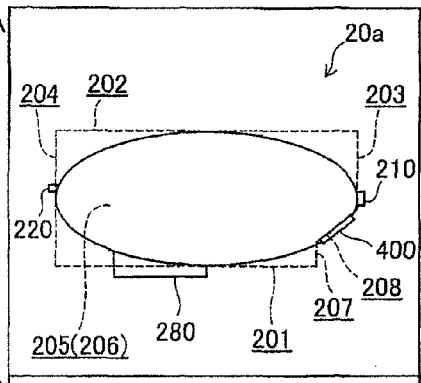
FIGS. 34A to 34F illustrate modifications of cartridge outer shape.

A cartridge 20*a* shown in FIG. 34A has a housing of an elliptical or oval side face. The cartridge 20*a* has the first cartridge-side locking element 210 and the circuit board 400 on its front face, the ink supply port 280 on its bottom face, and the second cartridge-side locking element 220 on its rear face. The cartridge 20*a* has a fixed width, viewed from its front face.

Figure 34B:
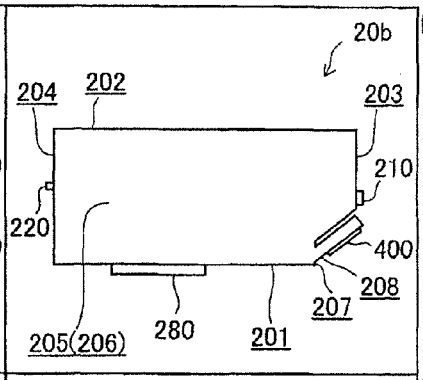

A cartridge 20*b* shown in FIG. 34B has the eighth face 208 that is discontinuous from the negative Z-axis end of the third face 203, but otherwise has the same structure as that of the cartridge 20 of the first embodiment.

Figure 34C:
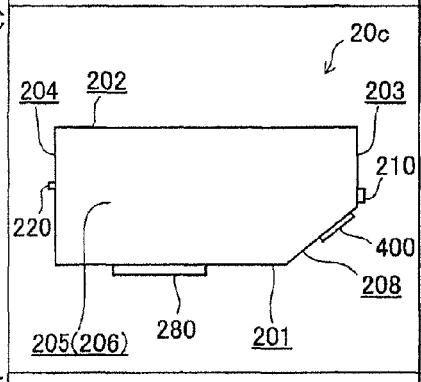

A cartridge 20*c* shown in FIG. 34C has the eighth face 208 extended to the first face 201 with omission of the seventh face 207, but otherwise has the same structure as that of the cartridge 20 of the first embodiment.

Figure 34D:
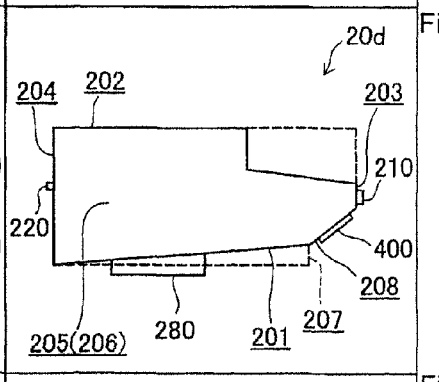

A cartridge 20*d* shown in FIG. 34D has a cutout portion at the intersection between the second face 202 and the third face 203 and the first face 201 inclined to the eighth face 208 with omission of the seventh face 207, but otherwise has the same structure as that of the cartridge 20 of the first embodiment.

Figure 34E:
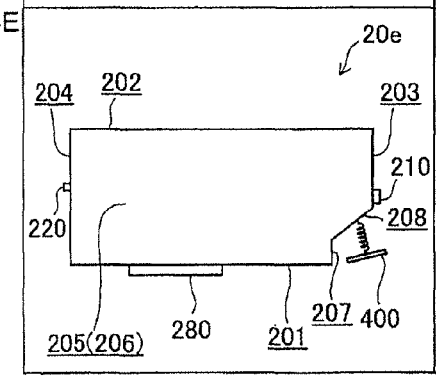

A cartridge 20*e* shown in FIG. 34E has the circuit board 400 attached to the eighth face 208 by means of a spring, but otherwise has the same structure as that of the cartridge 20 of the first embodiment.

Figure 34F:
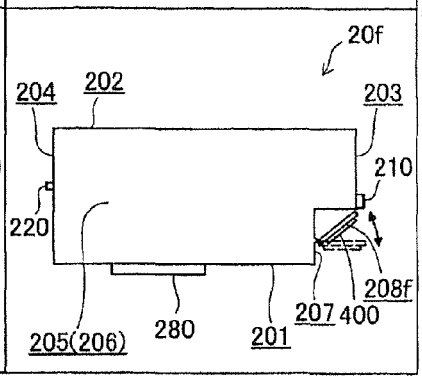

A cartridge 20*f* shown in FIG. 34F has a movable face 208*f*, instead of the eighth face 208, and the circuit board 400 mounted on this movable face 208*f*, but otherwise has the same structure as that of the cartridge 20 of the first embodiment.

All the cartridges 20*a* to 20*f* according to the modifications of FIGS. 34A to 34F have the first cartridge-side locking element 210, the second cartridge-side locking element 220, the ink supply port 280 and the circuit board 400 at the positions corresponding to those of the cartridge 20 of the first embodiment. The cartridges 20*a* to 20*f* of the respective modifications are thus all compatible with the cartridge 20 of the first embodiment.

As clearly understood from the examples shown in FIGS. 34A to 34F, there are various other modifications of cartridge outer shape. In the case of the cartridge having the outer shape other than the approximate rectangular parallelepiped, as shown by the broken lines in FIGS. 34A and 34D, the six faces of the rectangular parallelepiped, i.e., the first face (bottom face) 201, the second face (top face) 202, the third face (front face) 203, the fourth face (rear face) 204, the fifth face (left side face) 205 and the sixth face (right side face) 206 shown in FIGS. 7 and 8, can be virtually assumed. In the specification hereof, the terms "face" and "plane" mean both the virtual plane or the non-actual plane as shown in FIG. 34A or 34D and the actual plane as shown in FIGS. 7 and 8. The terms "face" and "plane" include both planar surfaces and curved surfaces.

D-4. Cartridge with Adapter

Figure 35:
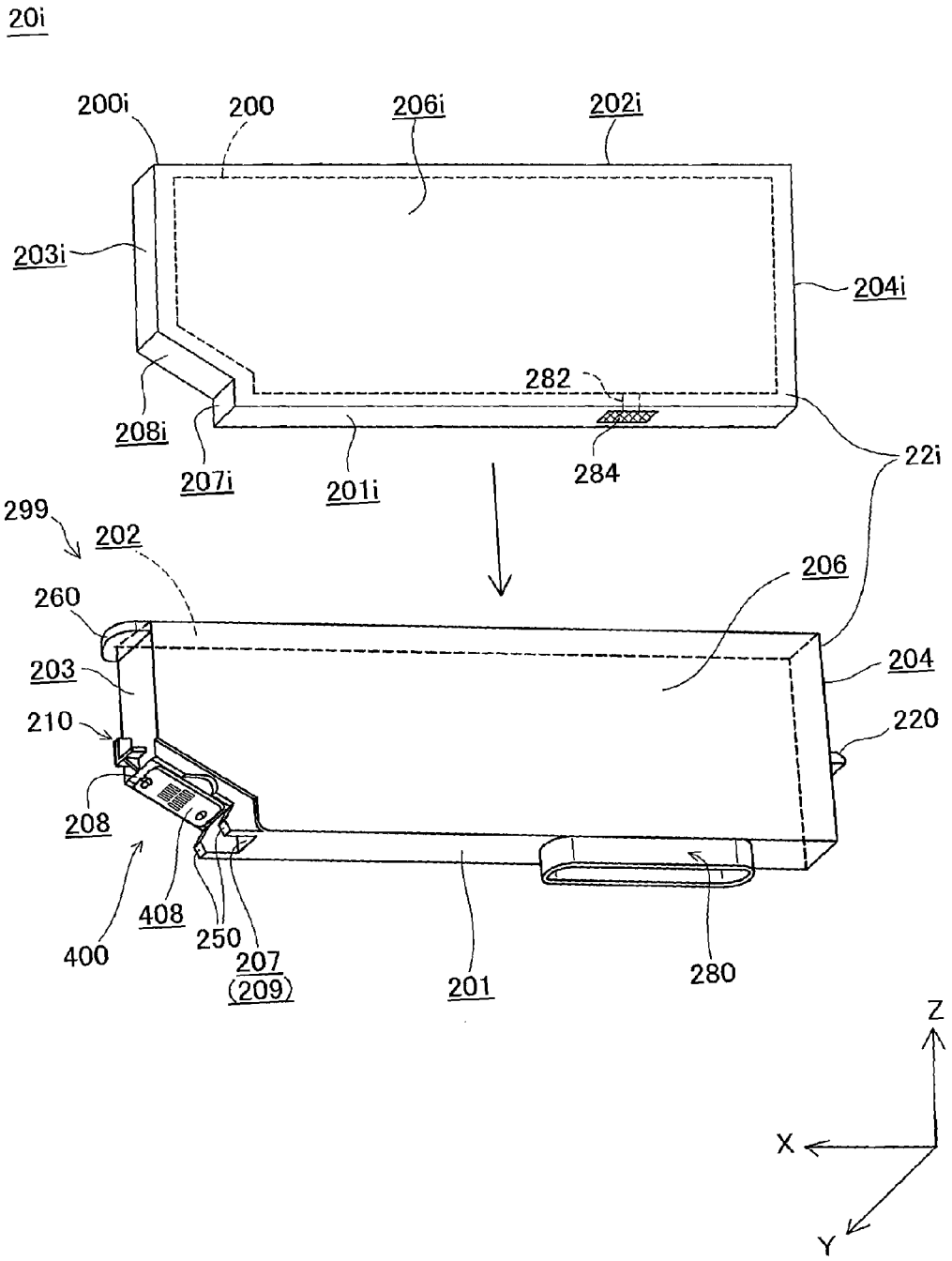
FIG. 35 is a perspective view illustrating the structure of a cartridge with an adapter.

FIG. 35 is a perspective view illustrating the structure of a cartridge 20*i* with an adapter 299. The cartridge 20*i* is configured to be separable to a container assembly 200*i* and the adapter 299. The container assembly 200*i* has a printing material chamber 200 structured to contain printing material. When the printing material in the printing material chamber 200 is used up, the user may replace the container assembly 200*i* with a new one or may refill the printing material into the printing material chamber 200 of the container assembly 200*i*. The adapter 299 is reusable with the replaced container assembly 200*i* or with the container assembly 200*i* having the printing material refilled. The cartridge 20*i* of FIG. 35 is compatible with the cartridge 20 of the first embodiment shown in FIG. 7.

A housing 22*i* for the cartridge 20*i* is structured as a combination of a housing for the container assembly 200*i* and a housing for the adapter 299. The container assembly 200*i* has an ink flow path 282 and a resin foam 284, in addition to the printing material chamber 200.

The container assembly 200*i* of the cartridge 20*i* has a second face 202*i* corresponding to the second face 202 of the cartridge 20*i*. The container assembly 200*i* also has a first face 201*i*, a third face 203*i*, a fourth face 204*i*, a fifth face (not shown), a sixth face 206*i*, a seventh face 207*i* and an eighth face 208*i* respectively corresponding to the first face 201 and the third to the eighth faces 203 to 208 of the cartridge 20*i*.

The first face 201*i* and the second face 202*i* are opposed to each other in the Z-axis direction; the first face 201*i* is located on the negative Z-axis side and the second face 202*i* is located on the positive Z-axis side. The third face 203*i* and the fourth face 204*i* are opposed to each other in the X-axis direction; the third face 203*i* is located on the positive X-axis side and the fourth face 204*i* is located on the negative X-axis side. The fifth face (not shown) and the sixth face 206*i* are opposed to each other in the Y-axis direction; the fifth face (not shown) is located on the negative Y-axis side and the sixth face 206*i* is located on the positive Y-axis side. The seventh face 207*i* and the eighth face 208*i* form the connection faces to connect the first face 201*i* with the third face 203*i*.

The seventh face 207*i* is perpendicular to the first face 201*i* and forms a plane parallel to the Y axis and the Z axis (YZ plane). The seventh face 207*i* is the step vertical-angled relative to the first face 201*i*. The seventh face 207*i* is accordingly extended from the first face 201*i* in the positive Z-axis direction. The seventh face 207*i* is located on the negative X-axis side and on the negative Z-axis side of the eighth face 208*i*.

The eighth face 208*i* connects the seventh face 207*i* with the third face 203*i* and is a sloped surface inclined in the direction including a positive X-axis component and a negative Z-axis component. The eighth face 208*i* is inclined to the first face 201*i* and the third face 203*i* and is perpendicular to the fifth face (not shown) and the sixth face 206*i*. In other words, the eighth face 208*i* is inclined to the XY plane and the YZ plane and is perpendicular to the XZ plane.

The adapter 299 of the cartridge 20*i* has the faces forming the first face 201, the third face 203, the fourth face 204, the fifth face 205, the sixth face 206, the seventh face 207 and the eighth face 208 of the cartridge 20*i*. The face of the adapter 299 forming the second face 202 of the cartridge 20*i* is an opening. The adapter 299 has an inner space to receive the container assembly 200*i*. The first face 201 of the adapter 299 has an ink supply port 280.

The structure of the cartridge 20*i* shown in FIG. 35 is similar to that of the cartridge 20 of the first embodiment shown in FIG. 7 and those of its modifications, except that the cartridge 20*i* is separable to the container assembly 200*i* and the adapter 299 as explained above. According to other embodiments and other modifications, the cartridge may be configured to be separable to a container assembly and an adapter, like the cartridge 20*i* of FIG. 35. The cartridge 20*i* illustrated in FIG. 35 is configured to have different dimensions and ratios in some parts and components from those of the cartridge 20 of the first embodiment, but may be configured to have the same dimensions and ratios to those of the cartridge 20 of the first embodiment.

Figure 36:
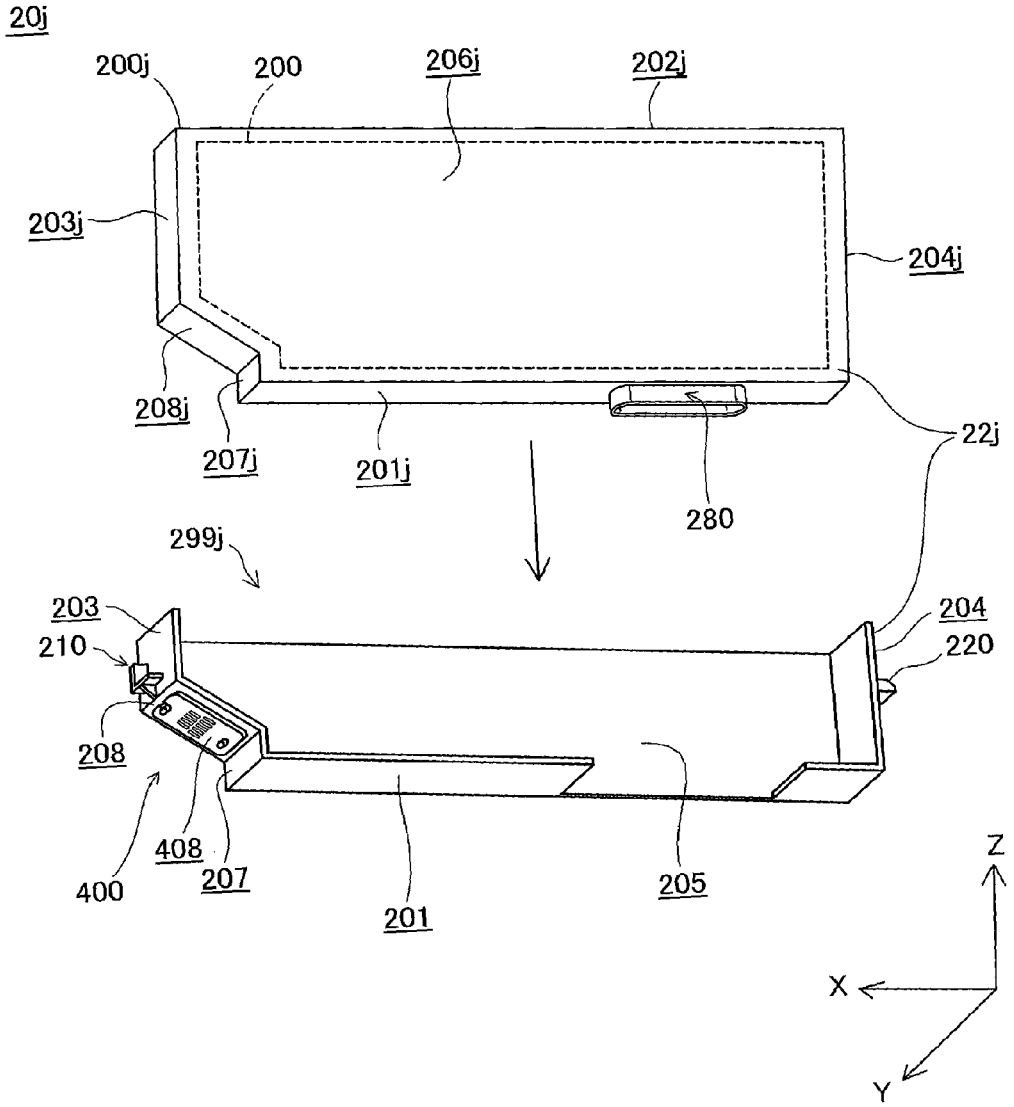
FIG. 36 is a perspective view illustrating the structure of another cartridge with an adapter.

FIG. 36 is a perspective view illustrating the structure of a cartridge 20*j* with an adapter. The cartridge 20*j* is configured to be separable to a container assembly 200*j* and an adapter 299*j*. The container assembly 200*i* has a printing material chamber 200 structured to contain printing material. When the printing material in the printing material chamber 200 is used up, the user may replace the container assembly 200*j* with a new one or may refill the printing material into the printing material chamber 200 of the container assembly 200*j*. The adapter 299*j* is reusable with the replaced container assembly 200*j* or with the container assembly 200*j* having the printing material refilled. The cartridge 20*j* of FIG. 36 is compatible with the cartridge 20 of the first embodiment shown in FIG. 7.

A housing 22*j* for the cartridge 20*j* is structured as a combination of a housing for the container assembly 200*j* and a housing for the adapter 299*j*. The container assembly 200*j* has the printing material chamber 200 and an ink supply port 280.

The container assembly 200*j* of the cartridge 20*j* has a second face 202*j* and a sixth face 206*j* respectively corresponding to the second face 202 and the sixth face 206 of the cartridge 20*j*. The container assembly 200*j* also has a first face 201*j*, a third face 203*j*, a fourth face 204*j*, a fifth face (not shown), a seventh face 207*j* and an eighth face 208*j* respectively corresponding to the first face 201, the third face 203, the fourth face 204, the fifth face 205, the seventh face 207 and the eighth face 208 of the cartridge 20*j*.

The first face 201*j* and the second face 202*j* are opposed to each other in the Z-axis direction; the first face 201*j* is located on the negative Z-axis side and the second face 202*j* is located on the positive Z-axis side. The third face 203*j* and the fourth face 204*j* are opposed to each other in the X-axis direction; the third face 203*j* is located on the positive X-axis side and the fourth face 204*j* is located on the negative X-axis side. The fifth face (not shown) and the sixth face 206*j* are opposed to each other in the Y-axis direction; the fifth face (not shown) is located on the positive Y-axis side and the sixth face 206*j* is located on the negative Y-axis side. The seventh face 207*j* and the eighth face 208*j* form the connection faces to connect the first face 201*j* with the third face 203*j*.

The seventh face 207*j* is perpendicular to the first face 201*j* and forms a plane parallel to the Y axis and the Z axis (YZ plane). The seventh face 207*j* is the step vertical-angled relative to the first face 201*j*. The seventh face 207*j* is accordingly extended from the first face 201*j* in the positive Z-axis direction. The seventh face 207*j* is located on the negative X-axis side and on the negative Z-axis side of the eighth face 208*j*.

The eighth face 208*j* connects the seventh face 207*j* with the third face 203*j* and is a sloped surface inclined in the direction including a positive X-axis component and a negative Z-axis component. The eighth face 208*j* is inclined to the first face 201*j* and the third face 203*j* and is perpendicular to the fifth face (not shown) and the sixth face 206*j*. In other words, the eighth face 208*j* is inclined to the XY plane and the YZ plane and is perpendicular to the XZ plane.

The adapter 299*j* of the cartridge 20*i* has the faces forming the first face 201, the third face 203, the fourth face 204 and the fifth face 205 of the cartridge 20*j*. The faces of the adapter 299*j* forming the second face 202 and the sixth face 206 of the cartridge 20*j* are openings. The adapter 299*j* has an inner space to receive the container assembly 200*j*. The adapter 299*j* also has an opening in part of the first face 201. The ink supply port 280 provided in the container assembly 200*j* is exposed on the opening and is connected with the ink supply tube 640.

The structure of the cartridge 20*j* shown in FIG. 36 is similar to that of the cartridge 20 of the first embodiment shown in FIG. 7 and those of its modifications, except that the cartridge 20*j* is separable to the container assembly 200*j* and the adapter 299*j* as explained above. According to other embodiments and other modifications, the cartridge may be configured to be separable to a container assembly and an adapter, like the cartridge 20*j* of FIG. 36.

The cartridge 20*j* illustrated in FIG. 36 is configured to have different dimensions and ratios in some parts and components from those of the cartridge 20 of the first embodiment, but may be configured to have the same dimensions and ratios to those of the cartridge 20 of the first embodiment. The cartridge 20*j* of FIG. 36 does not have the projection 260 but may have the projection 260 like the first embodiment.

Figure 37:
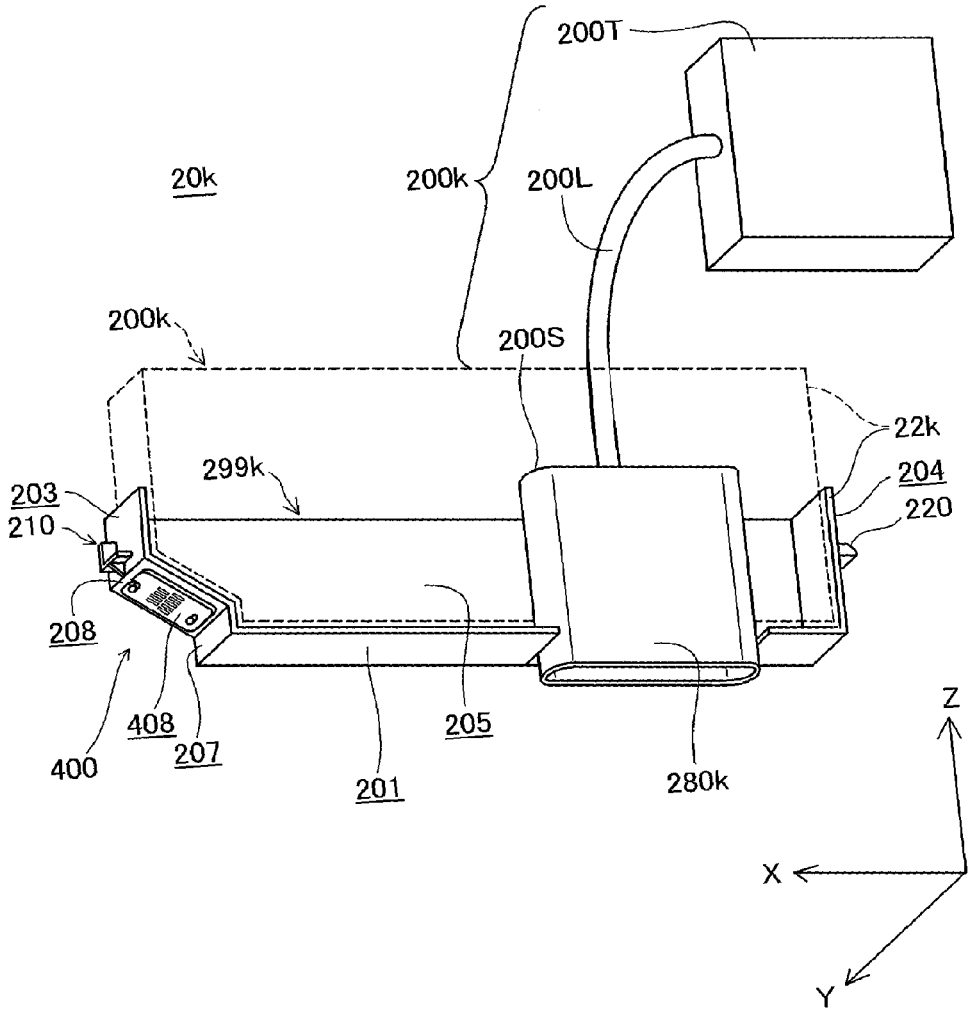
FIG. 37 is a perspective view illustrating the structure of another cartridge with an adapter.

FIG. 37 is a perspective view illustrating the structure of a cartridge 20*k* with an adapter. The cartridge 20*k* includes an adapter 299*k*, an external tank 200T, a tube 200L and an auxiliary adapter 200S. The adapter 299*k* of the cartridge 20*k* has the same structure as that of the adapter 299*j* of FIG. 36 and those of its modifications.

The external tank 200T of the cartridge 20*k* contains printing material and is located outside the printer 50 shown in FIG. 1 according to this modification. The printing material contained in the eternal tank 200T is supplied to the auxiliary adapter 200S via the tube 200L. The auxiliary adapter 200S of the cartridge 20*k* has an ink supply port 280*k*, which corresponds to the ink supply port 280 of the first embodiment.

The external tank 200T, the auxiliary adapter 200S and the tube 200L serve as a container assembly 200*k* configured to contain ink. As shown by the broken line, the cartridge 20*k* of FIG. 37 is assumed to have the container assembly 200*k*. A housing 22*k* of the cartridge 20*k* is structured as a combination of a housing for the virtual container assembly 200*k* and a housing for the adapter 299*k*.

The cartridge 20*k* of FIG. 37 is thus separable to the container assembly 200*k* and the adapter 299*k*, like the cartridge 20*i* shown in FIG. 35 and the cartridge 20*j* shown in FIG. 36. When the printing material in the external tank 200T is used up, the user may replace the external tank 200T with a new one or may refill the printing material into the external tank 200T. The adapter 299*k* is reusable with the replaced external tank 200T or with the external tank 200T having the printing material refilled. The cartridge 20*k* of FIG. 37 is compatible with the cartridge 20 of the first embodiment shown in FIG. 7.

The structure of the cartridge 20*k* shown in FIG. 37 is similar to that of the cartridge 20 of the first embodiment shown in FIG. 7 and those of its modifications, except that the cartridge 20*k* is separable to the container assembly 200*k* and the adapter 299*k* as explained above. According to other embodiments and other modifications, the cartridge may be configured to be separable to a container assembly and an adapter, like the cartridge 20*k* of FIG. 37.

D-5. Modifications of Circuit Board 400 and Terminal Array

The cartridge 20 has the circuit board 400 according to the above embodiments, but may not have the circuit board 400 according to other embodiments. The cartridge-side terminals may be formed directly on the eighth face 208. In this application, the eighth face 208 forms the cartridge-side sloped surface 408.

Part of wiring and the memory unit 420 on the circuit board 400 may be provided at any suitable location other than the eighth face 208. For example, part of wiring, the memory unit 420 and the cartridge-side terminals 431 to 439 may be provided on a flexible printed circuit board having the larger area than the circuit board 400. The flexible printed circuit board may be folded, so as to locate the cartridge-side terminals 431 to 439 on the eighth face 208. In another example, part of wiring and the memory unit 420 may be provided on the fifth face 205 adjacent to the eighth face 208.

Each of the cartridge-side terminals and the apparatus-side terminals may be arrayed in one single line or in three or more lines, instead of the two lines.

The shape and the array of the cartridge-side terminals 431 to 439 are not limited to those shown in FIG. 12A.

Figure 38A:
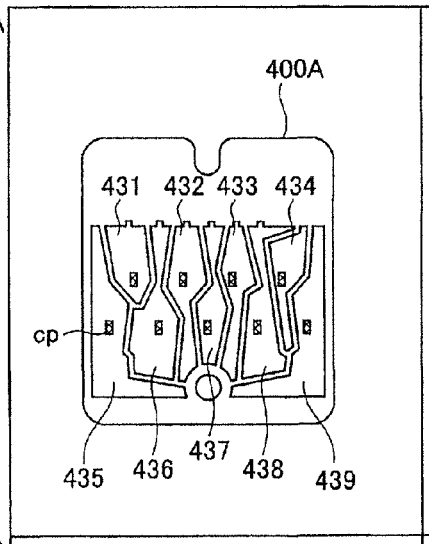
FIGS. 38A to 38C illustrate modifications of terminal shape.
Figure 38B:
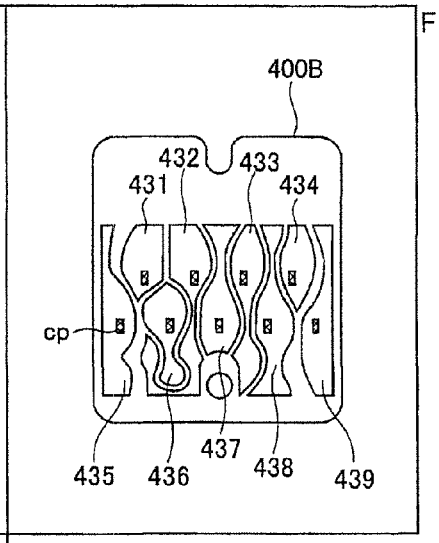
Figure 38C:
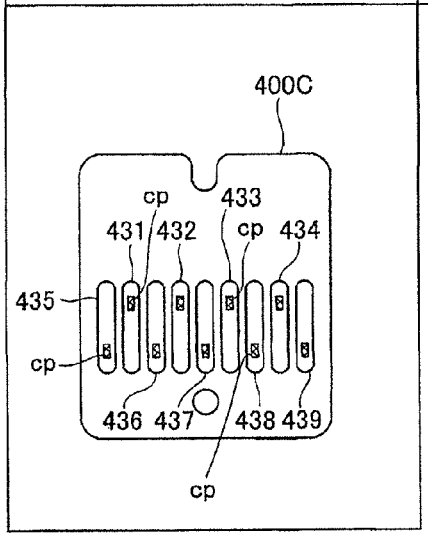

FIGS. 38A to 38C show modifications of the shape of the cartridge-side terminals. Circuit boards 400A, 400B and 400C of FIGS. 38A, 38B and 38C according to the modifications have the same structure as that of the circuit board 400 of FIG. 12A according to the first embodiment, except the outer shape of the cartridge-side terminals 431 to 439.

The cartridge-side terminals 431 to 439 on the circuit board 400A shown in FIG. 38A have irregular polygonal shapes, instead of the approximate rectangular shape of the cartridge-side terminals 431 to 439 on the circuit board 400 of FIG. 12A.

The cartridge-side terminals 431 to 439 on the circuit board 400B shown in FIG. 38B have shapes defined by irregular straight lines and curves, instead of the approximate rectangular shape of the cartridge-side terminals 431 to 439 on the circuit board 400 of FIG. 12A.

The cartridge-side terminals 431 to 439 on the circuit board 400C shown in FIG. 38C have an identical straight line shape of a predetermined width and are arrayed in one line in its width direction. The cartridge-side terminals (attachment detection terminals) 435 and 439 are located on both ends of the array of the aligned cartridge-side terminals 431 to 439. The cartridge-side terminal (attachment detection terminal) 431 is located between the cartridge-side terminal (attachment detection terminal) 435 and the cartridge-side terminal (power terminal) 436. The cartridge-side terminal (attachment detection terminal) 434 is located between the cartridge-side terminal (attachment detection terminal) 439 and the cartridge-side terminal (data terminal) 438.

In these circuit boards 400A, 400B and 400C shown in FIGS. 38A, 38B and 38C according to the modifications, the contact portions "cp" of these terminals 431 to 439, which are in contact with the corresponding apparatus-side terminals, have the same arrangement as that of the circuit board 400 shown in FIG. 12A according to the first embodiment. The individual terminals may have the outer shapes of various variations as long as the contact portions "cp" have the same arrangement.

E. Other Modifications

Among the various constituents, components and parts according to the above embodiments, those non-relevant to any of specific objects, functions, operations, effects and advantages may be omitted. For example, the memory unit 420 of the cartridge 20 may be replaced by another electric device.

Some of separate members and parts according to the above embodiments may not be necessarily structured as discrete members and parts, but a plurality of members or parts may be integrally formed as appropriate. On the contrary, a single member or part according to the above embodiments may be constructed as a combination of a plurality of members or parts as appropriate.

The invention is not restricted to the inkjet printer and its ink cartridge but is applicable to any of various liquid ejection devices configured to eject a liquid other than ink and its liquid container, for example, liquid ejection devices and their liquid containers given below:

image recording device, such as a facsimile machine;

color material ejection device used to manufacture color filters for image display devices, e.g., liquid crystal displays;

electrode material ejection device used to form electrodes of, for example, organic EL (electroluminescence) displays and field emission displays (FED);

liquid ejection device configured to eject a bioorganic material-containing liquid used for manufacturing biochips;

sample ejection device used as a precision pipette;

lubricating oil spray device;

resin solution spray device;

liquid spray device for pinpoint spray of lubricating oil at precision machinery including watches and cameras;

liquid ejection device configured to eject transparent resin solution, such as ultraviolet curable resin solution, onto the substrate, so as to manufacture a hemispherical microlens (optical lens) used for, for example, optical communication elements;

liquid spray device configured to spray an acidic or alkaline etching solution, in order to etch the substrate; and liquid ejection device equipped with liquid ejection head for ejecting a very small volume of droplets of another arbitrary liquid.

The "liquid droplet" means a state of liquid ejected from the liquid ejection device and may include granular liquid, teardrop liquid and tapered threadlike liquid. The "liquid" herein may be any material ejectable by the liquid ejection device. The "liquid" may be any material in the liquid phase. For example, liquid-state materials of high viscosity or low viscosity, sols, gel water, various inorganic solvents and organic solvents, solutions, liquid resins and liquid metals (metal melts) are included in the "liquid". The "liquid" is not restricted to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The "ink" includes general water-based inks and oil-based inks, as well as various liquid compositions, such as gel inks and hot-melt inks.

While the invention has been described with reference to exemplary embodiments thereof, it is to be understood that the invention is not limited to the disclosed embodiments or constructions. On the contrary, the invention is intended to cover various modifications and equivalent embodiments. In addition, while the various elements of the disclosed invention are shown in various combinations and configurations, which are exemplary, other combinations and configurations, including more, less or only a single element, are also within the spirit and scope of the invention.

What is claimed is:

1. A cartridge configured to be removably attached to a cartridge mounting structure of a printing apparatus comprising a printing material supply tube, an apparatus-side terminal constructed to apply a pressing force to the cartridge when the cartridge is mounted to the cartridge mounting structure and a lever comprising a first apparatus-side locking element, the cartridge comprising:

a first face located on a negative Z-axis side and a second face located on a positive Z-axis side, as two faces opposed to each other in a Z-axis direction;

a third face located on a positive X-axis side and a fourth face located on a negative X-axis side, as two faces opposed to each other in an X-axis direction and intersecting the first face and the second face;

a fifth face located on a positive Y-axis side and a sixth face located on a negative Y-axis side, as two faces opposed to each other in a Y-axis direction and intersecting the first, second, third and fourth faces;

a sloped surface provided in a corner section arranged to connect the first face with the third face and inclined in a negative Z-axis direction and in a positive X-axis direction;

a printing material supply port provided on the first face and configured to be connectable with the printing material supply tube;

a cartridge-side terminal provided on the sloped surface and configured to be in contact with the apparatus-side terminal while receiving the pressing force including the positive Z-axis component from the apparatus-side terminal, so as to be electrically connected with the apparatus-side terminal, in an attached state of the cartridge to the cartridge mounting structure; and a cartridge-side locking portion adjacent to the sloped surface, the cartridge-side locking portion configured to engage with the first apparatus-side locking element in the attached state of the cartridge to the cartridge mounting structure, and a projection adjacent to the cartridge-side locking portion, the projection protruded in the positive X-axis direction from the third face and provided on the positive Z-axis side of the locking portion.

2. The cartridge according to claim 1, wherein the projection is formed in a shape that is configured and adapted to prevent a first end of the lever from moving in a positive Z-axis direction from the cartridge-side locking portion.

3. The cartridge according to claim 1, further comprising a sloped portion adjacent to the sloped surface, the sloped surface provided on the negative Z-axis side of the locking portion.

4. The cartridge according to claim 1, wherein the projection is formed integrally with the cartridge-side locking portion.

5. The cartridge according to claim 1, wherein the projection is formed separately from the cartridge-side locking portion.

6. A printing material supply system comprising:

the cartridge according to claim 1, removably attached to the cartridge mounting structure;

the printing apparatus comprising the cartridge mounting structure, the cartridge mounting structure comprising the printing material supply tube, the apparatus-side terminal, and the lever comprising the first apparatus-side locking element and a second apparatus-side locking element;

wherein the cartridge mounting structure is configured to receive a plurality of the cartridges attached thereto and further comprises a corresponding respective additional printing material supply tube, a corresponding respective additional apparatus-side terminal, and a corresponding respective additional lever having a first apparatus-side locking element and a second apparatus-side locking element for each of the cartridges of the plurality of cartridges, and the printing material supply tube has a peripheral end adapted to be connected with the cartridge, wherein the Z axis represents an axis parallel to a central axis C of the printing material supply tube, the X axis represents an axis along which the printing material supply tube and the apparatus-side terminal are arrayed and which is orthogonal to the Z axis, and the Y axis represents an axis orthogonal to both the Z axis and the X axis, wherein a positive Z-axis direction represents a direction along the Z axis going from a base end to the peripheral end of the printing material supply tube, the negative Z-axis direction represents a reverse direction to the positive Z-axis direction, the positive X-axis direction represents a direction along the X axis going from the printing material supply tube to the apparatus-side terminal, and the negative X-axis direction represents a reverse direction to the positive X-axis direction, wherein the apparatus-side terminal is configured to be in contact with the cartridge while applying the pressing force including a positive Z-axis component to the cartridge, so as to be electrically connectable with the cartridge, the apparatus-side locking element is configured as part of the lever to lock the cartridge at a position on a positive Z-axis side and on a positive X-axis side of the apparatus-side terminal, and the lever is configured to turn about a pivotal center on a positive Z-axis side and on a positive X-axis side of a locking position where the apparatus-side locking element locks the cartridge, so as to move the apparatus-side locking element from the locking position in the positive X-axis direction and thereby allow the apparatus-side locking element to lock and unlock the cartridge.

7. The printing material supply system according to claim 6, wherein the lever defines an undercut element corresponding to the projection in a state that the apparatus-side locking element engages with the cartridge-side locking element.

* * * * *